United States Patent [19]

Gray, Jr.

[11] 4,198,680

[45] Apr. 15, 1980

[54] CONTROL SYSTEM FOR ELECTROSTATIC TYPE COPY REPRODUCING MACHINES

[75] Inventor: Gerald A. Gray, Jr., Fairport, N.Y.

[73] Assignee: Xerox Corporation, Stamford, Conn.

[21] Appl. No.: 829,030

[22] Filed: Aug. 30, 1977

[51] Int. Cl.[2] ..... G06F 15/20; G03G 15/00

[52] U.S. Cl. ..... 364/518; 355/14 R; 364/107

[58] Field of Search ..... 235/302, 304, 304.1; 364/200, 900, 518, 107, 300; 355/14

[56] References Cited

U.S. PATENT DOCUMENTS

| | | | |
|---|---|---|---|
| 3,936,182 | 2/1976 | Sheikh | 355/14 |
| 4,035,072 | 7/1977 | Deetz et al. | 355/14 |
| 4,062,061 | 12/1977 | Batchelor et al. | 364/900 |
| 4,107,777 | 8/1978 | Fisk et al. | 364/518 |
| 4,120,034 | 10/1978 | Fisk et al. | 364/518 |

*Primary Examiner*—Charles E. Atkinson
*Attorney, Agent, or Firm*—John E. Beck; Ronald F. Chapuran; Frederick E. McMullen

[57] ABSTRACT

An electrostatographic type copying or reproduction machine incorporating a programmable controller to operate the various machine components in an integrated manner to produce copies is disclosed. The controller carries a master program bearing machine operating parameters from which an operating program for the specific copy run desired is formed and used to operate the machine components to produce the copies programmed. A multiple prioritized interrupt system interrupts the background routine in use to carry out the next scheduled foreground routine as appropriate. Since the interrupt interval is limited, overlong foreground routines, if called by the copy run programmed, are spooled by placing a portion or all of the overlong routine in background.

3 Claims, 51 Drawing Figures

FROM CLOCK 552
Ø1
Ø2
542
507
510
TO: MEMORY 545,546
ADDRESS
A0
A15
(HOLD A)
(HOLD)
(DBIN)
EN
TO: MEMORY
TO: MEMORY 545,546
508
D0
DATA
D7
511
TO: MEMORY READY 548
(MEMR)
(OUT)
(WO)
(INP)
(MI)
(HALTA)
(STACK)
(INTA)
LATCH REGISTER
Ø1-1
FROM: 552
(SYNC)
(READY)
FROM: MEMORY READY 548
(INT)
(RESET)
(WAIT)
FROM: 550
(INTE)
(WR)
TO: MEMORY 546,545

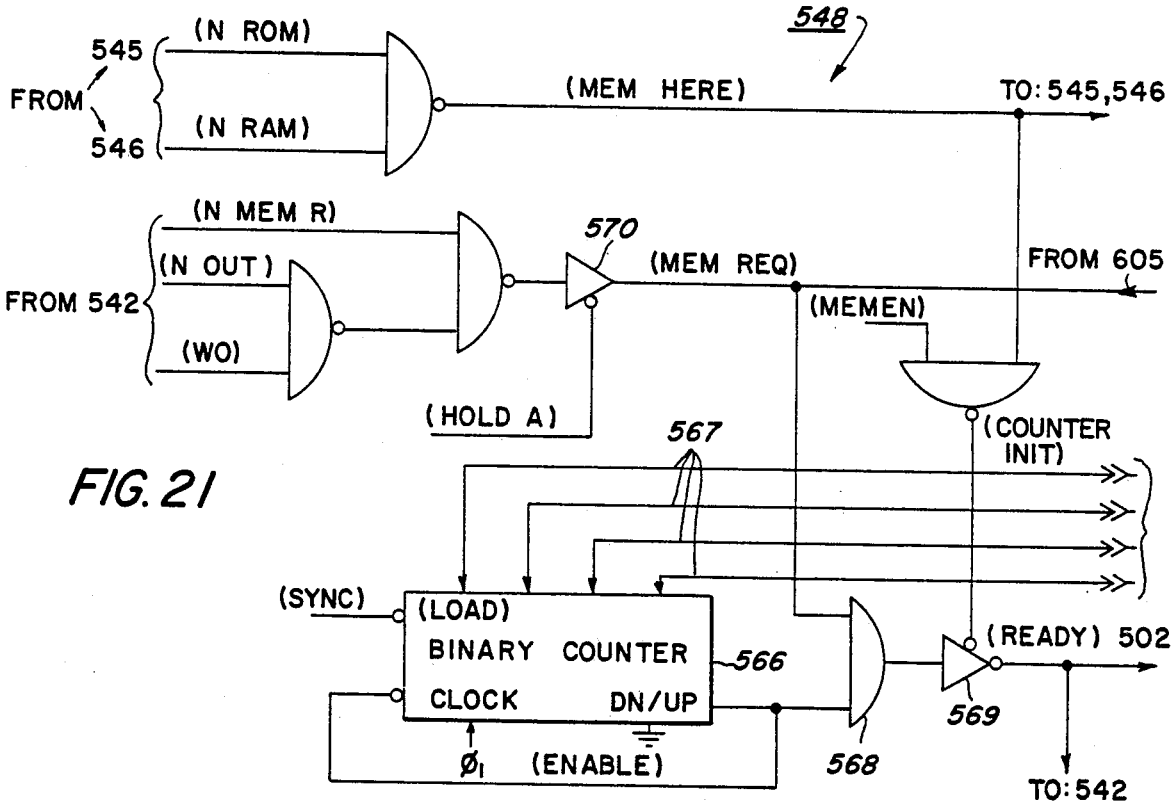
FIG. 21
MEMORY READY
FIG. 24
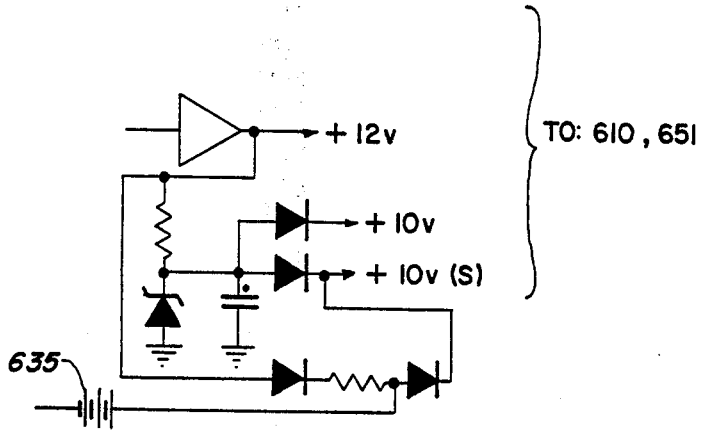

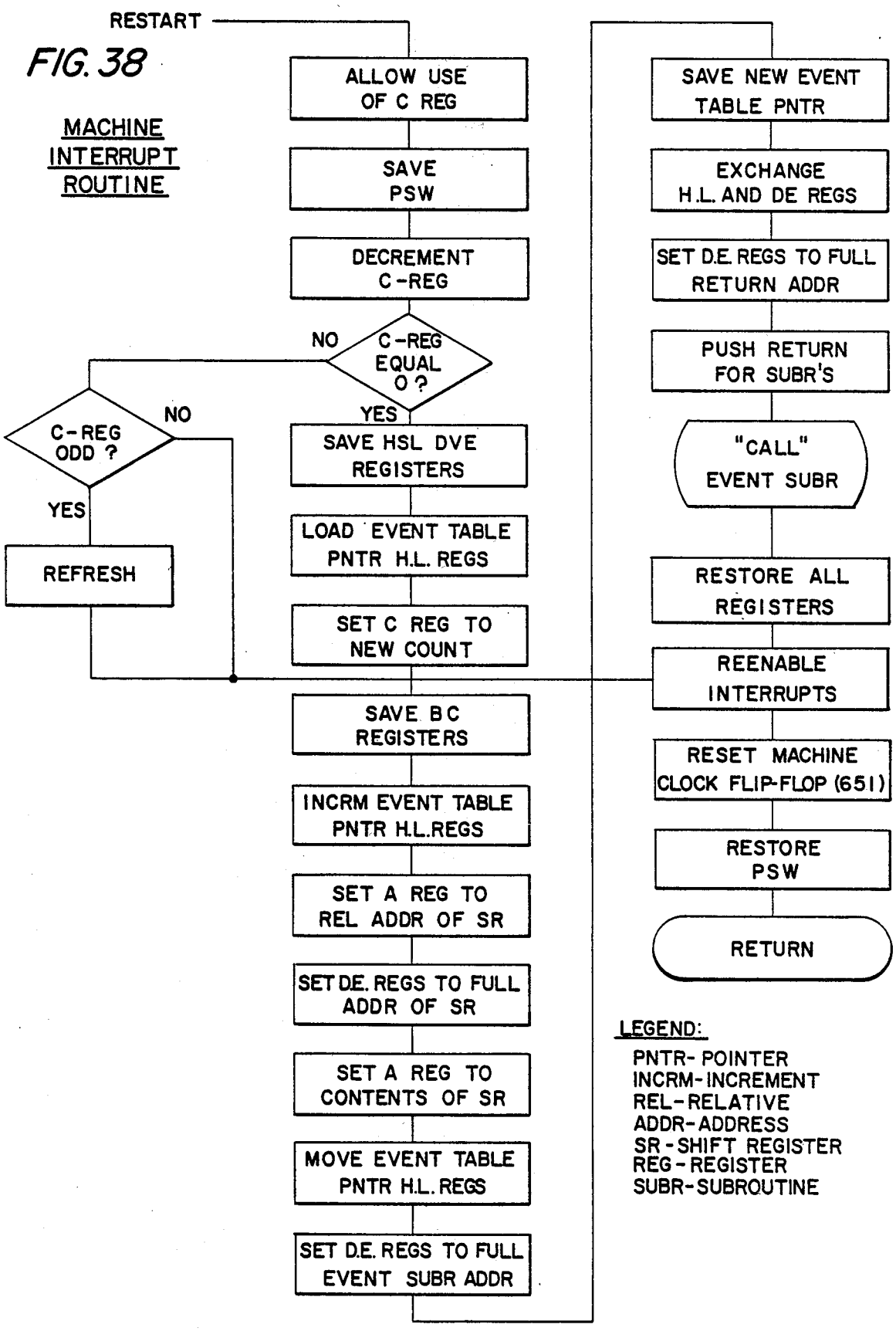
RESTART
FIG. 38
MACHINE INTERRUPT ROUTINE
ALLOW USE OF C REG
SAVE PSW
DECREMENT C-REG
C-REG EQUAL 0 ?
NO
YES
C-REG ODD ?
NO
YES
REFRESH
SAVE HSL DVE REGISTERS
LOAD EVENT TABLE PNTR H.L. REGS
SET C REG TO NEW COUNT
SAVE BC REGISTERS
INCRM EVENT TABLE PNTR H.L.REGS
SET A REG TO REL ADDR OF SR
SET DE. REGS TO FULL ADDR OF SR
SET A REG TO CONTENTS OF SR
MOVE EVENT TABLE PNTR H.L. REGS
SET D.E. REGS TO FULL EVENT SUBR ADDR
SAVE NEW EVENT TABLE PNTR
EXCHANGE H.L. AND DE REGS
SET D.E. REGS TO FULL RETURN ADDR
PUSH RETURN FOR SUBR'S
"CALL" EVENT SUBR
RESTORE ALL REGISTERS
REENABLE INTERRUPTS
RESET MACHINE CLOCK FLIP-FLOP (651)
RESTORE PSW
RETURN
LEGEND:
PNTR- POINTER
INCRM-INCREMENT
REL-RELATIVE
ADDR-ADDRESS
SR-SHIFT REGISTER
REG-REGISTER
SUBR-SUBROUTINE

REAL TIME INTERRUPT

LEGEND:

PNTR - POINTER
RTC - REAL TIME COUNTER
CNTR - COUNTER
REG - REGISTER

CONTROL SYSTEM FOR ELECTROSTATIC TYPE COPY REPRODUCING MACHINES

BACKGROUND OF THE INVENTION

This invention relates to electrostatographic xerographic type reproduction machines, and more particularly, to an improved control system for such machines.

The advent of higher speed and more complex copiers and reproduction machines has brought with it a corresponding increase in the complexity in the machine control wiring and logic. While this complexity manifests itself in many ways, perhaps the most onerous involves in inflexibility of the typical control logic/wiring systems. For as can be appreciated, simple unsophisticated machines with relatively simple control logic and wiring can be altered and modified easily to incorporate changes, retrofits, and the like. Servicing and repair of the control logic is also fairly simple. On the other hand, some modern high speed machines, which often include sorters, a document handler, choice of copy size, multiple paper trays, jam protection and the like have extremely complex logic systems making even the most minor changes and improvements in the control logic difficult, expensive and time consuming. And servicing or repairing the machine control logic may similarly entail substantial difficulty, time and expense.

To mitigate problems of the type alluded to, a programmable controller may be used, enabling changes and improvements in the machine operation to be made through the expediency of reprogramming the controller. However, the control data which operates the machine and which is stored in the controller memory pending use, must be transferred to the various machine components at the proper time and in the correct sequence without unduly interfering with or intruding unnecessarily upon the other essential functions and operations of the controller.

It is therefore a principal object of the present invention to provide a new and improved control system for electrostatic type reproduction machines.

It is a further object of the present invention to provide a method, in a control system for copiers, to provide increased time for carrying out overlong control sequences.

It is an object of the present invention to provide, in a copier control system comprised of both real time based background control functions and synchronized foreground control functions interposed on the background control functions periodically, an arrangement for accommodating overlong foreground control functions by spooling at least a part of the overlong foreground control function in with the background control functions.

It is an object of the present invention to provide a system for controlling reproduction machines wherein overlong control functions are recognized and shifted from a synchronous timing constraint to a real timimg constraint.

This invention relates to the method of operating an electrostatic type copy reproducing machine to produce copies in accordance with copy run instructions, the machine including relatively permanent background operating routines for operating the machine and foreground routines, at least a portion of the foreground routines reflecting the copy run instructions, the steps which comprise: actuating the background routines in preset timed order to render the machine operable; interrupting the background routines periodically and in synchronism with the machine for a preset interval to carry out a foreground routine; shifting at least the portion of a foreground routine that cannot be completed in the preset interval into the background routine; and completing any of the overlong foreground routine on return to the background routine.

BRIEF DESCRIPTION OF THE DRAWINGS

Other objects and advantages will be apparent from the ensuing description and drawings in which:

FIG. 21 is a logic schematic of the CPU memory ready;

FIG. 24 is a logic schematic of the nonvolatile memory power supply;

FIG. 38 is a flow chart of the machine clock interrupt routine;

DETAILED DESCRIPTION OF THE PREFERRED EMBODIMENT OF THE INVENTION

Figure 1:
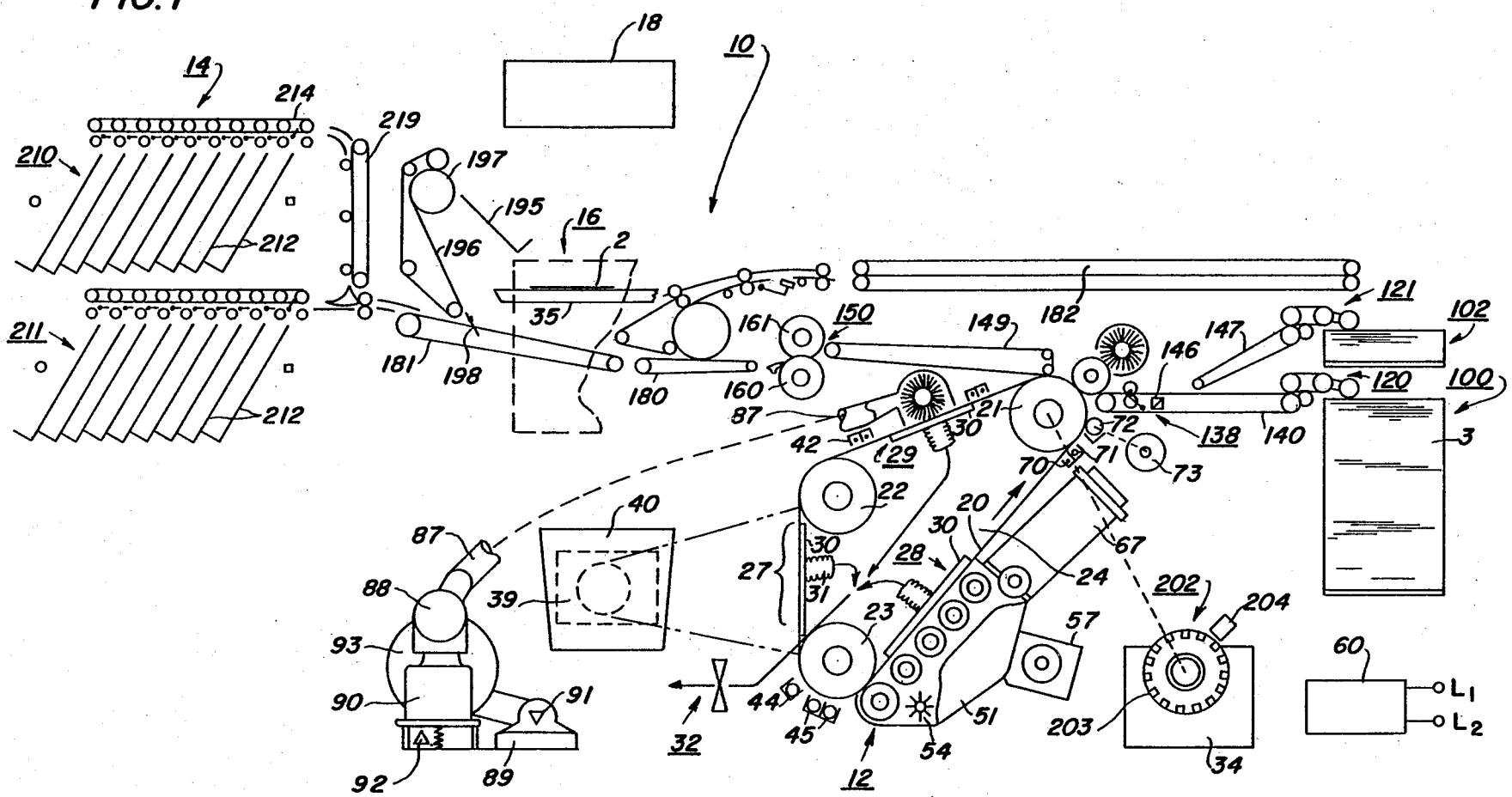
FIG. 1 is a schematic representation of an exemplary reproduction apparatus incorporating the control system of the present invention.
Figure 2:
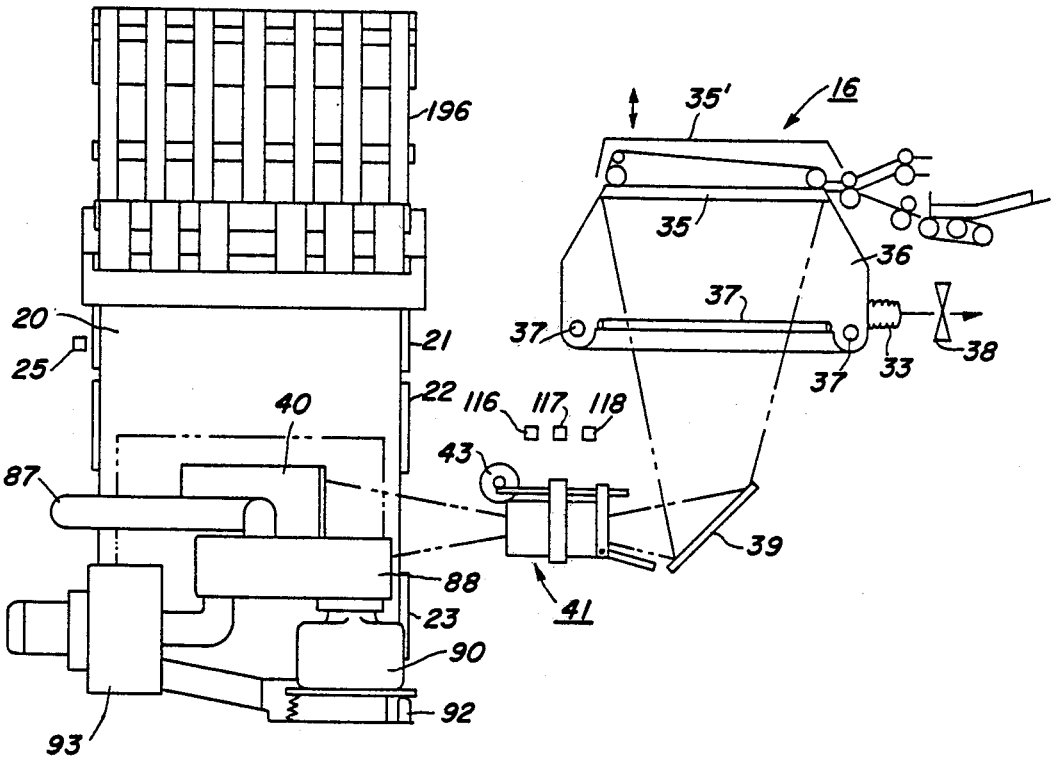
FIG. 2 is a vertical sectional view of the apparatus shown in FIG. 1 along the image plane.
Figure 3:
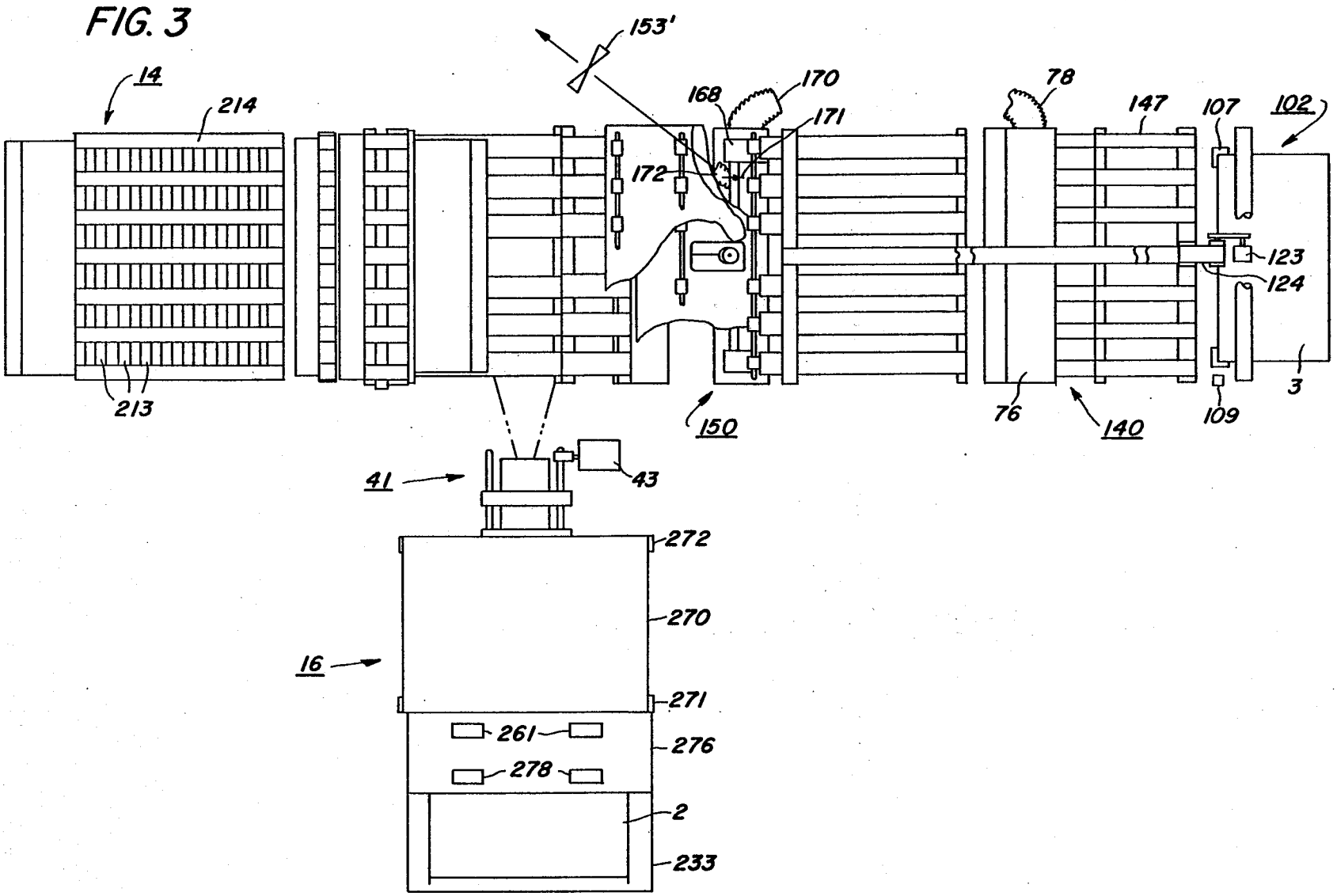
FIG. 3 is a top plane view of the apparatus shown in FIG. 1.

Referring particularly to FIGS. 1–3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combinations thereof may instead by envisioned.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type arrangements wherein webs of photoconductive material may be played in and out of the interior of supporting cylinders.

Figure 4:
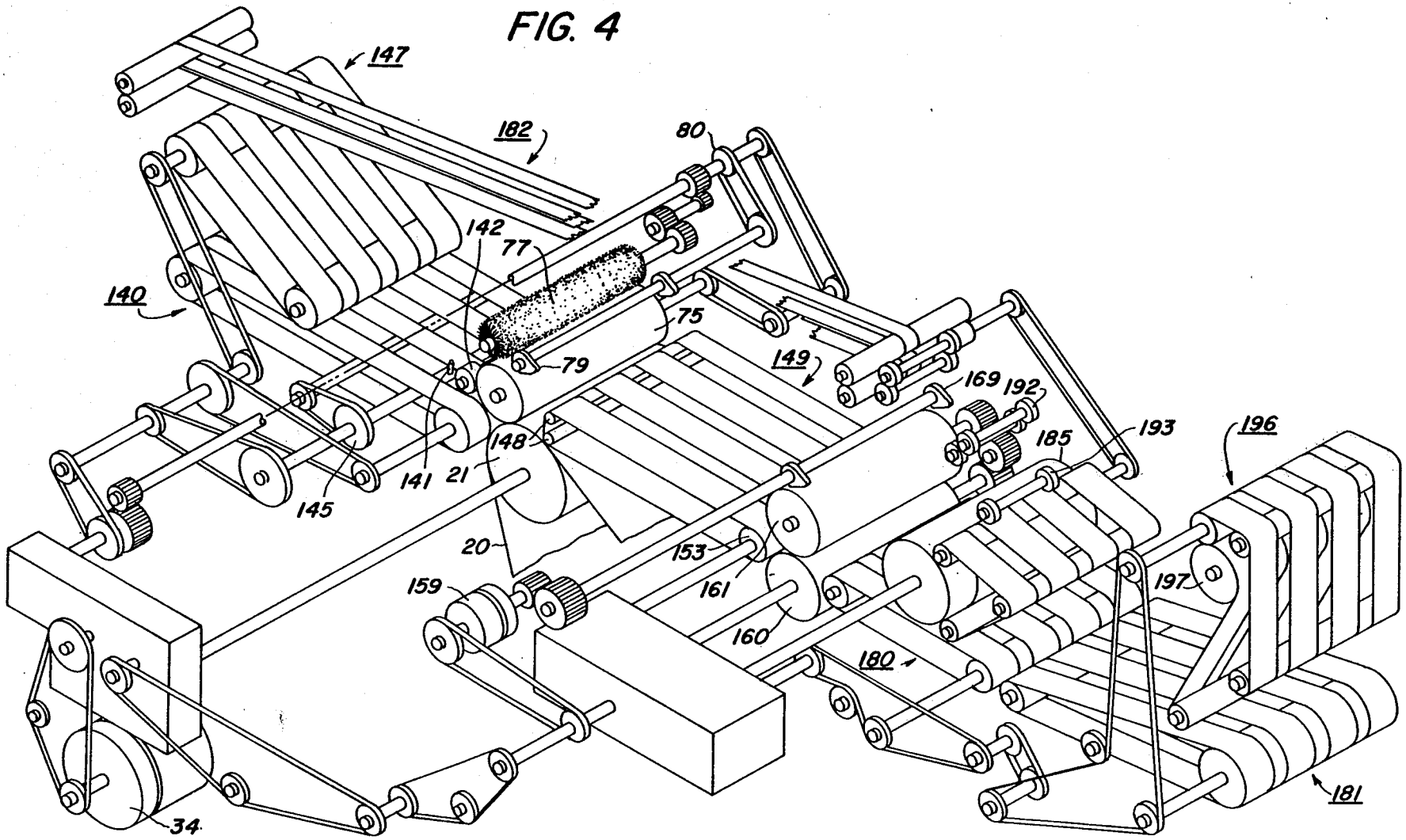
FIG. 4 is an isometric view showing the drive train for the apparatus shown in FIG. 1.

Suitable biasing means (not shown) are provided on subframe 24 to tension the photoreceptor belt 20 and insure movement of belt 20 along a prescribed operating bath. Belt tracking switch 25 (shown in FIG. 2) monitors movement of belt 20 from side to side. Belt 20 is supported so as to provide a trio of substantially flat belt runs opposite exposure, developing, and cleaning stations 27, 28, 29 respectfully. To enhance belt flatness at these stations, vacuum platens 30 are provided under belt 20 at each belt run. Conduits 31 communicate vacuum plates 30 with a vacuum pump 32. Photoconductive belt 20 moves in the direction indicated by the solid line arrow, drive thereto being effected through roll 21, which in turn is driven by main drive motor 34, as seen in FIG. 4.

Processor 12 includes a generally rectangular, horizontal transparent platen 35 on which each original 2 to be copied is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover 35′ may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 on operator module 800. (See FIG. 32) Sensors 116, 117, 118 signal the present disposition of lens assembly 41. Exposure of the previously charged belt 20 selectively discharges the photoconductive belt to produce on belt 20 an electrostatic latent image of the original 2. To prepare belt 20 for imaging, belt 20 is uniformly charged to a preselected level by charge corotron 42 upstream of the exposure station 27.

Figure 5:
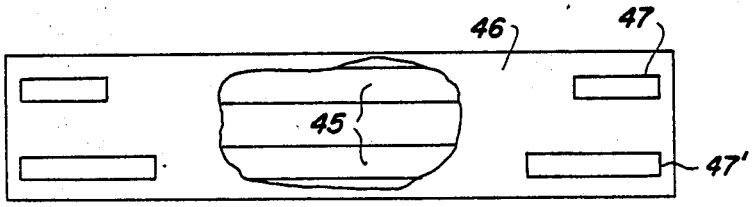
FIG. 5 is an enlarged view showing details of the photoreceptor edge fade-out mechanism for the apparatus shown in FIG. 1.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width of belt 20 to erase (i.e. discharge) areas of belt 20 before the first image, between successive images, and after the last image. Lamps 45, which are referred to herein as edge fadeout lamps, serve to erase areas bordering each side of the images. Referring particularly to FIG. 5, edge fadeout lamps 45, which extend transversely to belt 20, are disposed within a housing 46 having a pair of transversely extending openings 47, 47′ of differing length adjacent each edge of belt 20. By selectively actuating one or the other of the lamps 45, the width of the area bordering the sides of the image that is erased can be controlled.

Figure 6:
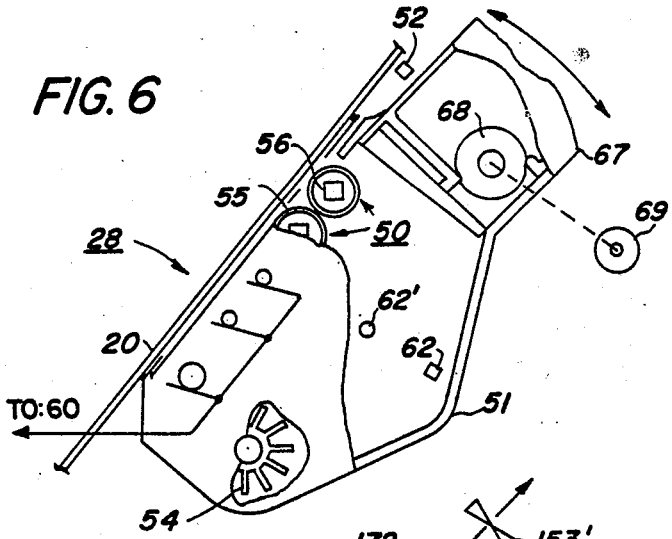
FIG. 6 is an enlarged view showing details of the developing mechanism for the apparatus shown in FIG. 1.
Figure 7:
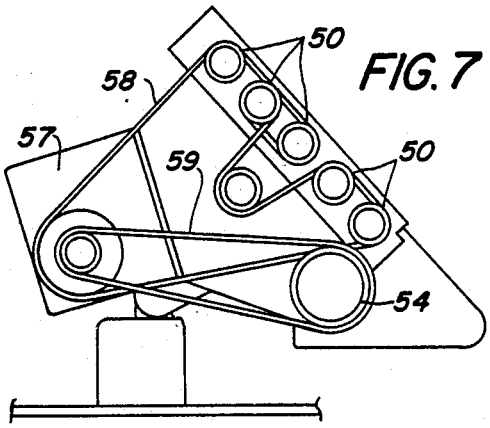
FIG. 7 is an enlarged view showing details of the developing mechanism drive.

Referring to FIGS. 1, 6 and 7, magnetic brush rolls 50 are provided in a developer housing 51 at developing station 28. Housing 51 is pivotally supported adjacent the lower end thereof with interlock switch 52 to sense disposition of housing 51 in operative position adjacent belt 20. The bottom of housing 51 forms a sump within which a supply of developing material is contained. A rotatable auger 54 in the sump area serves to mix the developing material and bring the material into operative relationship with the lowermost of the magnetic brush rolls 50.

As will be understood by those skilled in the art, the electrostatically attractable developing material commonly used in magnetic brush developing apparatus of the type shown comprises a pigmented resinous powder, referred to as toner, and larger granular beads referred to as carrier. To provide the necessary magnetic properties, the carrier is comprised of a magnetizable material such as steel. By virtue of the magnetic fields established by developing rolls 50 and the interrelationship between, a blanket of developing material is formed along the surfaces of developing rolls 50 adjacent the belt 20 and extending from one roll to another. Toner is attracted to the electrostatic latent image from the carrier bristles to produce a visible powder image on the surface of belt 20.

Magnetic brush rolls 50 each comprise a rotatable exterior sleeve 55 with relatively stationary magnet 56 inside. Sleeves 55 are rotated in unison and at substantially the same speed as belt 20 by a developer drive motor 57 through a belt and pulley arrangement 58. A second belt and pulley arrangement 59 drives auger 54.

To regulate development of the latent electrostatic images on belt 20, magnetic brush sleeves 55 are electrically biased. A suitable power supply 60 is provided for this purpose with the amount of bias being regulated by controller 18.

Figure 8:
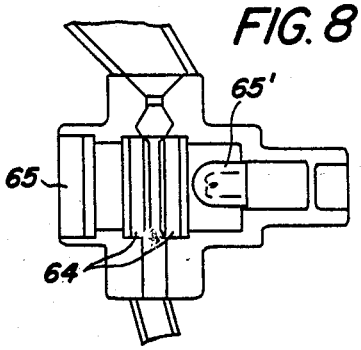
FIG. 8 is an enlarged view showing details of the developability control for the apparatus shown in FIG. 1.
Figure 11:
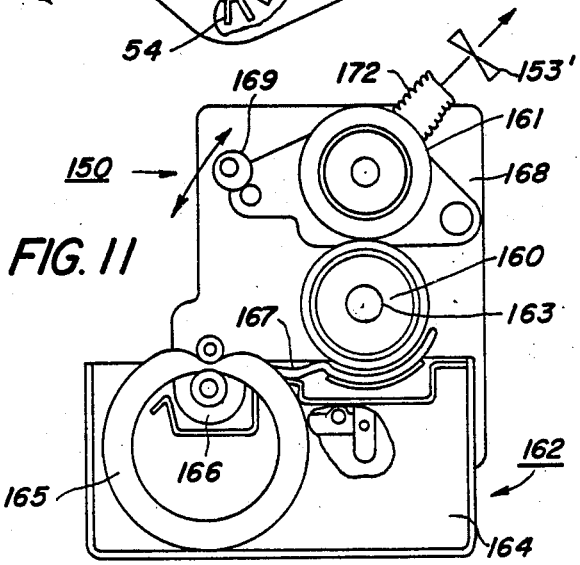
FIG. 11 is an enlarged view showing details of the fuser for the apparatus shown in FIG. 1.

Developing material is returned to the upper portion of developer housing 51 for reuse a photocell 62 monitors the level of developing material in housing 51 with lamp 62' therefor spaced opposite to the photocell 62. The disclosed machine is also provided with automatic developability control which maintains an optimum proportion of toner-to-carrier material by sensing toner concentration and replenishing toner, as needed. As shown in FIG. 8, the automatic developability control comprises a pair of transparent plates 64 mounted in spaced, parallel arrangement in developer housing 51 such that a portion of the returning developing material passes therebetween. A suitable circuit, not shown, alternately places a charge on the plates 64 to attract toner thereto. Photocell 65 on one side of the plate pair senses the developer material as the material passes therebetween. Lamp 65' on the opposite side of plate pair 64 provides reference illumination. In this arrangement, the returning developing material is alternately attracted and repelled to and from plates 64. The accumulation of toner, i.e. density determines the amount of light transmitted from lamp 65' to photocell 65. Photocell 65 monitors the density of the returning developing material with the signal output therefrom being used by controller 18 to control the amount of fresh or make-up toner to be added to developer housing 51 from toner supply container 67.

To discharge toner from container 67, rotatable dispensing roll 68 is provided in the inlet to developer housing 51. Motor 69 drives roll 68. When fresh toner is required, as determined by the signal from photocell 65, controller 18 actuates motor 69 to turn roll 68 for a timed interval. The rotating roll 68, which is comprised of a relatively porous sponge-like material, carries toner particles thereon into developer housing 51 where it is discharged. Pre-transfer corotron 70 and lamp 71 are provided downstream of magnetic brush rolls 50 to regulate developed image charges before transfer.

A magnetic pick-off roll 72 is rotatably supported opposite belt 20 downstream of pre-transfer lamp 71, roll 72 serving to scavenge leftover carrier from belt 20 preparatory to transfer of the developed image to the copy sheet 3. Motor 73 turns roll 72 in the same direction and at substantially the same speed as belt 20 to prevent scoring or scratching of belt 20. One type of magnetic pick-off roll is shown in U.S. Pat. No. 3,834,804, issued Oct. 10, 1974 to Bhagat et al.

Figure 9:
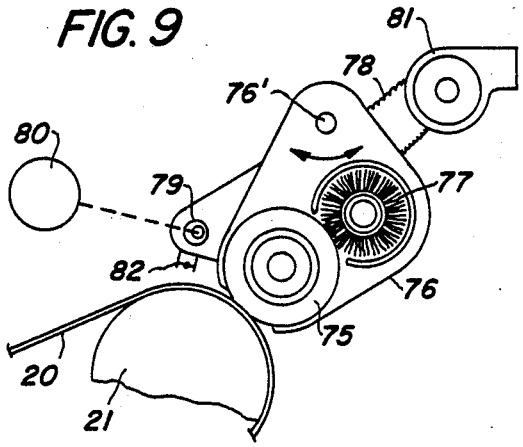
FIG. 9 is an enlarged view showing details of the transfer roll support mechanism for the apparatus shown in FIG. 1.
Figure 12:
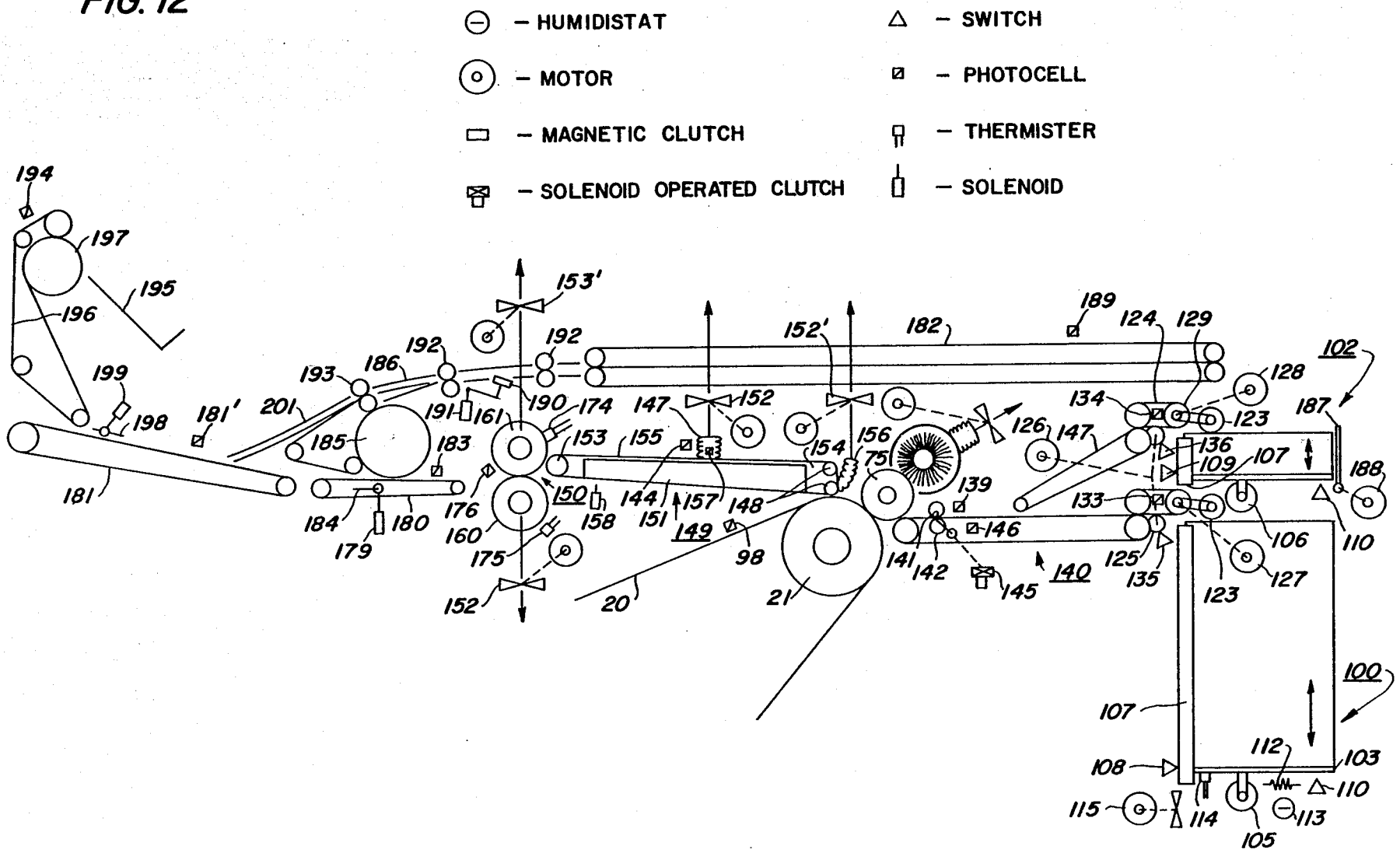
FIG. 12 is a schematic view showing the paper path and sensors of the apparatus shown in FIG. 1.

Referring to FIGS. 4, 9 and 12, to transfer developed images from belt 20 to the copy sheets 3, a transfer roll 75 is provided. Transfer roll 75, which forms part of the copy sheet feet path, is rotatably supported within a transfer roll housing 76 opposite belt support roll 21. Housing 76 is pivotally mounted for swinging movement about axis at 76' to permit the transfer roll assembly to be moved into and out of operative relationship with belt 20. A transfer roll cleaning brush 77 is rotatably journalled in transfer roll housing 76 with the brush periphery in contact with transfer roll 75. Transfer roll 75 is driven through contact with belt 20 while cleaning brush 77 is coupled to main drive motor 34. To remove toner, housing 76 is connected through conduit 78 with vacuum pump 81. To facilitate and control transfer of the developed images from belt 20 to the copy sheets 3, a suitable electrical bias is applied to transfer roll 75.

To permit transfer roll 75 to be moved into and out of operative relationship with belt 20, cam 79 is provided in driving contact with transfer roll housing 76. Cam 79 is driven from motor 34 through an electromagnetically operated one revolution clutch 80. Spring means (not shown) serves to maintain housing 76 in driving engagement with cam 79.

To facilitate separation of the copy sheets 3 from belt 20 following transfer of developed images, a detack corotron 82 is provided. Corotron 82 generates a charge designed to neutralize or reduce the charges tending to retain the copy sheet on belt 20. Corotron 82 is supported on transfer roll housing 76 opposite belt 20 and downstream of transfer roll 75.

Figure 10:
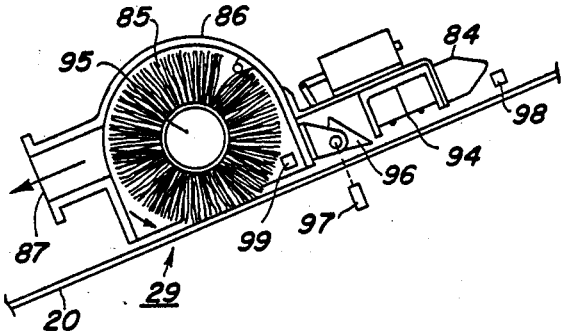
FIG. 10 is an enlarged view showing details of the photoreceptor cleaning mechanism for the apparatus shown in FIG. 1.

Referring to FIGS. 1, 2 and 10, to prepare belt 20 for cleaning, residual charges on belt 20 are removed by discharge lamp 84 and preclean corotron 94. A cleaning brush 85, rotatably supported within an evacuated semicircular shaped brush housing 86 at cleaning station 29, serves to remove residual developer from belt 20. Motor 95 drives brush 85, brush 85 turning in a direction opposite that of belt 20.

Vacuum conduit 87 couples brush housing 86 through a centrifugal type separator 88 with the suction side of vacuum pump 93. A final filter 89 on the outlet of pump 93 traps particles that pass through separator 88. The heavier toner particles separated by separator 88 drop into and are collected in one or more collecting bottles 90. Pressure sensor 91 monitors the condition of final filter 89 while a sensor 92 monitors the amount of toner particles in collecting bottles 90.

To obviate the danger of copy sheets retaining on belt 20 and becoming entangled with the belt cleaning mechanism, a deflector 96 is provided upstream of cleaning brush 85. Deflector 96, which is pivotally supported on the brush housing 86, is operated by solenoid 97. In the normal or off position, deflector 96 is spaced from belt 20 (the solid line position shown in the drawings). Energization of solenoid 97 pivots deflector 96 downwardly to bring the deflector leading edge into close proximity to belt 20.

Sensors 98, 99 are provided on each side of deflector 96 for sensing the presence of copy material on belt 20.

A signal output from upstream sensor 98 triggers solenoid 97 to pivot deflector 96 into position to intercept the copy sheet on belt 20. The signal from sensor 98 also initiates a system shutdown cycle (mis-strip jam) wherein the various operating components are, within a prescribed interval, brought to a stop. The interval permits any copy sheet present in fuser 150 to be removed, sheet trap solenoid 158 (FIG. 12) having been actuated to prevent the next copy sheet from entering fuser 150 and becoming trapped therein. The signal from sensor 99, indicating failure of deflector 96 to intercept or remove the copy sheet from belt 20, triggers an immediate or hard stop (sheet on selenium jam) of the processor. In such instances the power to drive motor 34 is interrupted to bring belt 20 and the other components driven therefrom to an immediate stop.

Referring particularly to FIGS. 1 and 12, copy sheets 3 comprise precut paper sheets supplied from either main or auxiliary paper trays 100, 102. Each paper tray has a platform or base 103 for supporting in stack-like fashion a quantity of sheets. The tray platforms 103 are supported for vertical up and down movement by motors 105, 106 being provided to raise and lower the platform. Side guide pairs 107, in each tray 100, 102 delimit the tray side boundaries, the guide pairs being adjustable toward and away from one another in accommodation of different size sheets. Sensors 108, 109 respond to the position of each side guide pair 107, the output of sensors 108, 109 serving to regulate operation of edge fadeout lamps 45 and fuser cooling valve 171 (FIG. 3). Lower limit switches 110 on each tray prevent overtravel of the tray platform in a downward direction.

A heater 112 is provided below the platform 103 of main tray 100 to warm the tray area and enhance feeding of sheets therefrom. Humidstat 113 and thermostat 114 control operation of heater 112 in response to the temperature/humidity conditions of main tray 100. Fan 115 is provided to circulate air within tray 100.

To advance the sheets 3 from either main or auxiliary tray 100, 102, main and auxiliary sheet feeders 120, 121 are provided. Feeders 120, 121 each include a nudger roll 123 to engage and advance the topmost sheet in the paper tray forward into the nip formed by a feed belt 124 and retard roll 125. Retard rolls 125, which are driven at an extremely low speed by motor 126, cooperate with feed belts 124 to restrict feeding of sheets from trays 100, 102 to one sheet at a time.

Feed belts 124 are driven by main and auxiliary sheet feed motors 127, 128 respectively. Nudger rolls 123 are supported for pivotal movement about the axis of feed belt drive shaft 129 with drive to the nudger rolls taken from drive shaft 129. Stack height sensors 133, 134 are provided for the main and auxiliary trays, the pivoting nudger rolls 123 serving to operate sensors 133, 134 in response to the sheet stack height. Main and auxiliary tray misfeed sensors 135, 136 are provided at the tray outlets.

Main transport 140 extends from main paper tray 100 to a point slightly upstream of the nip formed by photoconductive belt 20 and transfer roll 75. Transport 140 is driven from main motor 34. To register sheets 3 with the images developed on belt 20, sheet register fingers 141 are provided, fingers 141 being arranged to move into and out of the path of the sheets on transport 140 once each revolution (see also FIG. 4). Registration fingers 141 are driven from main motor 34 through electromagnetic clutch 145 (see in FIG. 4). A timing or reset switch 146 is set once on each revolution of sheet register fingers 141. Sensor 139 monitors transport 140 for jams. Further amplification of sheet register system may be found in U.S. Pat. No. 3,781,004, issued Dec. 25, 1973 to Buddendeck et al.

Pinch roll pair 142 is interspaced between transport belts that comprise main transport 140 on the downstream side of register fingers 141. Pinch roll pair 142 are driven from main motor 34.

Auxiliary transport 147 extends from auxiliary tray 102 to main transport 140 at a point upstream of sheet register fingers 141. Transport 147 is driven from motor 34.

To maintain the sheets in driving contact with the belts of transports 140, 147, suitable guides or retainers (not shown) may be provided along the belt runs.

The image bearing sheets leaving the nip formed by photoconductive belt 20 and transfer roll 75 are picked off by belts 155 of the leading edge of vacuum transport 149. Belts 155, which are perforated for the admission of vacuum therethrough, ride on forward roller pair 148 and rear roll 153. A pair of internal vacuum plenums 151, 154 are provided, the leading plenum 154 cooperating with belts 155 to pick up the sheets leaving the belt/transfer roll nip. Transport 149 conveys the image bearing sheets to fuser 150. Vacuum conduits 147, 156 communicate plenums 151,154 with vacuum pumps 152, 152'. A pressure sensor 157 monitors operation of vacuum pump 152. Sensor 144 monitors transport 149 for jams.

To prevent the sheet on transport 149 from being carried into fuser 150 in the event of a jam or malfunction, a trap solenoid 158 is provided below transport 149. Energization of solenoid 158 raises the armature thereof into contact with the lower face of plenum 154 to intercept and stop the sheet moving therepast.

Referring particularly to FIGS. 3, 4, 11 and 12, fuser 150 comprises a lower heated fusing roll 160 and upper pressure roll 161. Rolls 160, 161 are supported for rotation in fuser housing 162. The core of fusing roll 160 is hollow for receipt of heating rod 163 therewithin.

Housing 162 includes a sump 164 for holding a quantity of liquid release agent, herein termed oil. Dispensing belt 165, moves through sump 164 to pick up the oil, belt 165 being driven by motor 166. A blanket-like wick 167 carries the oil from belt 165 to the surface of fusing roll 160.

Pressure roll 161 is supported within an upper pivotal section 168 of housing 162. This enables pressure roll 161 to be moved into and out of operative contact fusing roll 160. Cam shaft 169 in fuser housing 162 serves to move housing section 168 and pressure roll 161 into operative relationship with fusing roll 160 against a suitable bias (not shown). Cam shaft 169 is coupled to main motor 34 through an electromagnetically operated one revolution clutch 159.

Fuser housing section 168 is evacuated. For this purpose, a, conduit 170 couples section 168 with vacuum pump 153. The ends of housing section 168 are separated into vacuum compartments opposite the ends of pressure roll 161 thereunder to cool the roll ends where smaller size copy sheets 3 are being processed. Vacuum valve 171 (FIG. 3) in conduit 172 regulates communication of the vacuum compartments with vacuum pump 153' in response to the size sheets as sensed by side guide sensors 108, 109 in paper trays 100, 102.

Fuser roll 160 is driven from main motor 34. Pressure roll 161 is drivingly coupled to fuser roll 160 for rotation therewith.

Thermostat 174 (FIG. 12) in fuser housing 162 controls operation of heating rod 163 in response to temperature. Temperature sensor 175 protects against fuser over temperature. To protect against trapping of a sheet in fuser 150 in the event of a jam, sensor 176 is provided.

Following fuser 150, the sheet is carried by post fuser transport 180 to either discharge transport 181 or, where duplex or two sided copies are desired, to return transport 182. Sheet sensor 183 monitors passage of the sheets from fuser 150. Transports 180, 181 are driven from main motor 34. Sensor 181' monitors transport 181 for jams. Suitable retaining means may be provided to retain the sheets on transports 180, 181.

A deflector 184, when extended, directs sheets on transport 180 onto conveyor roll 185 and into chute 186 leading to return transport 182. Solenoid 179, when energized raises deflector 184 into the sheet path. Return transport 182 carries the sheets back to auxiliary tray 102. Sensor 189 monitors transport 182 for jams. Paper stops 187 of tray 102 is supported for oscillating movement. Motor 188 drives stops 187 back and forth tap sheets returned to auxiliary tray 102 into alignment for refeeding.

To invert duplex copy sheets following fusing of the second or duplex image, a displaceable sheet stop 190 is provided adjacent the discharge end of chute 186. Stop 190 is pivotally supported for swinging movement into and out of chute 186. Solenoid 191 is provided to move stop 190 selectively into or out of chute 186. The sheet trapped in chute 186 by stop 190 is removed by pinch roll pairs 192, 193 and fed out through chute 201 onto discharge transport 181. Further description of the inverter mechanism may be found in U.S. Pat. No. 3,856,295, issued Dec. 24, 1974, to John H. Looney.

Output tray 195 receives unsorted copies. Transport 196 a portion of which is wrapped around a turn around roll 197, serves to carry the finished copies to tray 195. Sensor 194 monitors transport 196 for jams. To route copies into output tray 195, a deflector 198 is provided. Deflector solenoid 199, when energized, turns deflector 198 to intercept sheets on conveyor 181 and route the sheets onto conveyor 196.

When output tray 195 is not used, the sheets are carried by conveyor 181 to sorter 14.

SORTER

Figure 13:
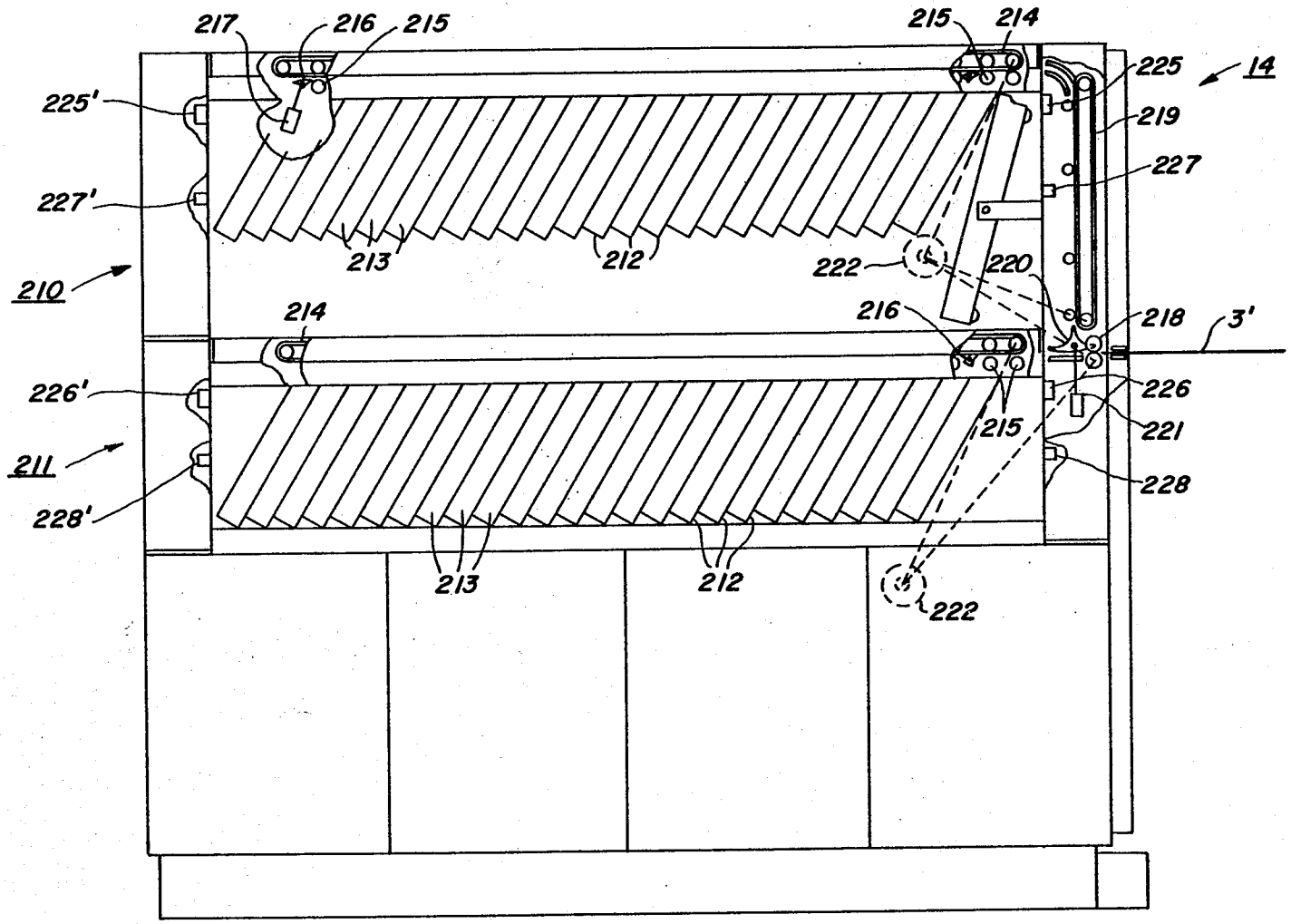
FIG. 13 is an enlarged view showing details of the copy sorter for the apparatus shown in FIG. 1.

Referring particularly to FIG. 13, sorter 14 comprises upper and lower bin arrays 210, 211. Each bin array 210, 211 consists of series of spaced downwardly inclined trays 212, forming a series of individual bins 213 for receipt of finished copies 3'. Conveyors 214 along the top of each bin array, cooperate with idler rolls 215 adjacent the inlet to each bin to transport the copies into juxtaposition with the bins. Individual defelctors 216 at each bin cooperate, when depressed, with the adjoining idler roll 215 to turn the copies into the bin associated therewith. An operating solenoid 217 is provided for each deflector.

A driven roll pair 218 is provided at the inlet to sorter 14. A generally vertical conveyor 219 serves to bring copies 3' to the upper bin array 210. Entrance deflector 220 routes the copies selectively to either the upper or lower bin array 210, 211 respectively. Solenoid 221 operates deflector 220.

Motor 222 is provided to drive the conveyors 214 and 219 of upper bin array 210 and conveyor 214 of lower bin array 211. Roll pair 218 is drivingly coupled to motor 222.

To detect entry of copies 3' in the individual bins 213, a photoelectric type sensor 225, 226 is provided at one end of each bin array 210, 211 respectively. Sensor lamps 225', 226' are disposed adjacent the other end of the bin array. To detect the presence of copies in the bins 213, a second set of photoelectric type sensors 227, 228 is provided for each bin array, on a level with a tray cutout (not shown). Sensor lamps 227', 228' are disposed opposite sensors 227, 228.

DOCUMENT HANDLER

Figure 14:
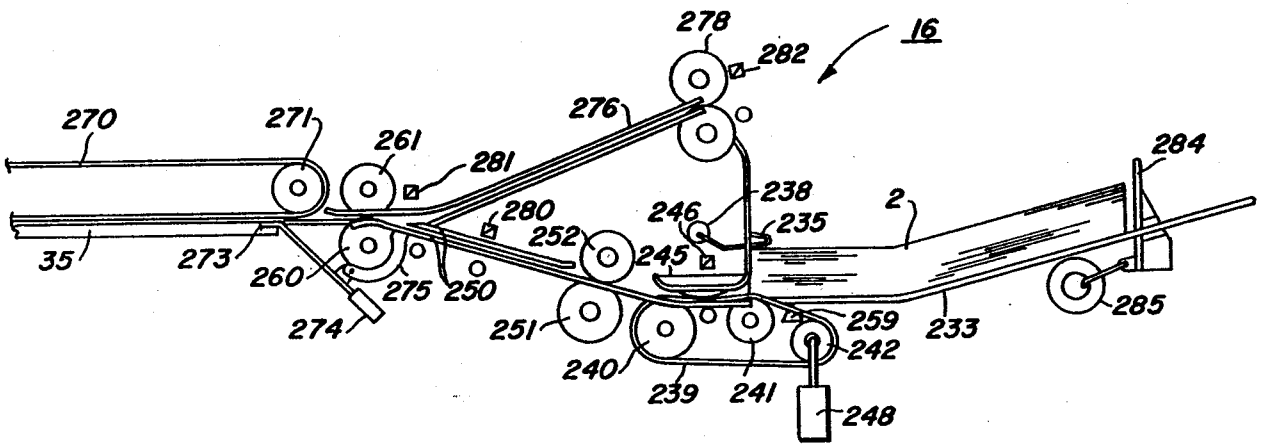
FIG. 14 is a schematic view showing details of the document handler for the apparatus shown in FIG. 1.
Figure 15:
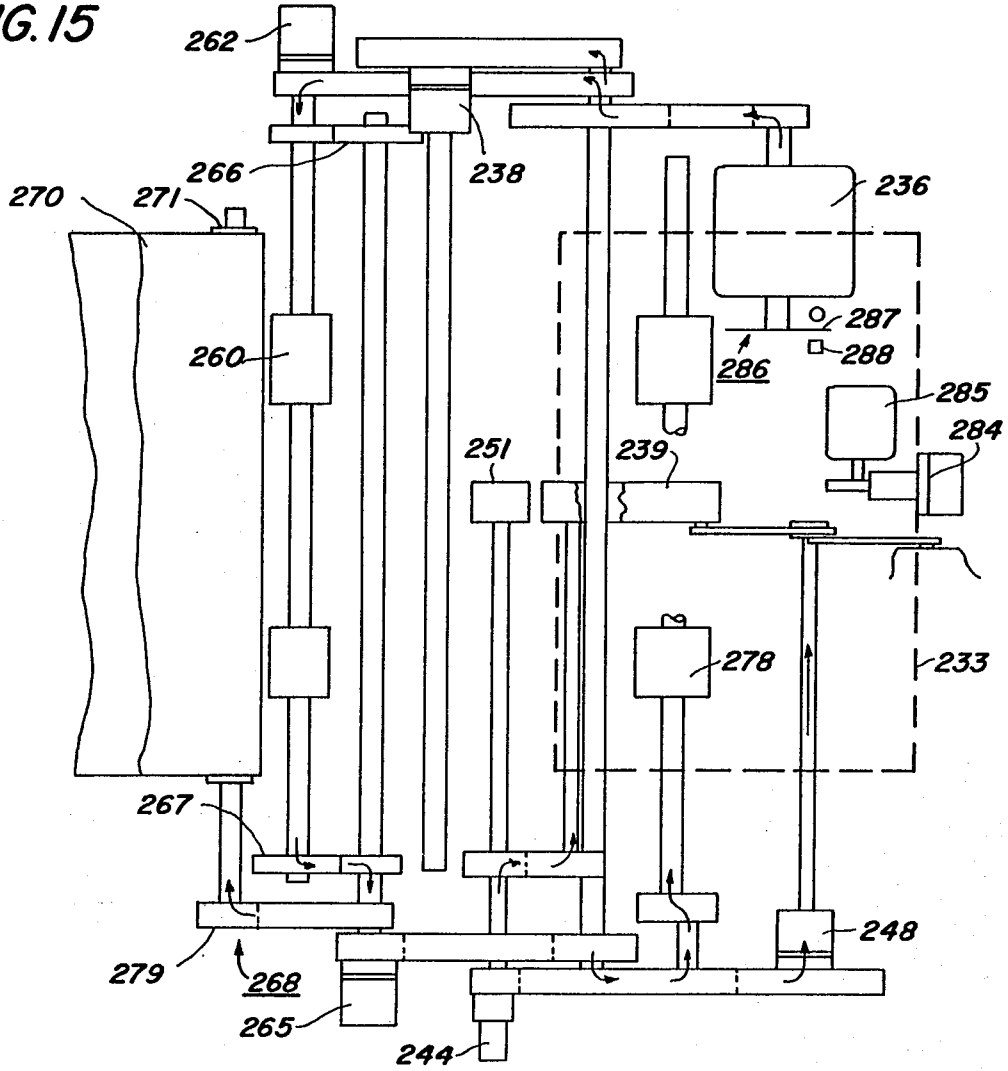
FIG. 15 is a view showing details of the drive mechanism for the document handler shown in FIG. 14.

Referring particularly to FIGS. 14 and 15, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document separation.

A document feed belt 239 is supported on drive and idler rolls 240, 241 and kicker roll 242 under tray 233, tray 233 being suitably apertured to permit the belt surface to project therewithin. Feedbelt 239 is driven by motor 236 through electromagnetic clutch 244. Guide 245, disposed near the discharge end of feed belt 239, cooperates with belt 239 to form a nip between which the documents pass.

A photoelectric type sensor 246 is disposed adjacent the discharge end of belt 239. Sensor 246 responds on failure of a document to feed within a predetermined interval to actuate solenoid 248 raise kicker roll 242 and increases the surface area of feed belt 239 in contact with the documents. Another sensor 259 located underneath tray 233 provides an output signal when the last document 2 of each set has left the tray 233.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 advance the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233 via return chute 276. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto platen 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276, deflector 275 being raised by solenoid 274 when withdrawing register 273. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

TIMING

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor 34. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Figure 17:
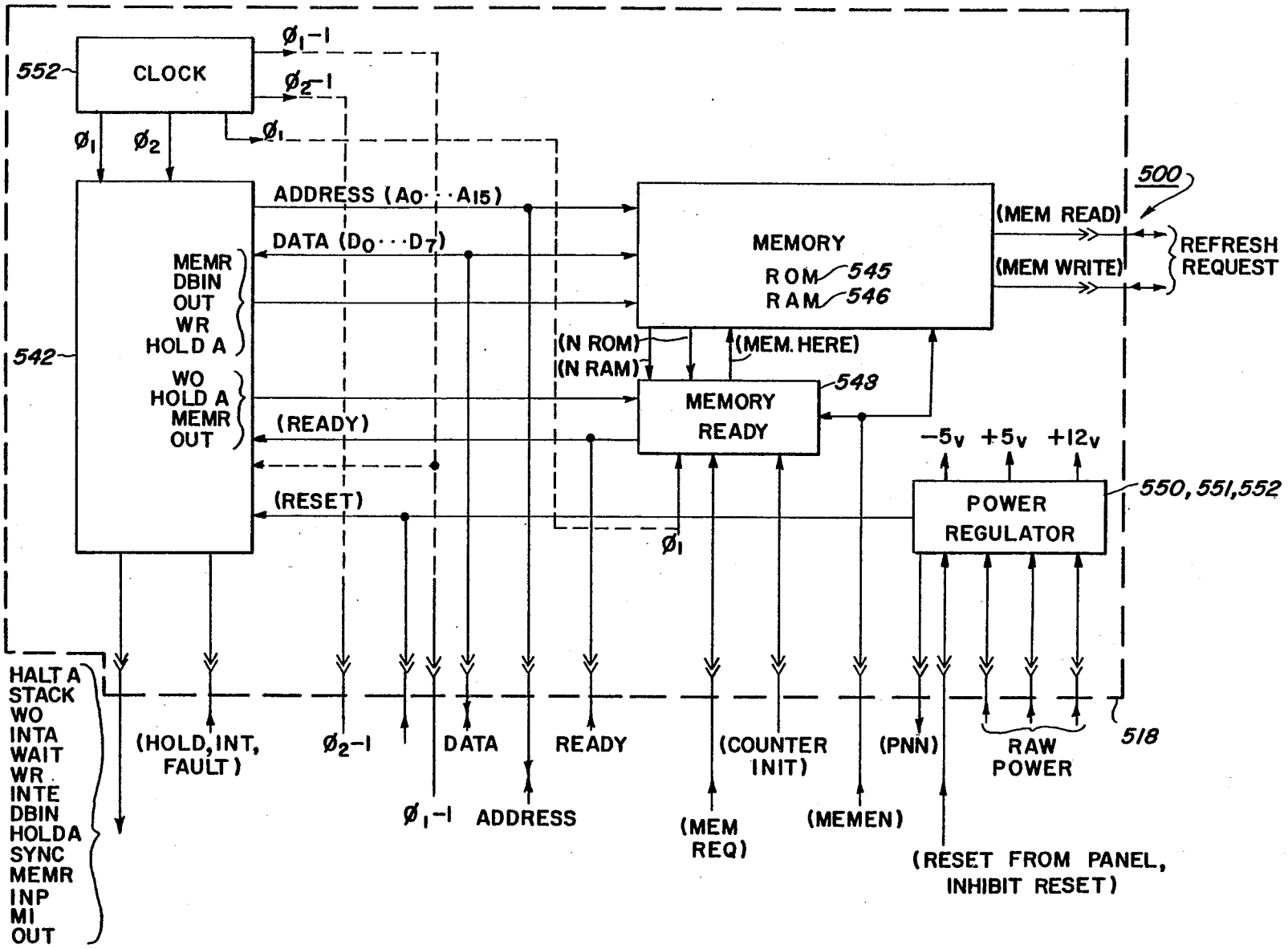
FIG. 17 is a block diagram of the controller CPU.

Referring to FIG. 15, a document handler clock 286 consisting of apertured disc 287 on the output shaft of document handler drive motor 236 and cooperating photoelectric type signal generator 288 is provided. As in the case of machine clock 202, document handler clock 286 produces an output pulse train from which components of the document handler may be synchronized. A real time clock such as clock 552 of FIG. 17, is utilized to control internal operations of the controller 18 as is known in the art.

CONTROLLER

Figure 16:
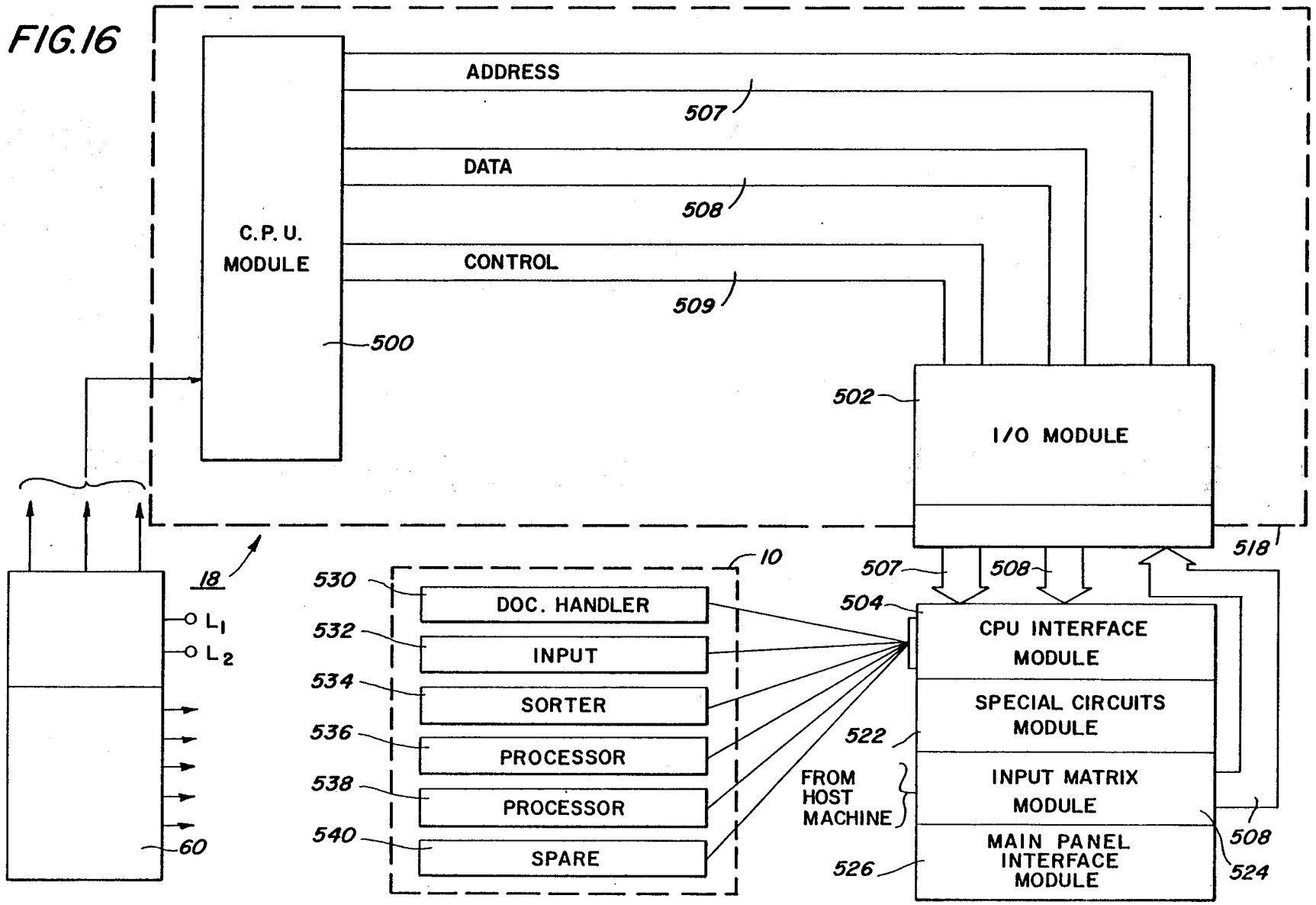
FIG. 16 is a block diagram of the controller for the apparatus shown in FIG. 1.

Referring to FIG. 16, controller 18 includes a Central Processor Unit (CPU) Module 500, Input/Output (I/O) Module 502, and Interface 504. Address, Data and Control Buses 507, 508, 509 respectively operatively couple CPU Module 500 and I/O Module 502. CPU Module 500 I/O Module 502 are disposed within a shield 518 to prevent noise interference.

Interface 504 couples I/O Module 502 with special circuits module 522, input matrix module 524, and main panel interface module 526. Module 504 also couples I/O Module 502 to the operating sections of the machine, namely, document handler section 530, input section 532, sorter section 534 and processor sections 536, 538. A spare section 540, which may be used for monitoring operation of the host machine, or which may be later utilized to control other devices, is provided.

Referring to FIGS. 17, 18(*a*), CPU module 500 comprises a processor 542 such as an Intel 8080 microprocessor manufactured by Intel Corporation, Santa Clara, Calif., 16K Read Only Memory (herein ROM) and 2K Random Access Memory (herein RAM) sections 545, 546, Memory Ready section 548, power regulator section 550, and onboard clock 552. Bipolar tri-state buffers 510, 511 in Address and Data buses 507, 508 disable the bus on a Direct Memory access (DMA) signal (HOLDA) as will appear. While the capacity of memory sections 545, 546 are indicated throughout as being 16K and 2K respectively, other memory sizes may be readily contemplated.

Figure 19A:
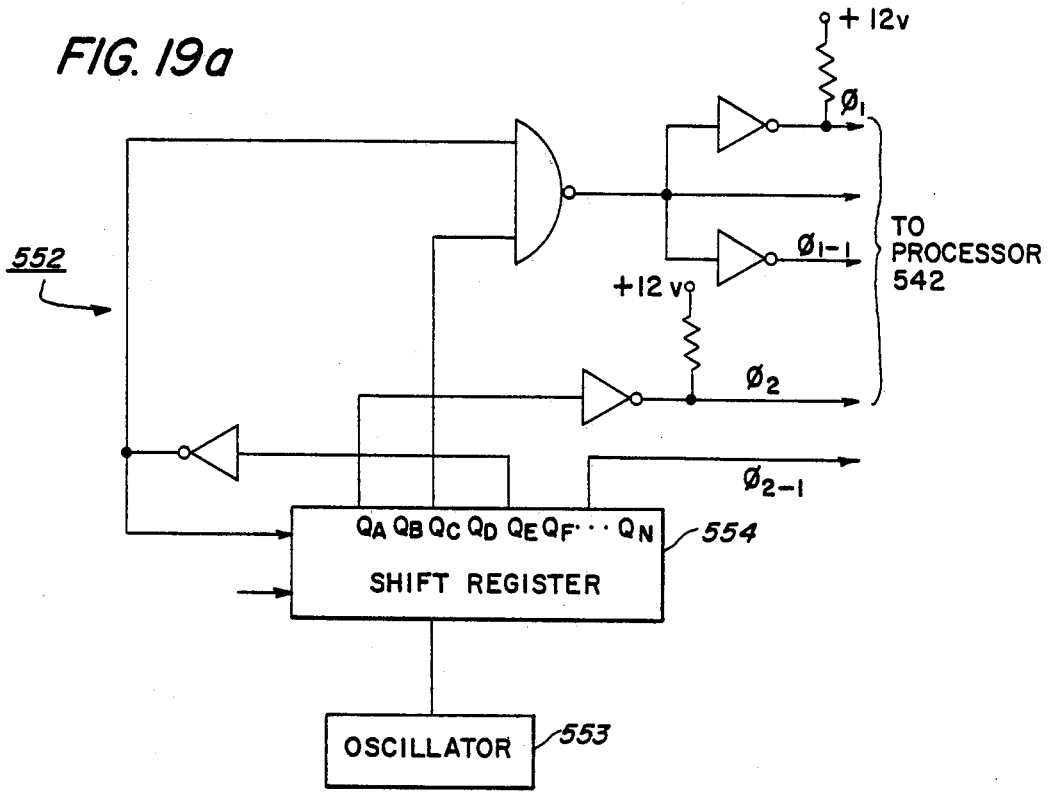
FIG. 19*a* is a logic schematic of the CPU clock.
Figure 19B:
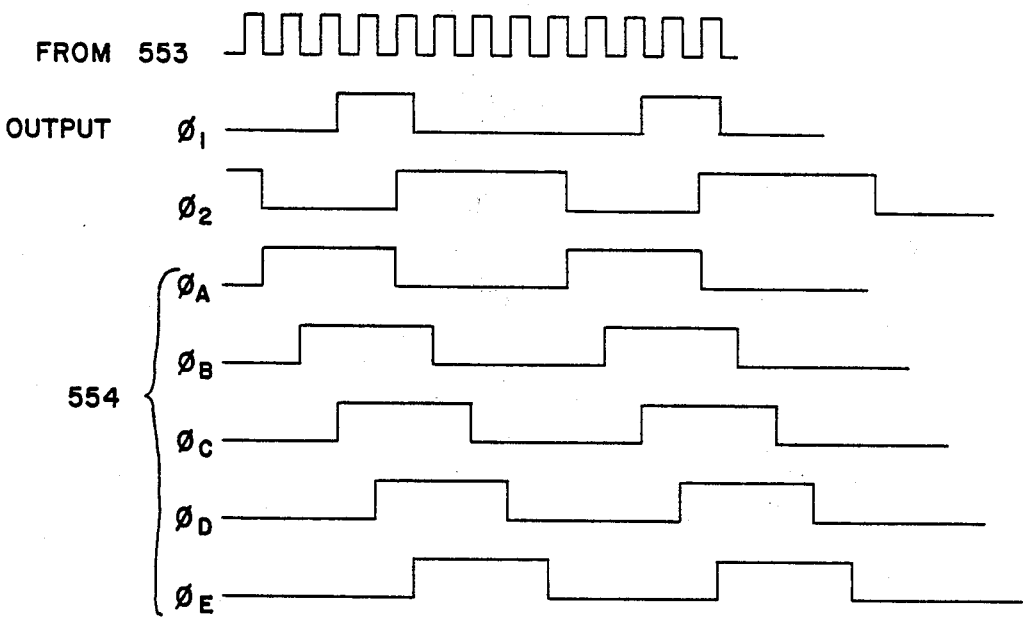
FIG. 19*b* is a chart illustrating the output wave form of the clock shown in FIG. 19*a;*

Referring particularly to FIGS. 19(*a*, *b*), clock 552 comprises a suitable clock oscillator 553 feeding a multibite (Qa–Qn) shift register 554. Register 554 includes an internal feedback path from one bit to the serial input of register 544. Output signal waveforms $\phi_1, \phi_2, \phi_{1\text{-}1}$ and $\phi_{2\text{-}1}$ are produced for use by the system.

Figure 20:
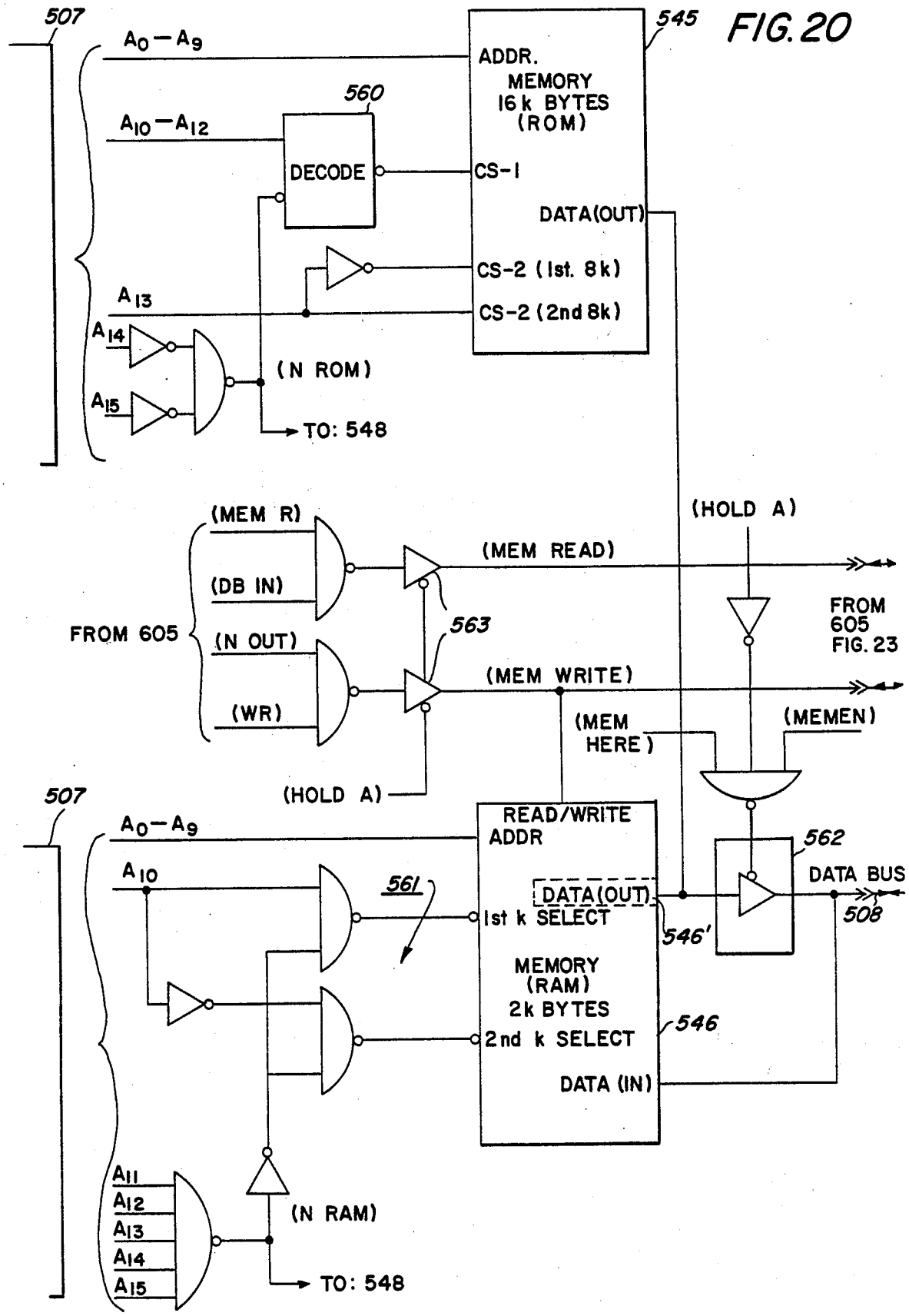
FIG. 20 is a logic schematic of the CPU memory.

Referring to FIG. 20, the memory bytes in ROM section 545 are implemented by address signals (Ao-A 15) from processor 542, selection being effected by 3 to 8 decode chip 560 controlling chip select 1 (CS-1) and a 1 bit selection (A 13)controlling chip select 2 (CS-2). The most significant address bits (A 14, A 15) select the first 16K of the total 64 bytes of the addressing space. The memory bytes in RAM section 546 are implemented by Address signals (Ao-A 15) through selector circuit 561. Address bit A 10 serves to select the memory bank while the remaining five most significant bits (A 11-A 15) select the last 2K bytes out of the 64K bytes of addressing space. RAM memory section 546 includes a 40 bit output buffer (DATA OUT) the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 (FIG. 23*b*) to access MEM READ and MEM WRITE control channels directly on a DMA signal (HOLD A) from processor 542 as will appear.

Referring to FIG. 21, memory ready section 548 provides a READY signal to processor 542. A binary counter 566, which is initialized by a SYNC signal ($\phi$,) to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Figure 22A:
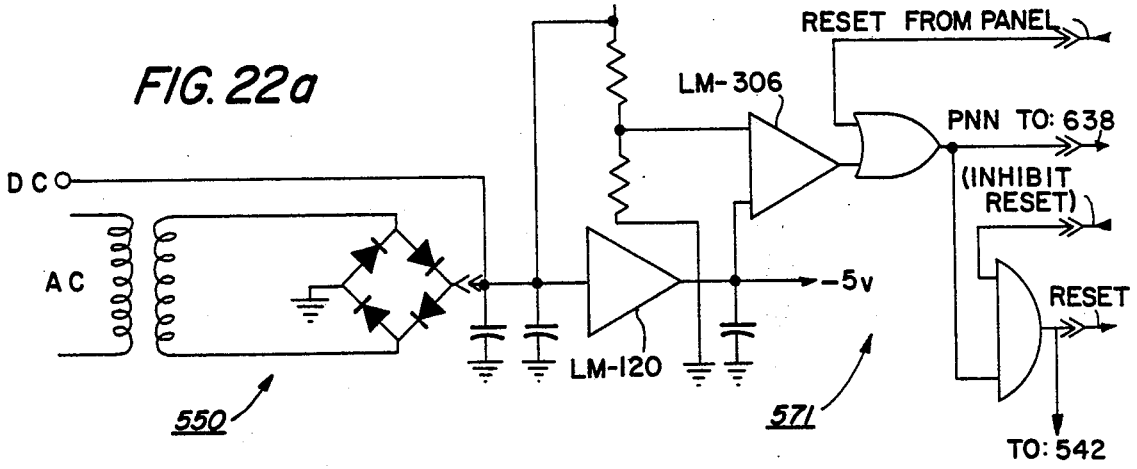
FIGS. 22*a*, 22*b*, 22*c* are logic schematics of the CPU power supply stages.
Figure 22B:
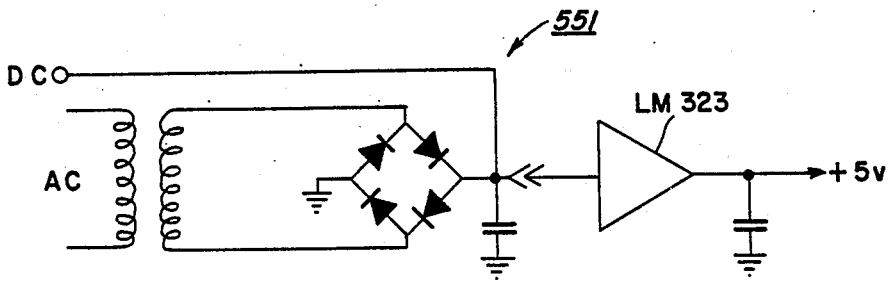
Figure 22C:
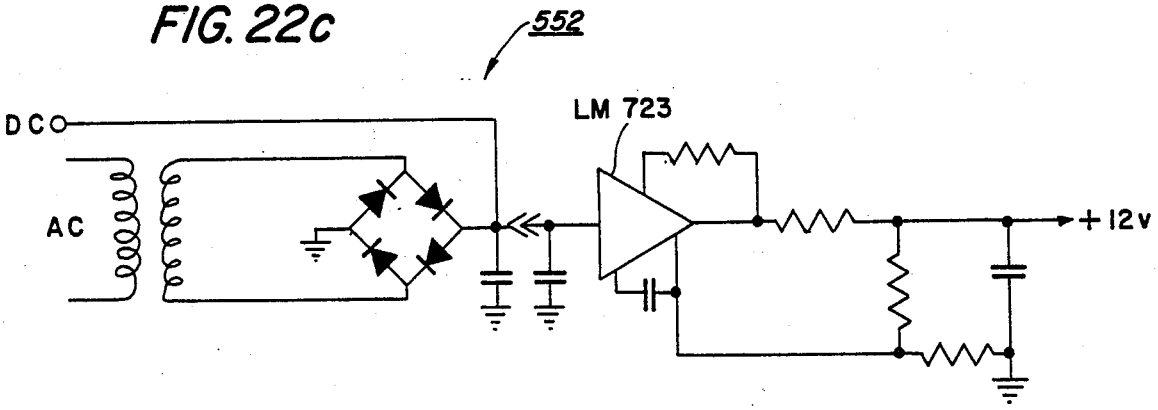

Referring to FIGS. 22(*a, b, c*) and 23*b*, power regulators 550, 551, 552 provide the various voltage levels, i.e. +5 v, +12 v, and −5 v D.C. required by the module 500. Each of the three on board regulators 550, 551, 552 employ filtered D.C. inputs. Power Not Normal (PNN) detection circuitry 571 is provided to reset processor 542 during the power up time. Reset control from the machine service panel (not shown) is also provided via PNN. An enabling signal (INHIBIT RESET) from Memory Control 638 allows completion of a write cycle in Non Volatile (N.V.) Memory 610 of I/O Module 502.

Figure 18A:
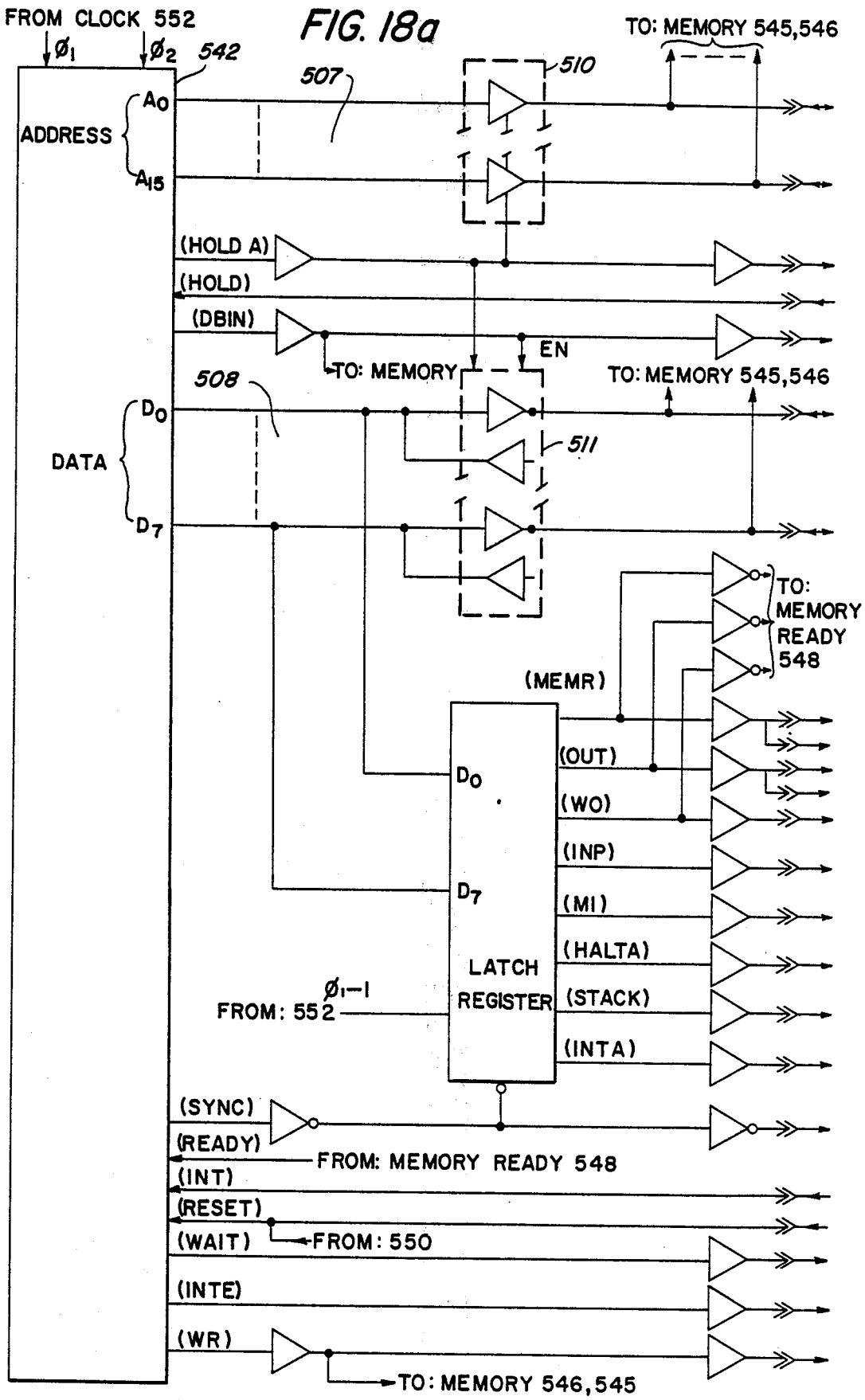
FIG. 18*a* is a block diagram showing the CPU microprocessor input/output connections.
Figure 18B:
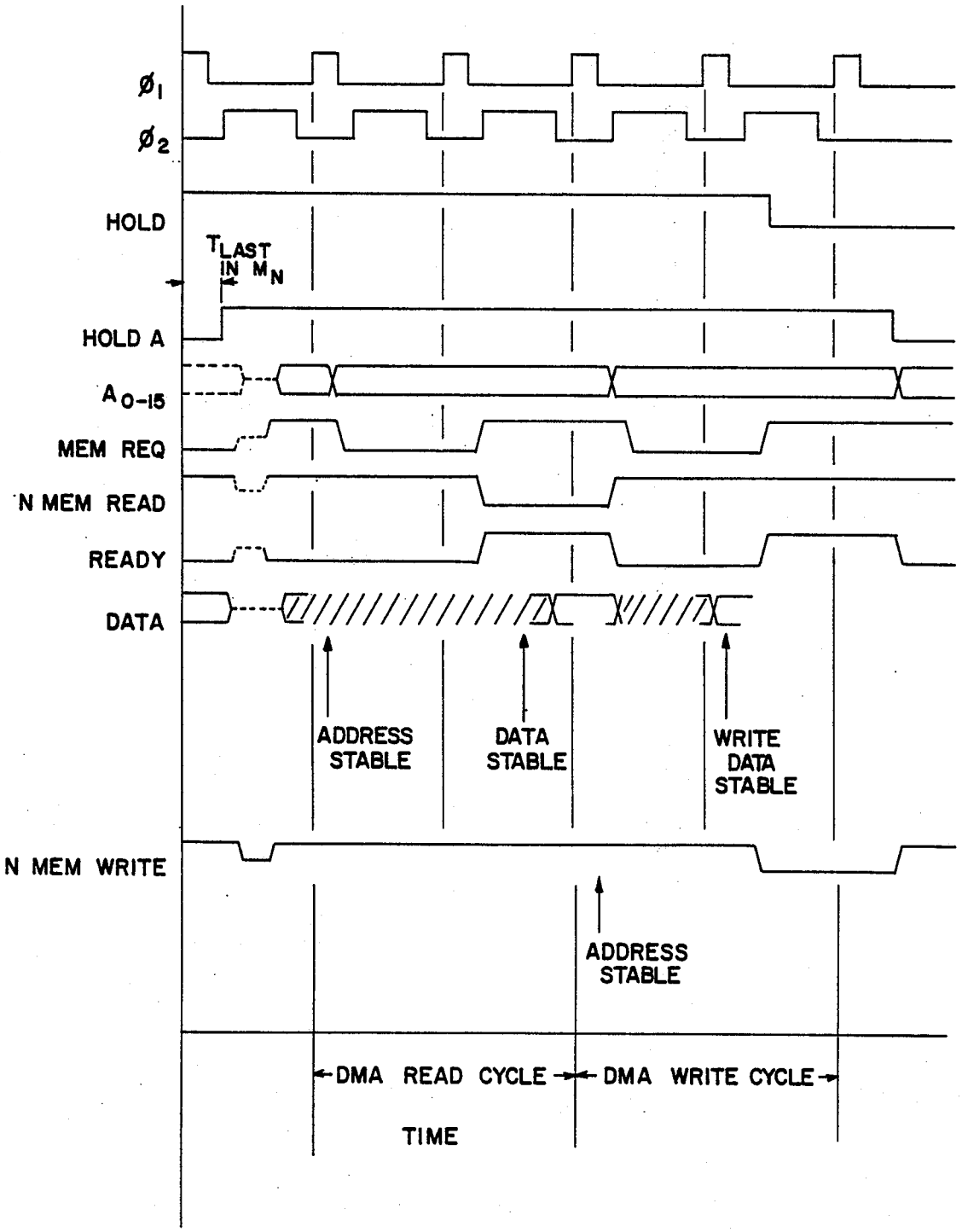
FIG. 18*b* is a timing chart of Direct Memory access (DMA) Read and Write cycles.
Figure 23A:
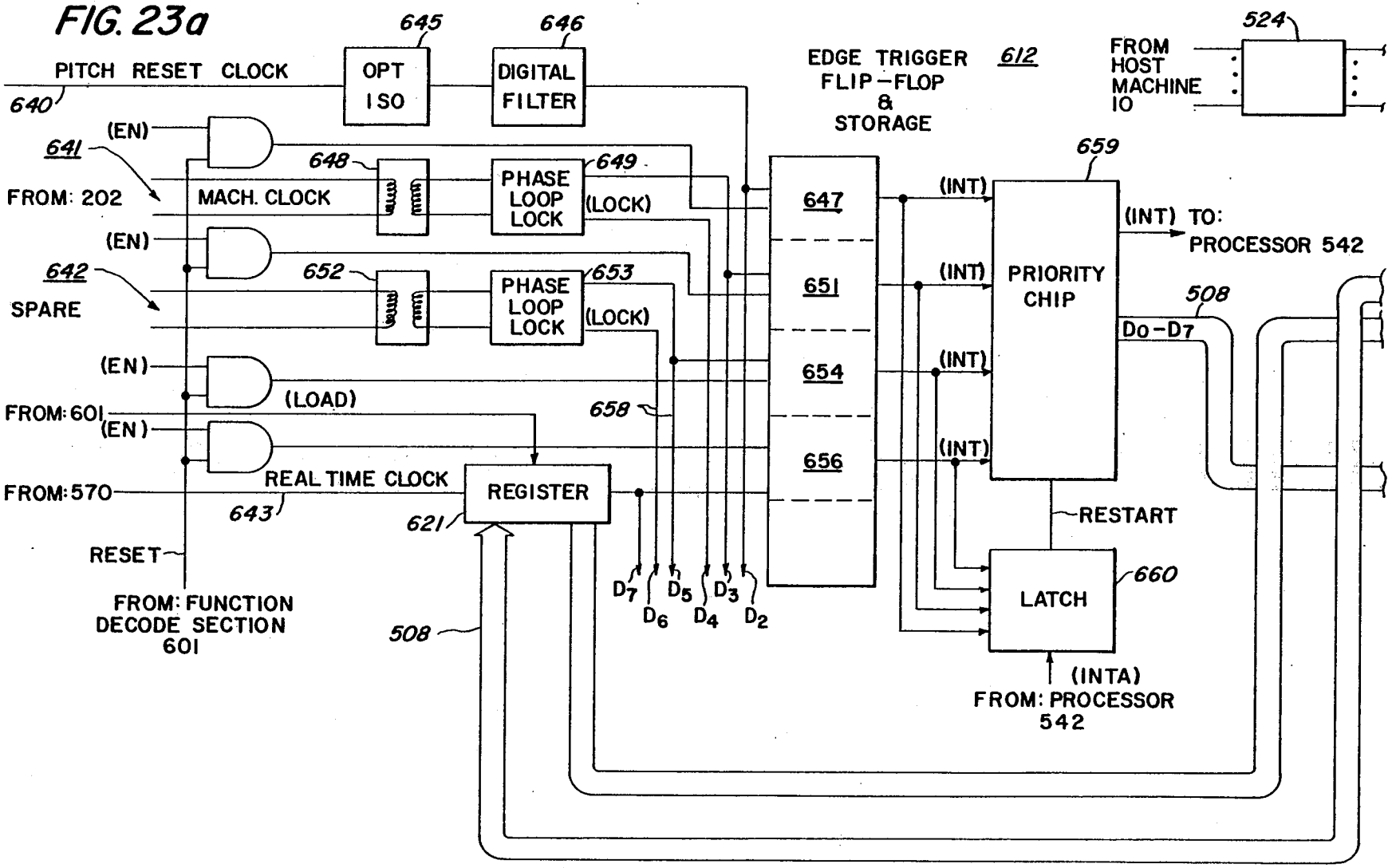
FIGS. 23*a* and 23*b* comprise a block diagram of the controller I/O module.
Figure 23B:
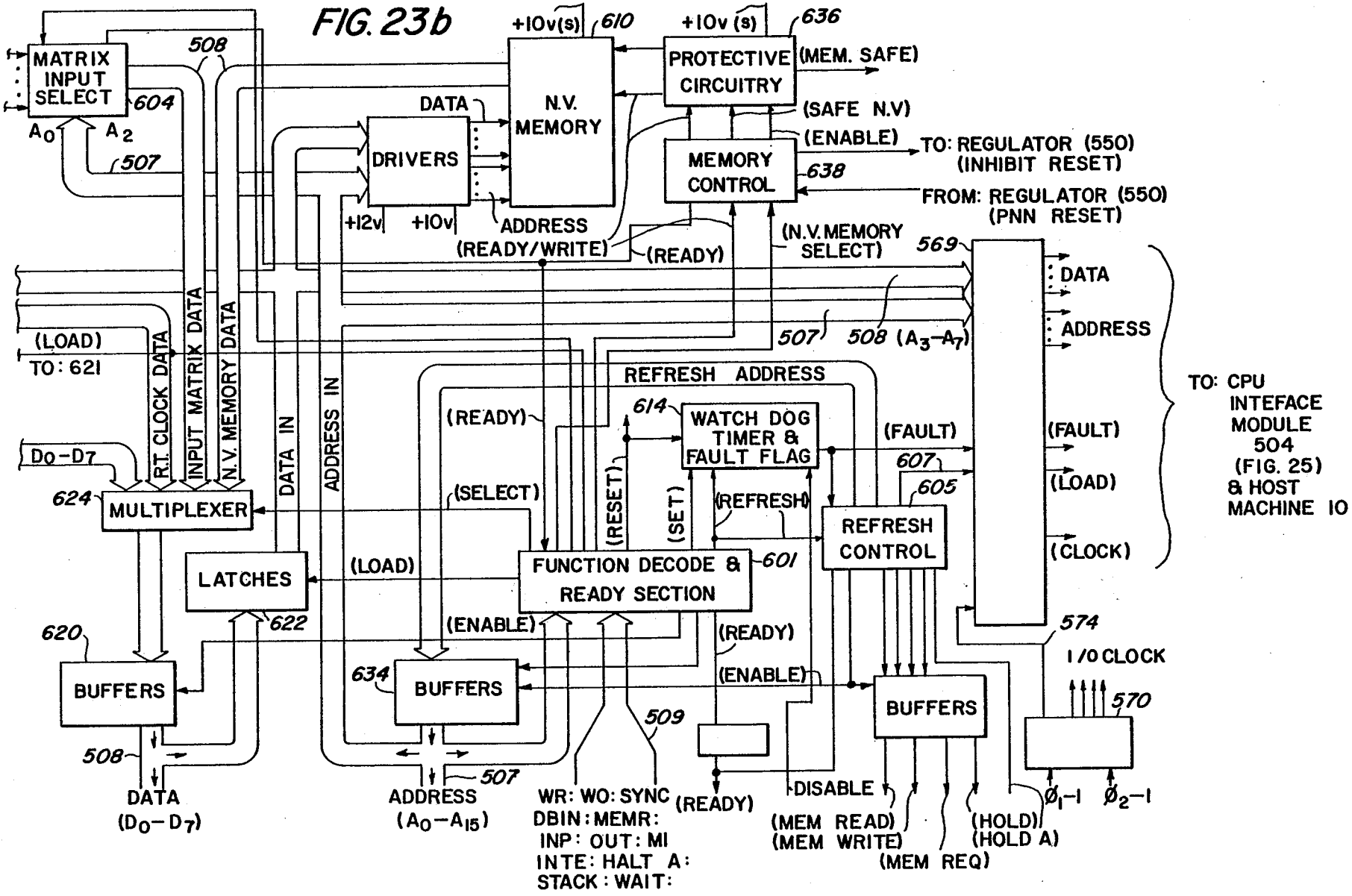

Referring to FIGS. 18*a*, 20, 21, and the DMA timing chart (FIG. 18*b*) data transfer from RAM section 546 to host machine 10 is effected through Direct Memory Access (DMA), as will appear. To initiate DMA, a signal (HOLD) is generated by Refresh Control 605 (FIG. 23*b*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 20, 21) to Refresh Control 605 of I/O Module 502.

Referring to FIGS. 23(*a, b*), I/O Module 502 interfaces with CPU module 500 through bi-directional Address and, Data buses 507, 508 respectively, and control bus, 509. I/O Module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory access (DMA) by I/O module 502 of RAM section 546.

I/O module 502 includes Matrix Input select 604 (through which inputs from the host machine 10, are received), Refresh Control 605, Nonvolatile (NV) memory 610, Interrupt Control 612 (FIG. 23*a*), Watch dog Timer and failure Flag 614 and clock 570.

A Function Decode Section 601 receives and interprets commands from CPU section 500 by decoding information on address bus 507 along with signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits Ao-A 7 to be sent to the host machine 10 for input matrix read operations; (f) commanding operation of Matrix Input Select 604; (g) initiating read or write operation of N.V. memory 610 through Memory Control 638; (h) loading Real Time clock register 621 (FIG. 23*a*) from data bus 508; and (i) resetting the Watch Dog timer and setting the Fault Failure flag 614. In addition, section 601 includes logic to control and synchronize the READY control line to CPU module 500, the READY line being used to advise module 500 when data placed on the Data bus by I/O module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25 m sec) a fault flip flop is set and a signal (FAULT) sent to the host machine 10. The signal (FAULT) also raises the HOLD line (via Refresh Control 605) to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input select 604 which controls receipt of data from host machine 10 has capacity to read up to 32 groups of 8 discrete inputs from host machine 10. Lines $A_3$ through $A_7$ of Address bus 507 are routed to host machine 10 via optical isolator 569 and CPU Interface Module 504 to select the desired group of 8 inputs. The selected inputs from machine 10 are received by matrix 604 via Input Matrix Module 524 (FIG. 28) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from the memory output buffer (DATA OUT) of RAM memory section 546 to host machine 10 at the predetermined clock rate in line 574. Direct Memory access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 (through actuation of tri-state buffers 510, 511 as described) to the high impedance stage giving I/O module 502 control thereover. I/O module 502 then sequentially accesses the 32 memory words from output buffer (DATA OUT) of RAM section 546 (REFRESH ADDRESS) and transfers the contents to the host machine 10 via data bus 508 and optical isolator 569. CPU Module 500 is dormant during this period.

On capture of the address and data buses 507, 508, a control signal (LOAD) from Refresh Control 605 together with a clock signal (CLOCK) in line 574 are utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

N.V. memory 610 comprises a predetermined number of bits of non-volatile memory stored in I/O module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset interrupt and the Machine interrupt, as well as a third clock driven interrupt, the Real Time interrupt.

Referring particularly to FIG. 23(*a*) the highest priority interrupt signal, Pitch reset signal 640, is generated by the signal output of pitch reset clock 138. The clock signal is fed via optical isolator 645 and digital filter 646 to edge trigger flip flop 647.

The second highest priority interrupt signal, machine clock signal 641, is sent directly from machine clock 202 through isolation transformer 648 to a phase locked loop 649. Loop 649, which serves as bandpath filter and signal conditioner, sends a square wave signal to edge trigger flip flop 651. The second signal output (LOCK) serves to indicate whether loop 649 is locked onto a valid signal input or not.

The lowest priority interrupt signal, Real Time Clock signal 643, is generated by register 621. Register 621 which is loaded and stored by memory reference instructions from CPU module 500 is decremented by a clock signal in line 643 which may be derived from I/O Module clock 570. On the register count reaching zero, register 621 sends an interrupt signal to edge trigger flip flop 656. A spare interrupt 642 is also provided.

Setting of one or more of the edge trigger flip flops 647, 651, 654, 656 by the interrupt signals 640, 641, 642, 643 generates a signal (INT) via priority chip 659 to processor 542 of CPU Module 500 (FIG. 18*a*). On acknowledgement, processor 542, issues a signal (INTA) transferring the status of the edge trigger flip flops 647, 651, 654, 656 to a four bit latch 660 to generate an interrupt instruction code (RESTART) onto the data bus 508.

Each interrupt is assigned a unique RESTART instruction code. Should an interrupt of higher priority be triggered, a new interrupt signal (INT) and RESTART instruction code are generated resulting in a nesting of interrupt software routines whenever the interrupt recognition circuitry is enabled within the CPU 500.

Priority chip 659 serves to establish a handling priority in the event of simultaneous interrupt signals in accordance with the priority schedule described.

Once triggered, the edge trigger flip flop 647, 651, 654 or 656 must be reset in order to capture the next occurrence of the interrupt associated therewith. Each interrupt subroutine serves, in addition to performing the functions programmed, to reset the flip flops (through the writing of a coded byte in a uniquely selected address) and to re-enable the interrupt (through execution of a re-enabling instruction). Until re-enabled, initiation of a second interrupt is precluded while the first interrupt is in progress.

Lines 658 permit interrupt status to be interrogated by CPU module 500 on a memory reference instruction.

I/O Module 502 includes a suitable pulse generator or clock 570 for generating the various timing signals required by module 502. Clock 570 is driven by the pulse-like output $\phi_{1-1}$, $\phi_{2-1}$ of processor clock 552 (FIG. 19*a*). As described, clock 570 provides a reference clock pulse (in line 574) for synchronizing the output refresh data and is the source of clock pulse (in line 643) for driving Real Time register 621.

Figure 25:
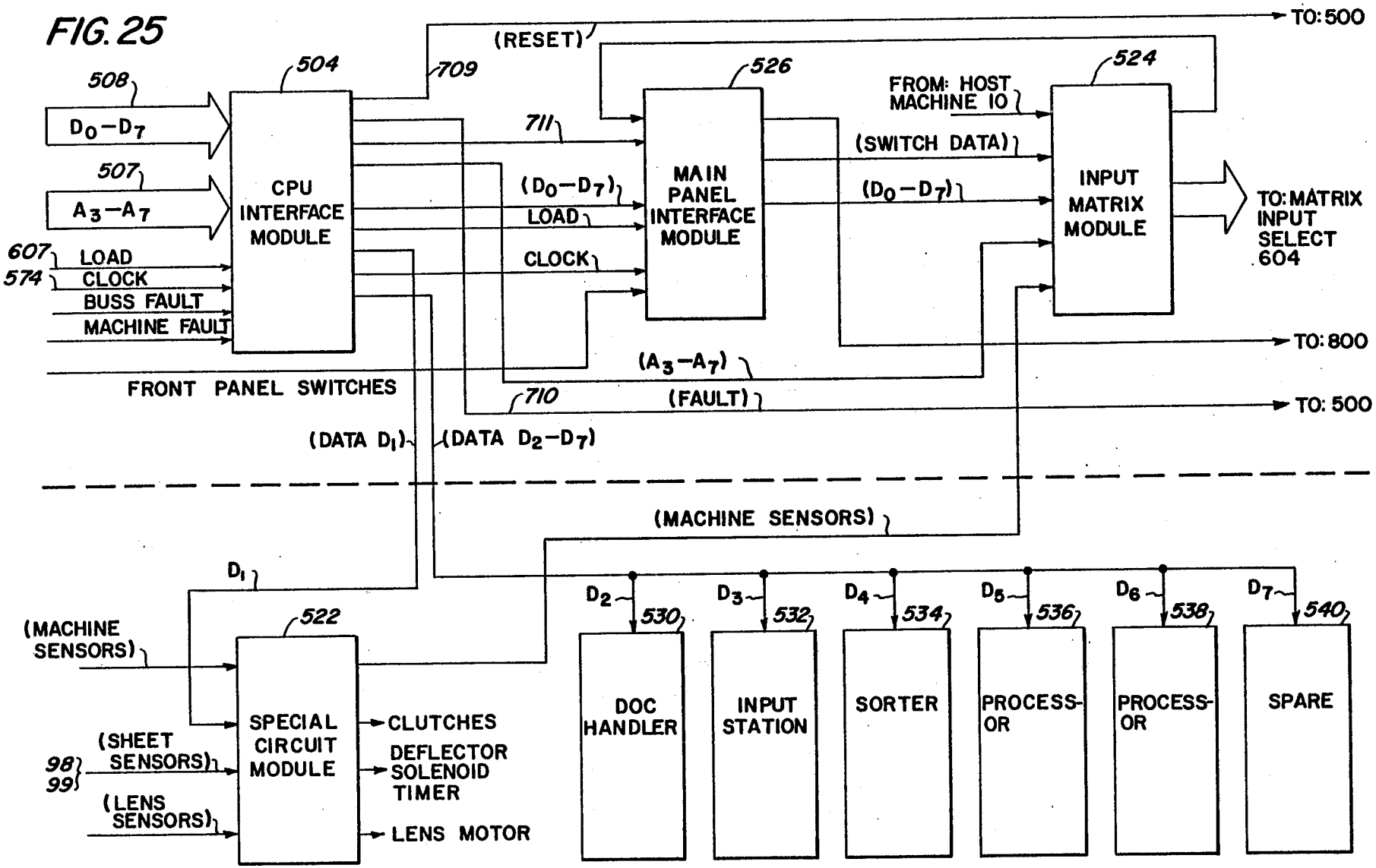
FIG. 25 is a block diagram of the apparatus interface and remote output connections.
Figure 26:
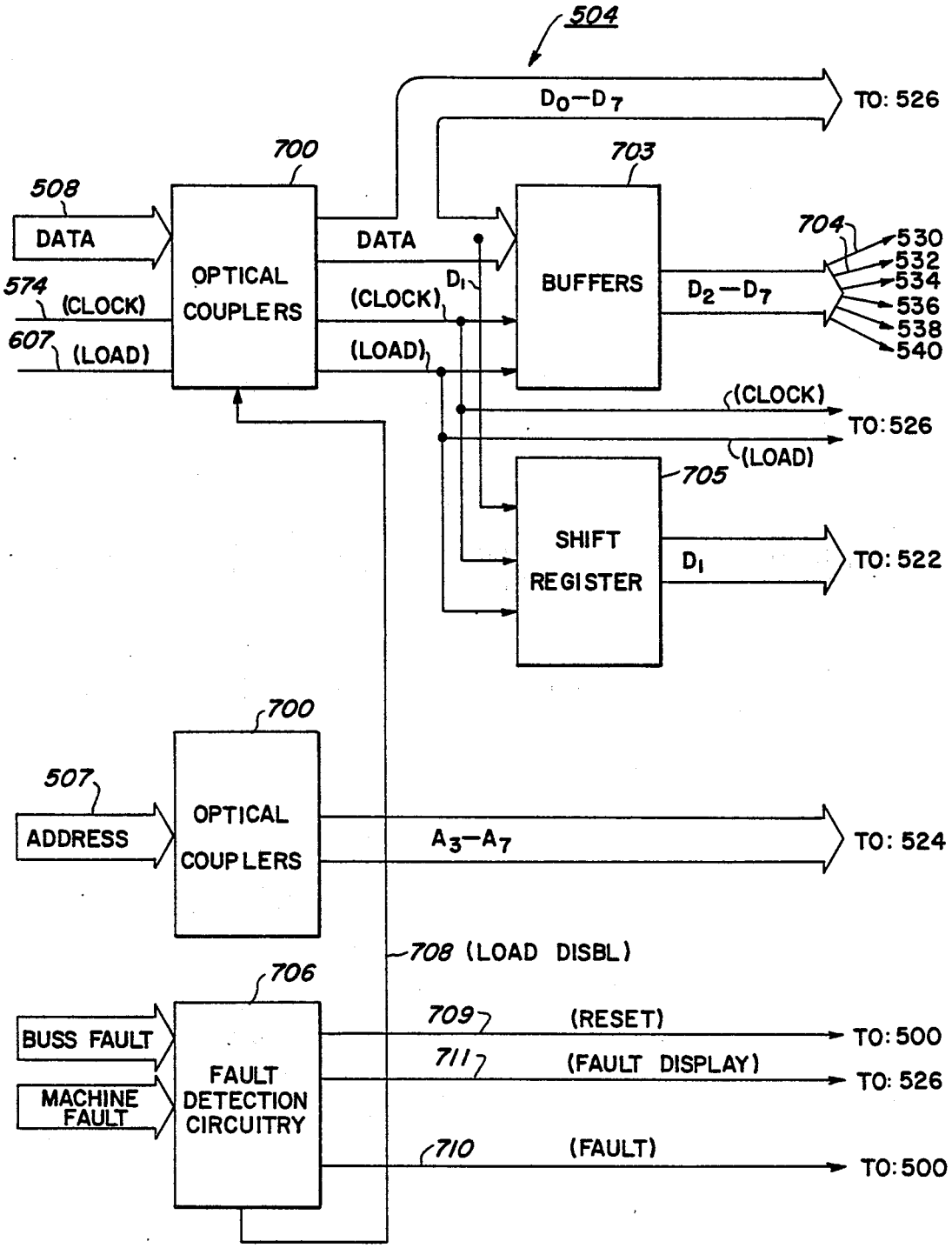
FIG. 26 is a block diagram of the CPU interface module.

CPU interface module 504 interfaces I/O module 502 with the host machine 10 and transmits operating data stored in RAM section 546 to the machine. Referring particularly to FIGS. 25 and 26, data and address information are inputted to module 504 through suitable means such as optical type couplers 700 which convert the information to single ended logic levels. Data in bus 508 on a signal from Refresh Control 605 in line 607 (LOAD), is clocked into module 546 at the reference clock rate in line 574 parallel by bit, serial by byte for a preset byte length, with each data bit of each successive byte being clocked into a separate data channel D0-D7. As best seen in FIG. 25, each data channel D0-D7 has an assigned output function with data channel D0 being used for operating the front panel lamps 830 in the digital display, (see FIG. 32), data channel D1 for special circuits module 522, and remaining data channels D2-D7 allocated to the host machine operating sections 530, 532, 534, 536, 538 and 540. Portions of data channels D1-D7 have bits reserved for front panel lamps and digital display.

Since the bit capacity of the data channels D2-D7 is limited, a bit buffer 703 is preferably provided to catch any bit overflow in data channels D2-D7.

Inasmuch as the machine output sections 530, 532, 534, 536, 538 and 540 are electrically a long distance away, i.e. remote, from CPU interface module 504, and the environment is electrically "noisy", the data stream in channels D2-D7 is transmitted to remote sections 530, 532, 534, 536, 538 and 540 via a shielded twisted pair 704. By this arrangement, induced noise appears as a differential input to both lines and is rejected. The associated clock signal for the data is also transmitted over line 704 with the line shielded carrying the return signal currents for both data and clock signals.

Data in channel $D_1$ destined for special circuits module 522 is inputted to shift register type storage circuitry 705 for transmittal to module 522. Display Data ($D_0$-$D_7$) is also inputted to main panel interface module 526. Address information in bus 507 is converted to single ended output by couplers 700 and transmitted to Input Matrix Module 524 to address host machine inputs.

CPU interface module 504 includes fault detector circuitry 706 for monitoring both faults occurring in host machine 10 and faults or failures along the buses, the latter normally comprising a low voltage level or failure in one of the system power lines. Machine faults may comprise a fault in CPU module 500, a belt mistrack signal from sensor 27 (see FIG. 2), opening one of the machine doors or covers as responded to by conventional cover interlock sensors (not shown), a fuser over temperture as detected by sensor 175, etc. In the event of a bus fault, a reset signal (RESET) is generated automatically in line 709 to CPU module 500 (see FIGS. 17 and 18*a*) until the fault is removed. In the event of a machine fault, a signal is generated in line 710 to actuate a suitable relay (not shown) controlling power to all or a portion of host machine 10. A load disabling signal (LOAD DISBL) is inputted to DATA receiving optical couplers 700 via line 708 in the event of a fault in CPU module 500 to terminate input of data to host machine 10. Other fault conditions are monitored by the software background program. In the event of a fault, a signal is generated in line 711 to the digital display on control console 800 (via main panel interface module 526) signifying a fault.

Figure 27:
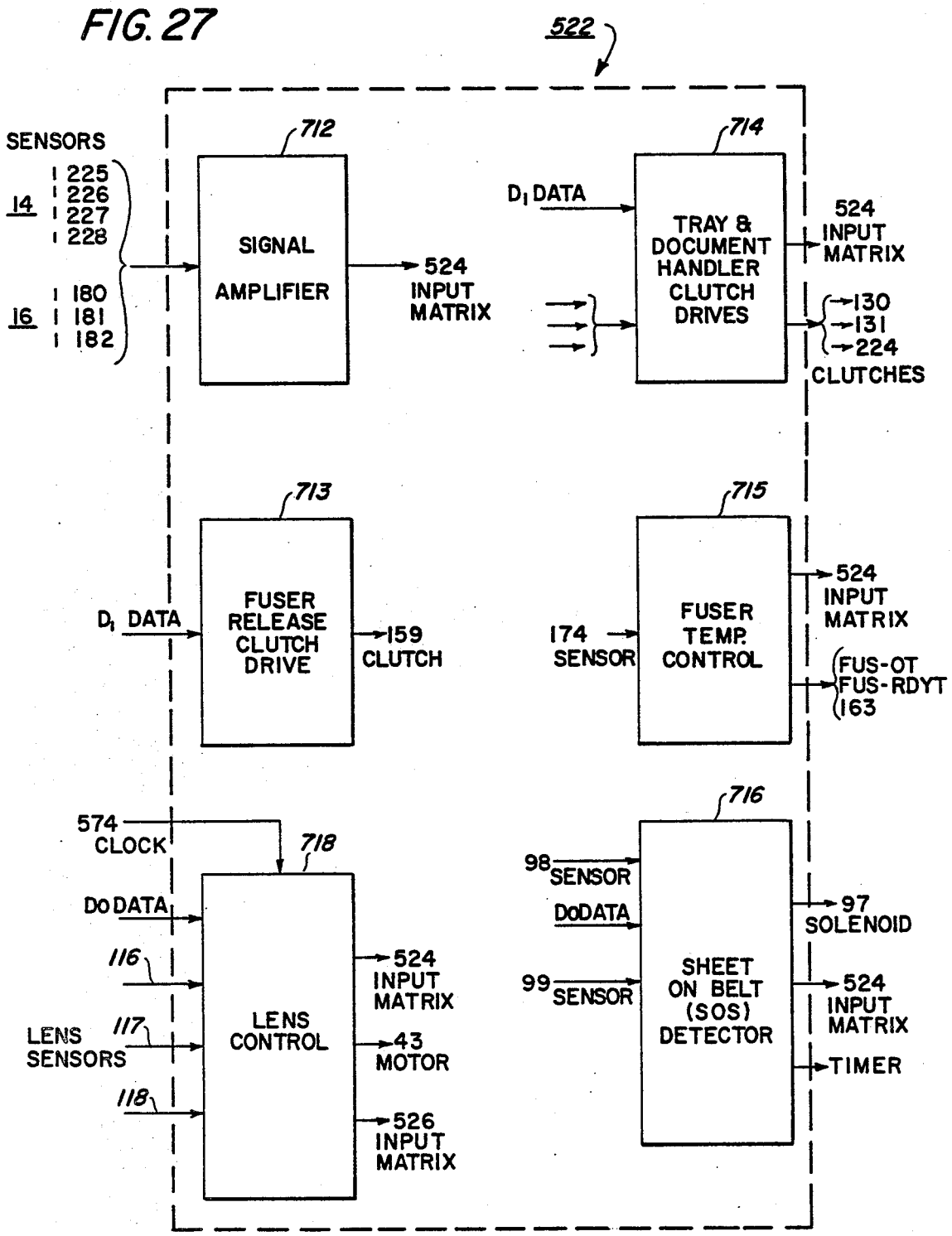
FIG. 27 is a block diagram of the apparatus special circuits module.

Referring particularly to FIGS. 25 and 27, special circuits module 522 comprises a collection of relatively independent circuits for either monitoring operation of and/or driving various elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDYT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a misstrip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensors 116, 117, 118. The signal output of circuitry 718 serves to operate lens drive motor 43 as required to place the optical elements of lens 41 in proper position to effect the image reduction programmed by the operator.

Figure 28:
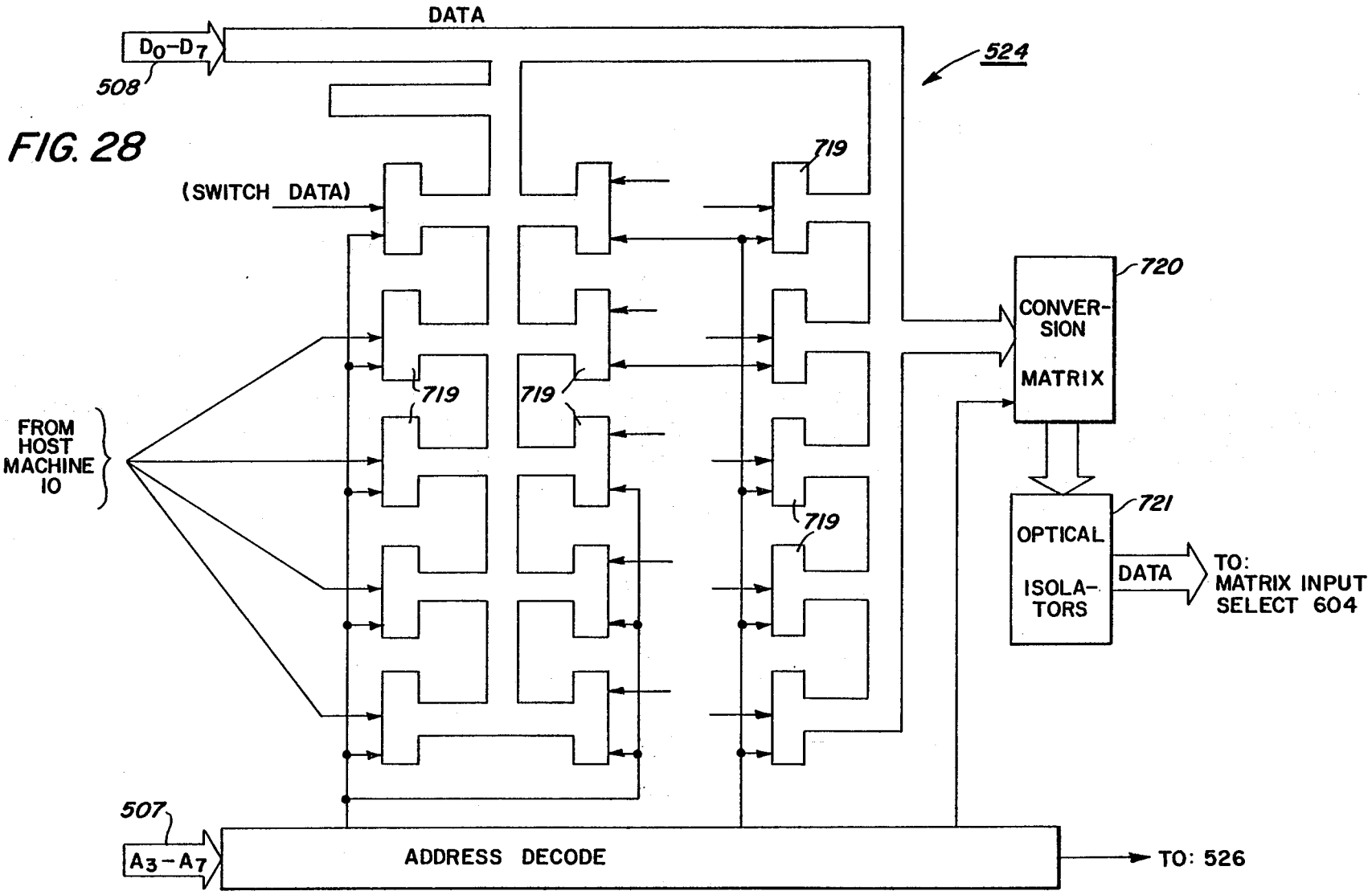
FIG. 28 is a block diagram of the main panel interface module.

Referring to FIG. 28, input matrix module 524 provides analog gates 719 for receiving data from the various host machine sensors and inputs (i.e. sheet sensors 135, 136; pressure sensor 157; etc), and data (SWITCH DATA) from the various switches on Console 800 (FRONT PANEL SWITCHES-FIG. 25) module 524 serving to convert the signal input to a byte oriented output for transmittal to I/O module 502 under control of Input Matrix Select 604 (FIG. 23*b*). The byte output of module 524 is selected by address information inputted on bus 507 and decoded on module 524. Conversion matrix 720, which may comprise a diode array, converts the input logic signals of "0" to logic "1" true. Data from input matrix module 524 is transmitted via optical isolators 721 to Input Matrix Select 604 of I/O module 502 (FIG. 23*b*). From there, the data is transmitted through Multiplexer 624 and buffers 620 to CPU Module 500.

Figure 29:
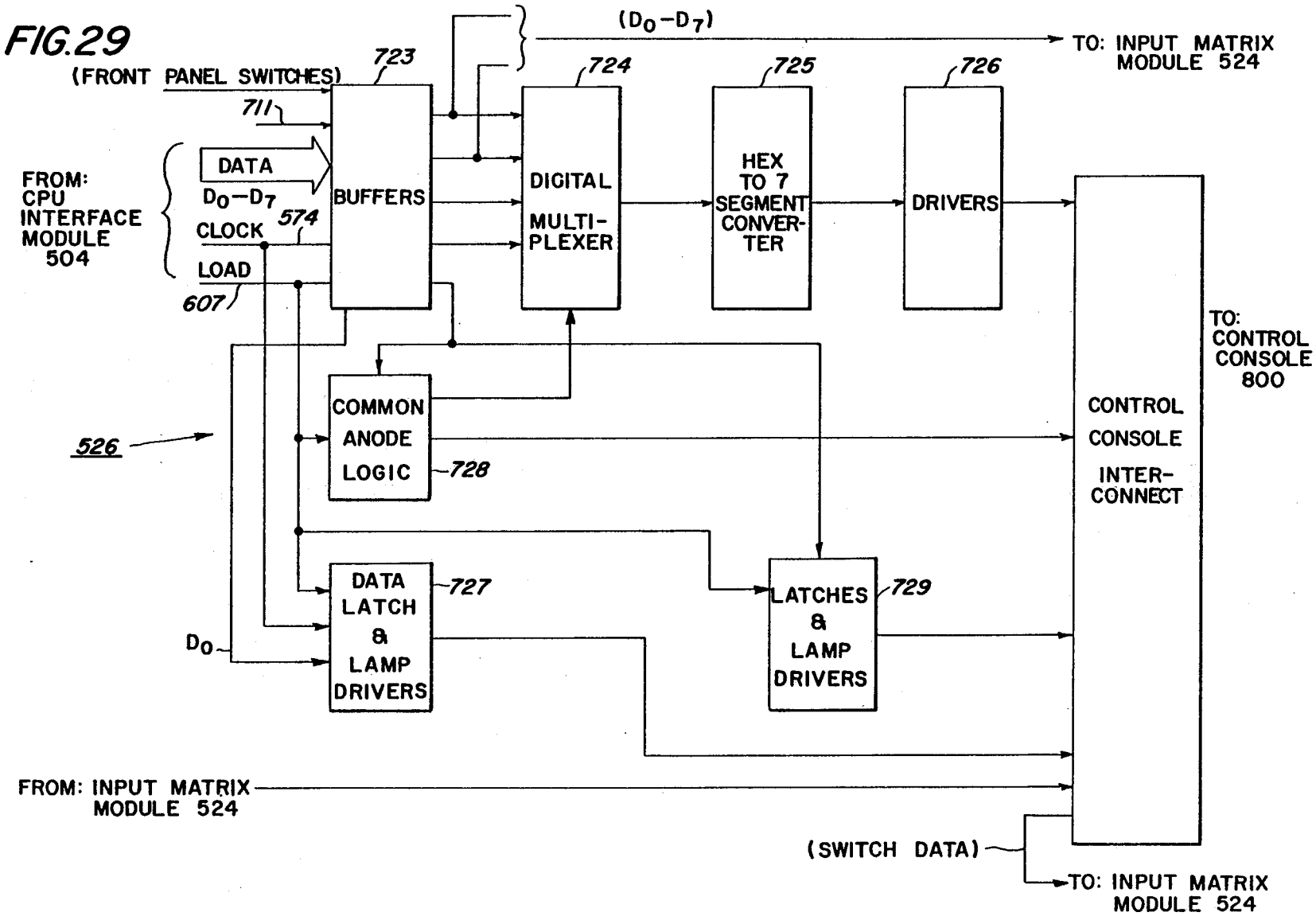
FIG. 29 is a block diagram of the input matrix module.

Referring particularly to FIG. 29, main panel interface module 526 serves as interface between CPU interface module 504 and operator control console 800 for display purposes and as interface between input matrix module 524 and the console switches. As described, data channels D0-D7 have data bits in each channel associated with the control console digital display or lamps. This data is clocked into buffer circuitry 723 and from there, for digital display, data in channels D1-D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard (FRONT PANEL SWITCHES) is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D3, D4, D5, D6, D7 respectively.

Figure 30:
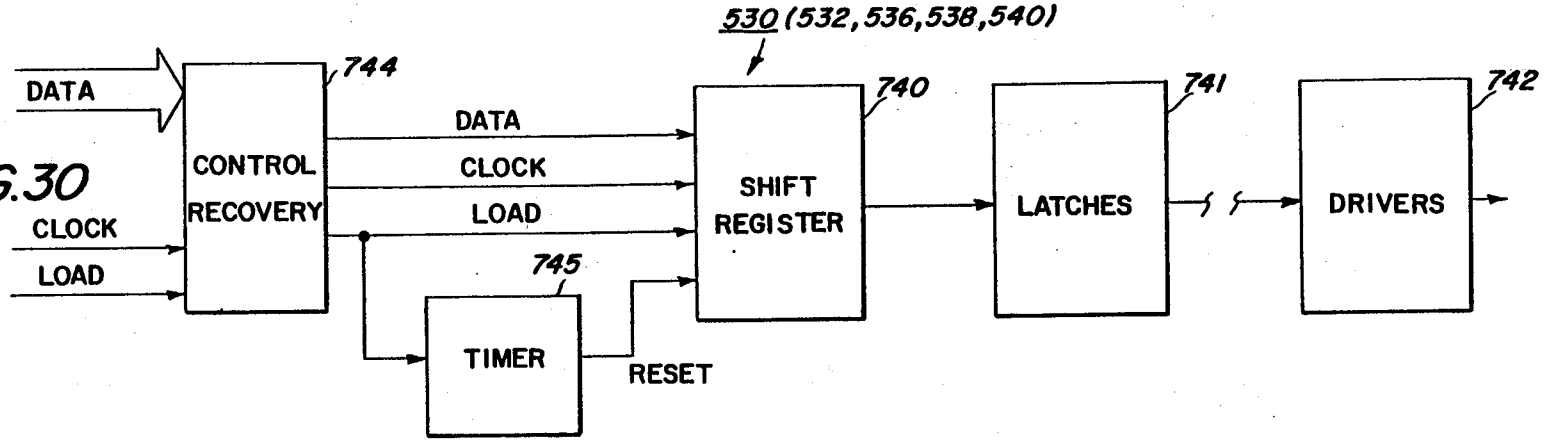
FIG. 30 is a block diagram of a typical remote.

Referring to FIG. 30, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuitry 744, which may comprise an inverting/non-inverting digital comparator pair and output latch is provided.

The LOAD signal serves to lockout input of data to latches 741 while new data is being clocked into shift register 740. Removal of the LOAD signal enables commutation of the fresh data to latches 741. The LOAD signal also serves to start timer 745 which imposes a maximum time limit within which a refresh period (initiated by Refresh Control 605) must occur. It refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Figure 31:
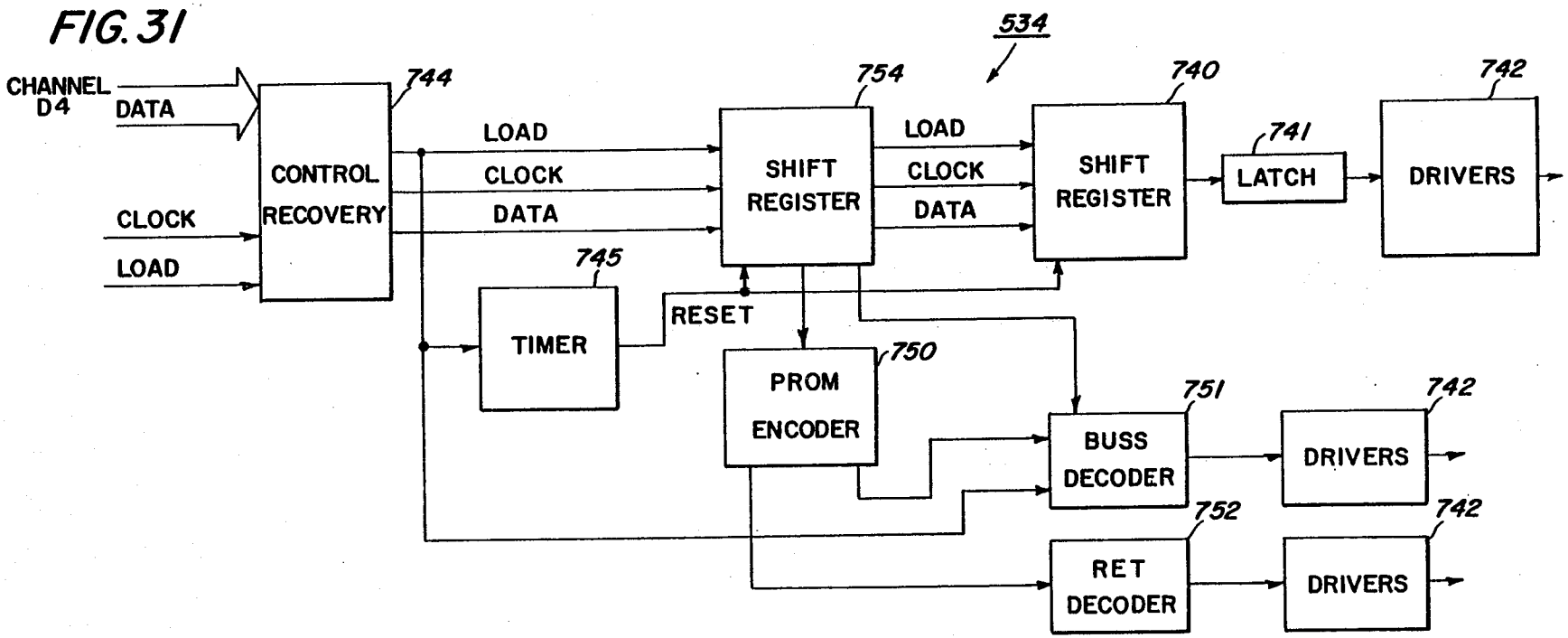
FIG. 31 is a block diagram of the sorter remote.

Referring to FIG. 31 wherein like numbers refer to like parts, to provide capacity for driving the sorter deflector solenoids 221, a decode matrix arrangement consisting of a Prom encoder 750 controlling bus decoder (BUS DECODER) 751, and return decoder 752 (RET DECODER) is provided. The output of decoders 751, 752 drive the sorter solenoids 221 of upper and lower bin arrays 210, 211 respectively. Data is inputted to encoder 750 by means of shift register 754.

Figure 32:
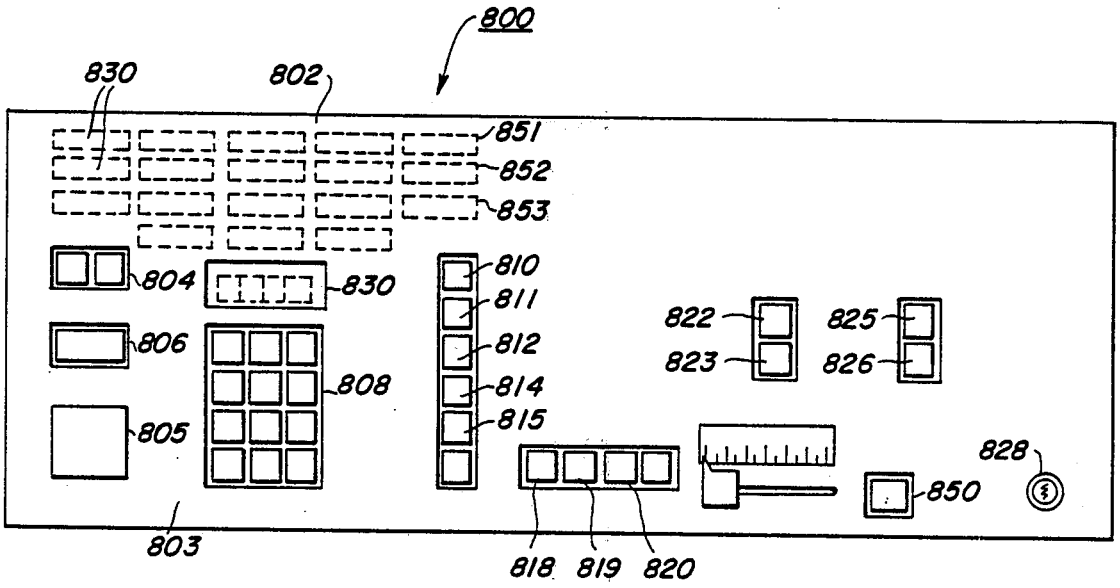
FIG. 32 is a view of the control console for inputting copy run instructions to the apparatus shown in FIG. 1.

Referring now to FIG. 32, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) buttons 805, stop print (STOP) button 806 and keyboard copy quantity selector 808. A series of feature select buttons consisting of auxiliary paper tray button 810, two sided copy button 811, copy lighter button 814, and copy darker button 815, are provided.

Additionally, image size selector buttons 818, 819, 820; multiple or single document select buttons 822, 823 for operation of document handler 16; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, JOB INCOMPLETE and UNLOAD SORTER. Other display information may be envisioned.

MACHINE OPERATION

As will appear, host machine 10 is conveniently divided into a number of operational states. The machine control program is divided into Background routines and Foreground routines with operational control normally residing in the Background routine or routines appropriate to the particular machine state then in effect. The output buffer 546' of RAM memory section (DATA OUT) is used to transfer/refresh control data to the various remote locations in host machine 10, control data from both Background and Foreground routines being inputted to RAM memory section 546 for subsequent transmittal to host machine 10. Transmittal/refresh of control data presently in the output buffer (DATA OUT) of section 546 is effected through Direct Memory access (DMA) under the aegis of a Machine Clock interrupt routine.

Foreground routine control data which includes a Run Event Table built in response to the particular copy run or runs programmed, is transferred to output buffer (DATA OUT) of RAM section 546 by means of a multiple prioritized interrupt system wherein the Background routine in process is temporarily interrupted while fresh Foreground routine control data is inputted to the RAM output buffer following which the interrupted Background routine is resumed.

The operating program for host machine 10 is divided into a collection of Foreground tasks, some of which are driven by the several interrupt routines and Background or non-interrupt routines. Foreground tasks are tasks that generally require frequent servicing, high speed response, or synchronization with the host machine 10. Background routines are related to the state of host machine 10, different Background routines being performed with different machine states. A single Background software control program (STCK) composed of specific sub-programs associated with the principal operating states of host machine 10 is provided. A byte called STATE contains a number indicative of the current operating state of host machine 10. The machine STATES are as follows:

| STATE NO. | MACHINE STATE | CONTROL SUBR. |
|---|---|---|
| 0 | Software Initialize | INIT |

-continued

| STATE NO. | MACHINE STATE | CONTROL SUBR. |
|---|---|---|
| 1 | System Not Ready | NRDY |
| 2 | System Ready | RDY |
| 3 | Print | PRINT |
| 4 | System Running, Not Print | RUNNPRT |
| 5 | Service | TECHREP |

Figure 33:
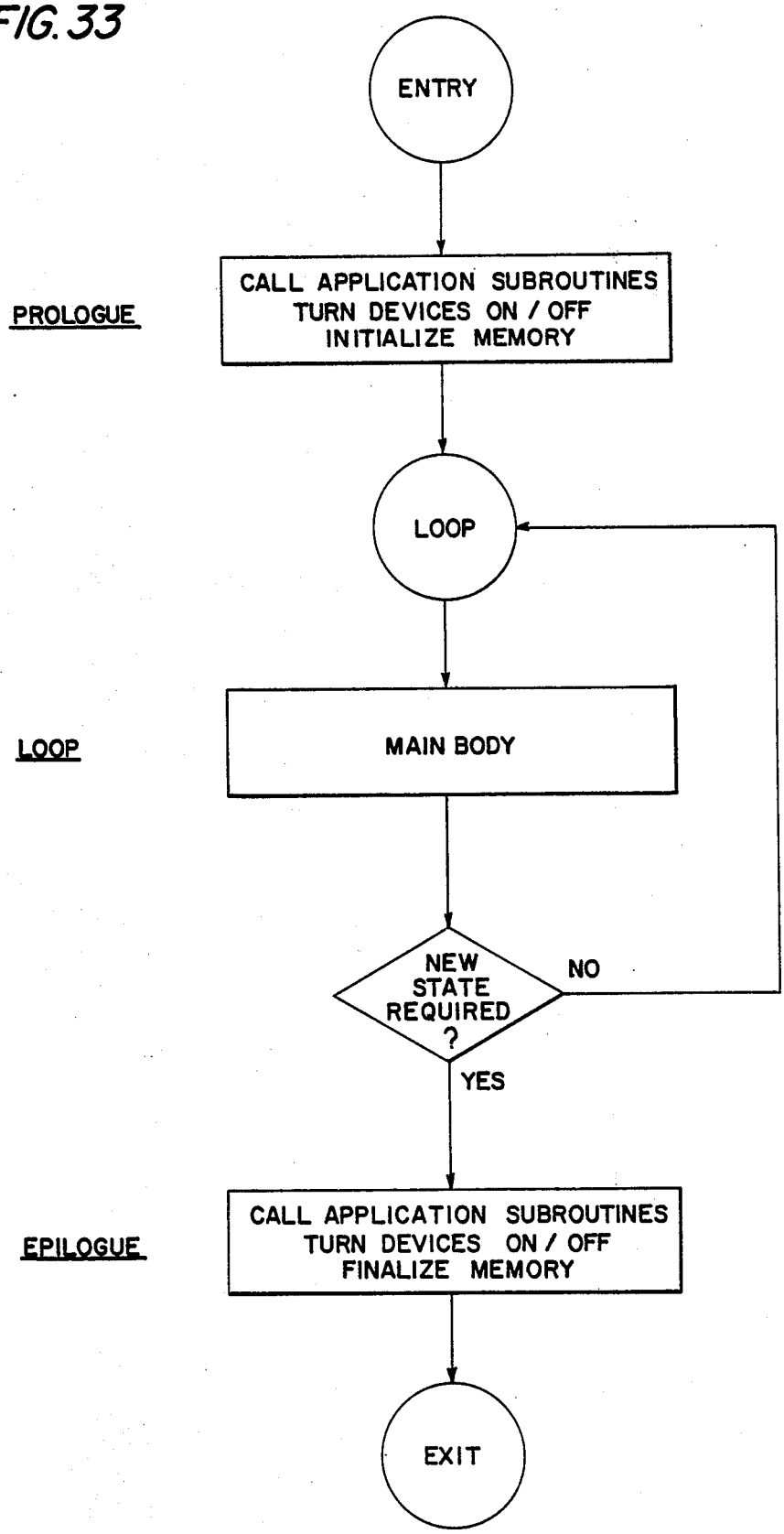
FIG. 33 is a flow chart illustrating a typical machine state.

Referring to FIG. 33, each STATE is normally divided into PROLOGUE, LOOP and EPILOGUE sections. As will be evident from the exemplary program STCK reproduced in TABLE I, entry into a given STATE (PROLOGUE) normally causes a group of operations to be performed, these consisting of operations that are performed once only at the entry into the STATE. For complex operations, a CALL is made to an applications subroutine therefor. Relatively simpler operations (i.e. turning devices on or off, clearing memory, presetting memory, etc.) are done directly.

Once the STATE PROLOGUE is completed, the main body (LOOP) is entered. The program (STCK) remains in this LOOP until a change of STATE request is received and honored. On a change of STATE request, the STATE EPILOGUE is entered wherein a group of operations are performed, following which the STATE moves into the PROLOGUE of the next STATE to be entered.

Figure 34:
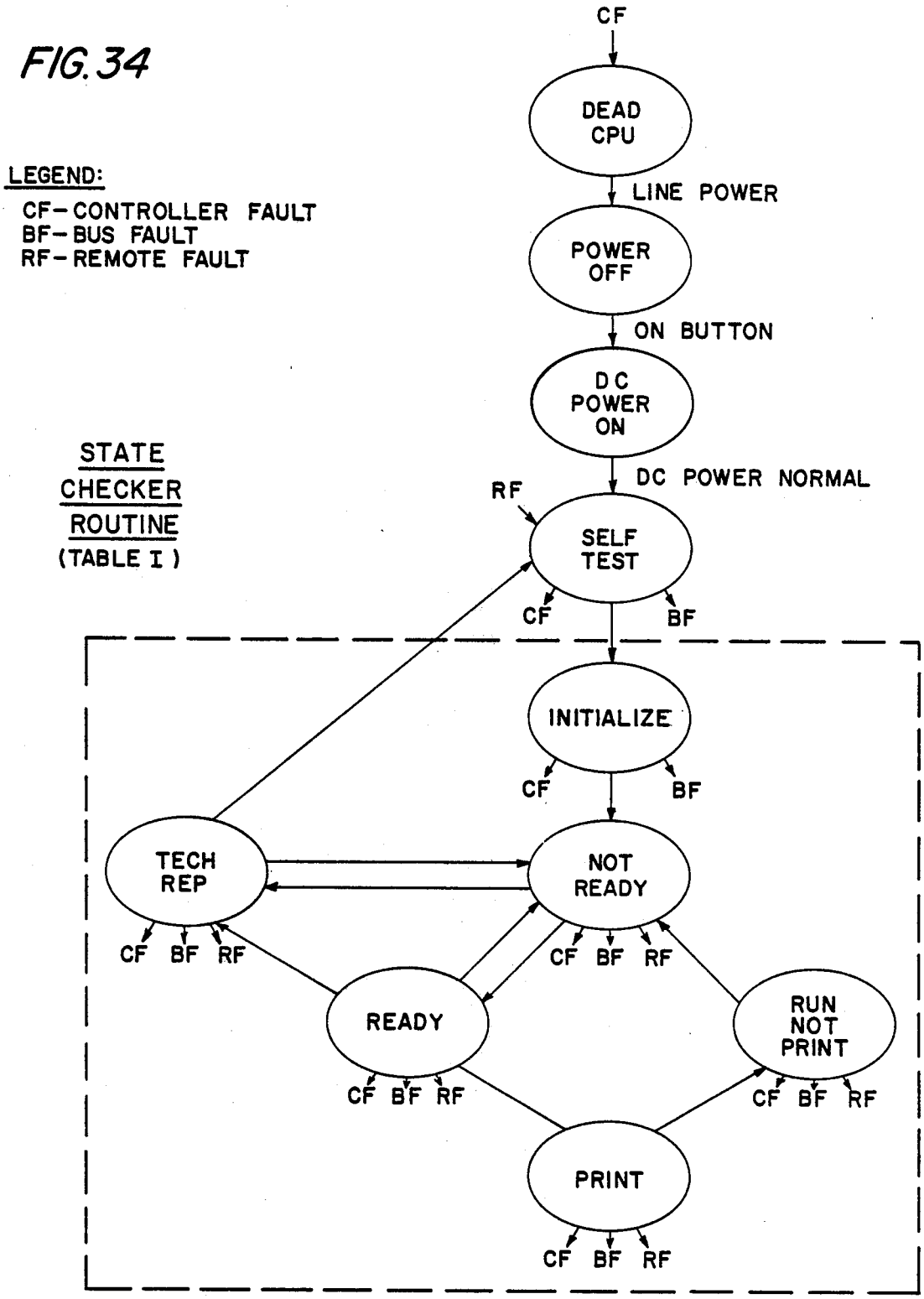
FIG. 34 is a flow chart of the machine state routine.

Referring to FIG. 34 and the exemplary program (STCK) in TABLE I. On actuation of the machine POWER-ON button 804 (FIG. 32), the software Initialize STATE (INIT) is entered. In this STATE, the controller is initialized and a software controlled self test subroutine is entered. If the self test of the controller is successfully passed, the System Not Ready STATE (NRDY) is entered. If not, a fault condition is signaled.

In the System Not Ready STATE (NRDY), Background subroutines are entered. These include setting of Ready flags, control registers, timers, and the like; turning on power supplies, the fuser, etc., initializing the Fault Handler, checking for paper jams (left over from a previous run), door and cover interlocks, fuser temperatures, etc. During this period, the WAIT lamp on console 800 is lit and operation of host machine 10 precluded.

When all ready conditions have been checked and found acceptable, the controller moves to the system ready state (RDY). The READY lamp on console 800 is lit and final ready checks made. Host Machine 10 is now ready for operation upon completion of input of a copy run program, loading of one ore more originals 2 into document handler 16 (if selected by the operator), and actuation of START PRINT button 805. As will appear hereinafter, the next state is PRINT wherein the particular copy run programmed is carried out.

While the machine is completing a copy run, the controller normally enters the Run Not Print state (RUNNPRT) where the controller calculates the number of copies delivered, resets various flags, stores certain machine event information in the memory, as well as generally conditioning the machine for another copy run, if desired. The controller then returns to the System Not Ready state (NRDY) to recheck for ready conditions prepatory for another copy run, with the same state sequence being repeated until the machine is turned off by actuation of POWER OFF button 804 or a malfunction inspired shutdown is triggered. The last state (TECH REP) is a machine servicing state wherein certain service routines are made available to the machine/repair personnel, i.e. Tech Reps.

Referring particularly to FIG. 32 and Tables II, III, IV, V, VI and VII, the machine operator uses control console 800 to program the machine for the copy run desired. Programming may be done during either the System Not Ready (NRDY) or System Ready (RDY) states, although the machine will not operate during the System Not ready state should START PRINT button 805 be pushed. The copy run includes selecting (using keyboard 808) the number of copies to be made, and such other ancillary program features as may be desired, i.e. use of auxiliary paper tray 102, (push button 810), image size selection (push buttons 818, 819, 820), document handler/sorter selection (push buttons 822, 823, 825, 826), copy density (push buttons 814, 815), duplex or two sided copy button 811, etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table (FIG. 35) comprised of Foreground tasks is built for operating in cooperation with the Background tasks the various components of host machine 10 in an integrated manner to produce the copies programmed. The run Event Table is formed by controller 18 through merger of a Fixed Pitch Event Table (TABLE II) (stored in ROM 545 and Non Volatile Memory 610) and a Variable Pitch Event Table (TABLE III) in a fashion appropriate to the parameters of the job selected.

The Fixed Pitch Event Table (TABLE II) is comprised of machine events whose operational timing is fixed during each pitch cycle such as the timing of bias to transfer roll 75, (TRN 2 CURR), actuating toner concentration sensor 65 (ADC ACT), loading roll 161 of fuser 150 (FUS*LOAD), and so forth, irrespective of the particular copy run programmed. The Variable Pitch Table (TABLE III) is comprised of machine events whose operational timing varies with the individual copy run programmed, i.e. timing of pitch fade-out lamp 44 (FO*ONBSE) and timing of flash illumination lamps 37 (FLSH BSE). The variable Pitch Table is built by the Pitch Table Builder (TABLE IV) from the copy run information programmed in by controller 18 (using the machine control program stored in ROM section 545 and Non-Volatile Memory 610), coupled with event address information from ROM section 545, sorted by absolute clock count (via the routine shown in TABLE V), and stored in RAM section 546 (via the routine shown in TABLE VI). The Fixed Pitch Event Table and Variable Pitch Table are merged with the relative clock count differences between Pitch events calculated to form a Run Event Table (TABLE VII).

Figure 35:
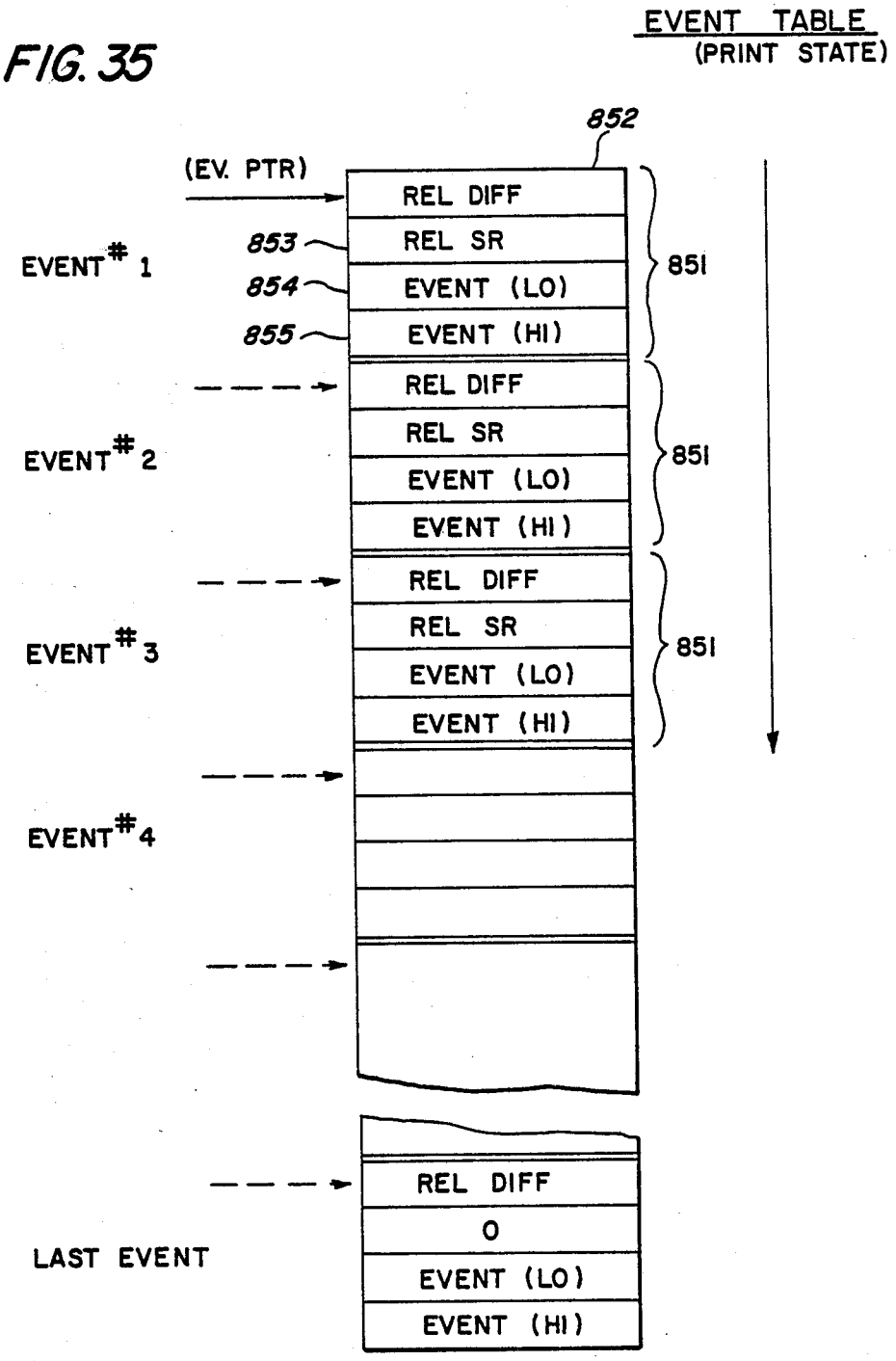
FIG. 35 is a view showing the event table layout.
Figure 36:
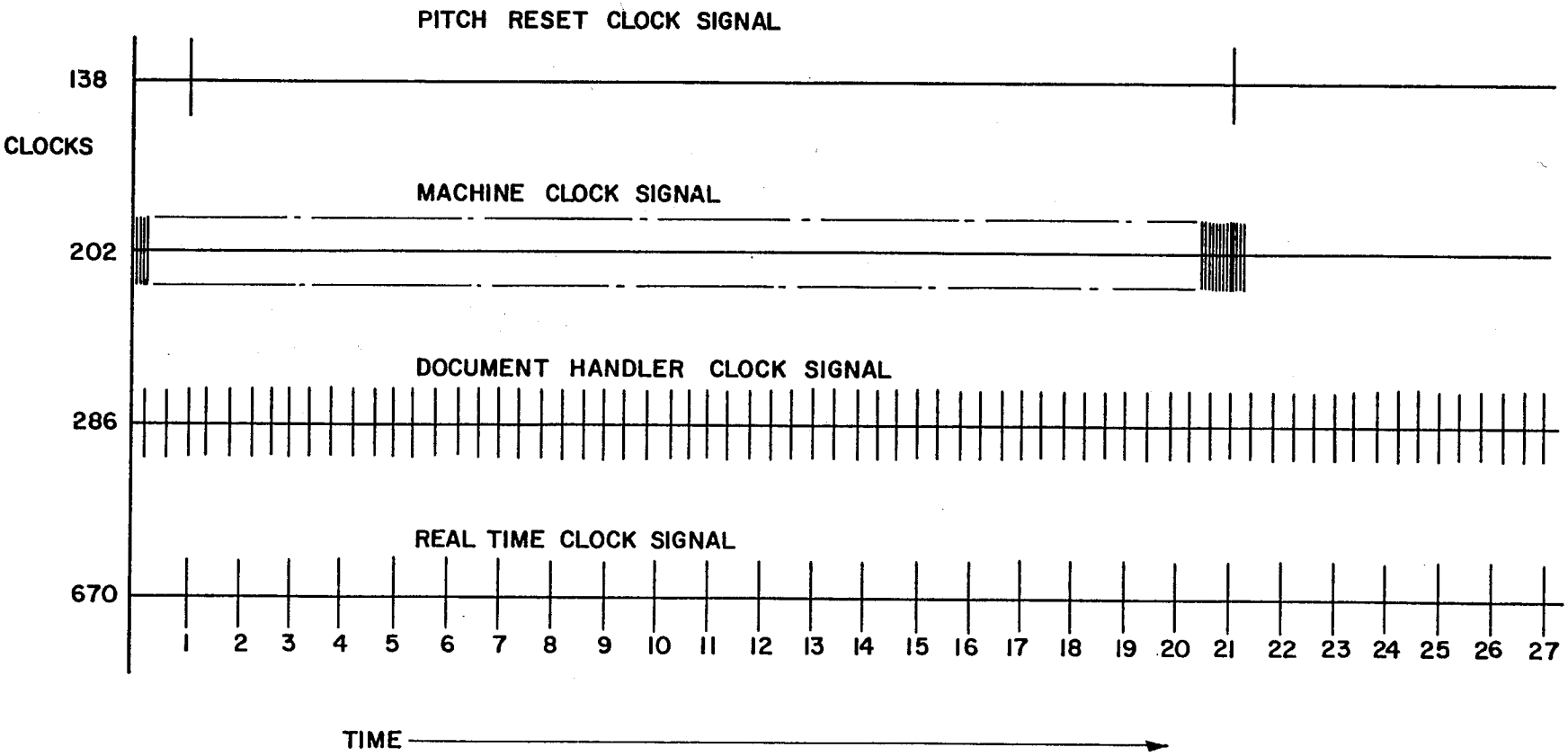
FIG. 36 is a chart illustrating the relative timing sequences of the clock interrupt pulses.
Figure 37:
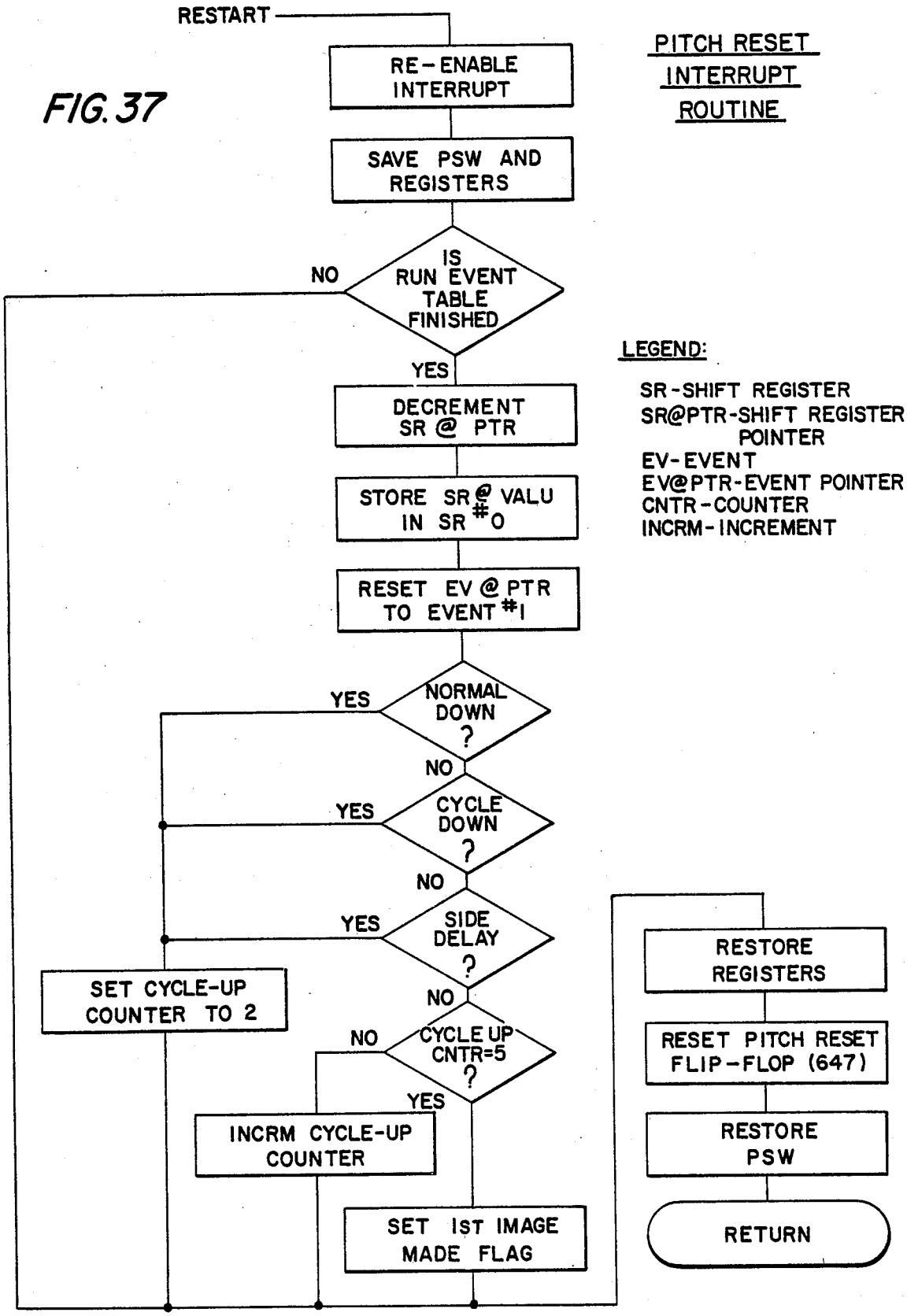
FIG. 37 is a flow charge of the pitch interrupt routine.

Referring particularly to FIG. 35, the Run Event Table consists of successive groups of individual events 851. Each event 851 is comprised of four data blocks, data block 852 containing the number of clock pulses (from machine clock 202) to the next scheduled pitch event (REL DIFF), data block 853 containing the shift register position associated with the event (REL SR), and data blocks 854, 855 (EVENT LO) (EVENT HI) containing the address of the event subroutine.

In machine states other than PRINT, data blocks 852, 853 (REL DIFF) (REL SR) are set to zero. Data blocks 854, 855 hold the address information for the Non-Print state event.

Control Data in the Run Event Table represents a portion of the Foreground tasks and is transferred to the output buffer 546' of RAM memory section 546 by the Pitch Reset and Machine Clock interrupt routines. Other control data, representing Foreground tasks not in the Run Event Table is transferred to RAM output buffer 546' by the Real Time Clock interrupt routine. Transfer of the remaider of the control data to output buffer 546' is by means of Background (non-interrupt) routines.

Transfer of control data from output buffer 546' of RAM memory section 546 to the various locations in host machine 10 is through output Refresh via Direct Memory access (DMA) in response to machine clock interrupt signals as will appear. The interrupt routines are initiated by the respective interrupt signals.

Referring particularly to FIG. 23 and 35–37 and TABLES VII, VIII the interrupt having the highest priority, the Pitch Reset interrupt (signal 640), is operable only during the PRINT state, and occurs once each revolution of sheet register fingers 141 as responded to by sensor 146 of pitch reset clock 138. At each pitch reset interrupt signal, after a determination of priority by Priority Chip 659 in the event of multiple interrupt signals, an interrupt signal (INT) is generated. The acknowledgement signal (INTA) from processor 542 initiates the pitch reset interrupt routine.

On entering the pitch reset routine, the interrupt is re-enabled and the contents of the program working registers stored. A check is made to determine if building of the Run Event Table is finished. Also checks are made to insure that a new shift register schedules have been build and at least 910 clock counts since the last pitch reset have elapsed. If not, an immediate machine shutdown is initiated.

Presuming that the above checks are satisfactory, the shift register pointer (SR PTR), which is the byte variable containing the address of a pre-selected shift register position (SR O), is decremented by one and adjusted for overflow and the shift register contents are updated with a byte variable (SR+VALUV) containing the new shift register value to be shifted in following the pitch reset interrupt. The event pointer (EV*PTR), a two byte variable containing the full address of the next scheduled event, is reset to Event #1. The count in the C register equals the time to the first event.

Machine Cycle Down, Normal Down, and Side One Delay checks are made, and if negative, the count on a cycle up counter (CYC UP CT) is checked. If the count is less than a predetermined control count (i.e. 5), the counter (CYC UP CT) is incremented by one. When the count on the cycle up counter equals the control count, an Image Made Flag is set.

If a Normal Down, Cycle Down, or Side One Delay has been initiated, the cycle up counter (CYC UP CT) is reset to a preset starting count (i.e. 2). The pitch reset interrupt routine is exited with restoration of the working registers and resetting of pitch reset flip flop 647.

The Machine Clock Interrupt routine, which is second in priority, is operative in all operational states of host machine 10. Although nominally driven by machine clock 202, which is operative only during Print state when processor main drive motor 34 is energized, machine clock pulses are also provided by phase locked loop 649 when motor 34 is stopped.

Referring particularly to FIG. 38 and TABLE IX, entry to the Machine Clock interrupt routine there shown is by a signal (INTA) from processor 542 following a machine clock interrupt signal 642 as described earlier. On entry, the event control register (C REG) is obtained and the working register contents stored. The C REG is decremented by one, the register having been previously set to a count corresponding to the next event in the Event Run Table.

The control register (C REG) is checked for zero. If the count is not zero and is an odd number, an output refresh cycle is initiated to effect transfer/refresh of data in RAM output buffer 546' to host machine 10. If the number is even, or following an output refresh, the interrupt system is re-enabled, the machine clock interrupt flip flop 651 is reset and the working registers are restored. Return is then made to the interrupted routine.

If the control register (C REG) count is zero, the Event Pointer (EV*PTR), which identifies the clock count (in data block 852) for the next scheduled event (REL DIFF), is loaded and the control register (C REG) reset to a new count equal to the time to the next event. The Event Pointer (EV*PTR) is incremented to the relative shift register address for the event (REL SR, data block 853), and the shift register address information is set in appropriate shift registers (B, D, E, A registers).

The event Pointer (EV*PTR) is incremented successively to the event subroutine address information (EVENT LO) (EVENT HI) in the Event Run Table, and the address information therefrom loaded into a register pair (D & E registers). The Event Pointer (EV PTR) is incremented to the first data block (REL DIFF) of the next succeeding event in the Run Event Table, saved, and the register pair (H & L registers) that comprise the Event Pointer are loaded with the event subroutine address from the register pair (D & E registers) holding the information. The register pair (D & E registers) are set to the return address for the Event Subroutine. Using the address information, the Event Subroutine is called and the subroutine data transferred to RAM output buffer 546' for transfer to the host machine on the next Output Refresh.

Following this, the Machine Clock interrupt routine is exited as described earlier.

The Output Refresh cycle alluded to earlier functions, when entered, to transfer/refresh data from the output buffer of 546' RAM section 546 to host machine 10. Direct Memory Access (DMA) is used to insure a high data transfer rate.

On a refresh, Refresh Control 605 (see FIG. 236) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546' of RAM section 546 and transfers the contents thereof to host machine 10. Data previously transferred is refreshed.

The Real Time Interrupt, which carries the lowest priority, is active in all machine states. Primarily, the interrupt acts as an interval timer by decrementing a series of timers which in turn serve to control initiation of specialized subroutines used for control and error checking purposes.

Figure 39A:
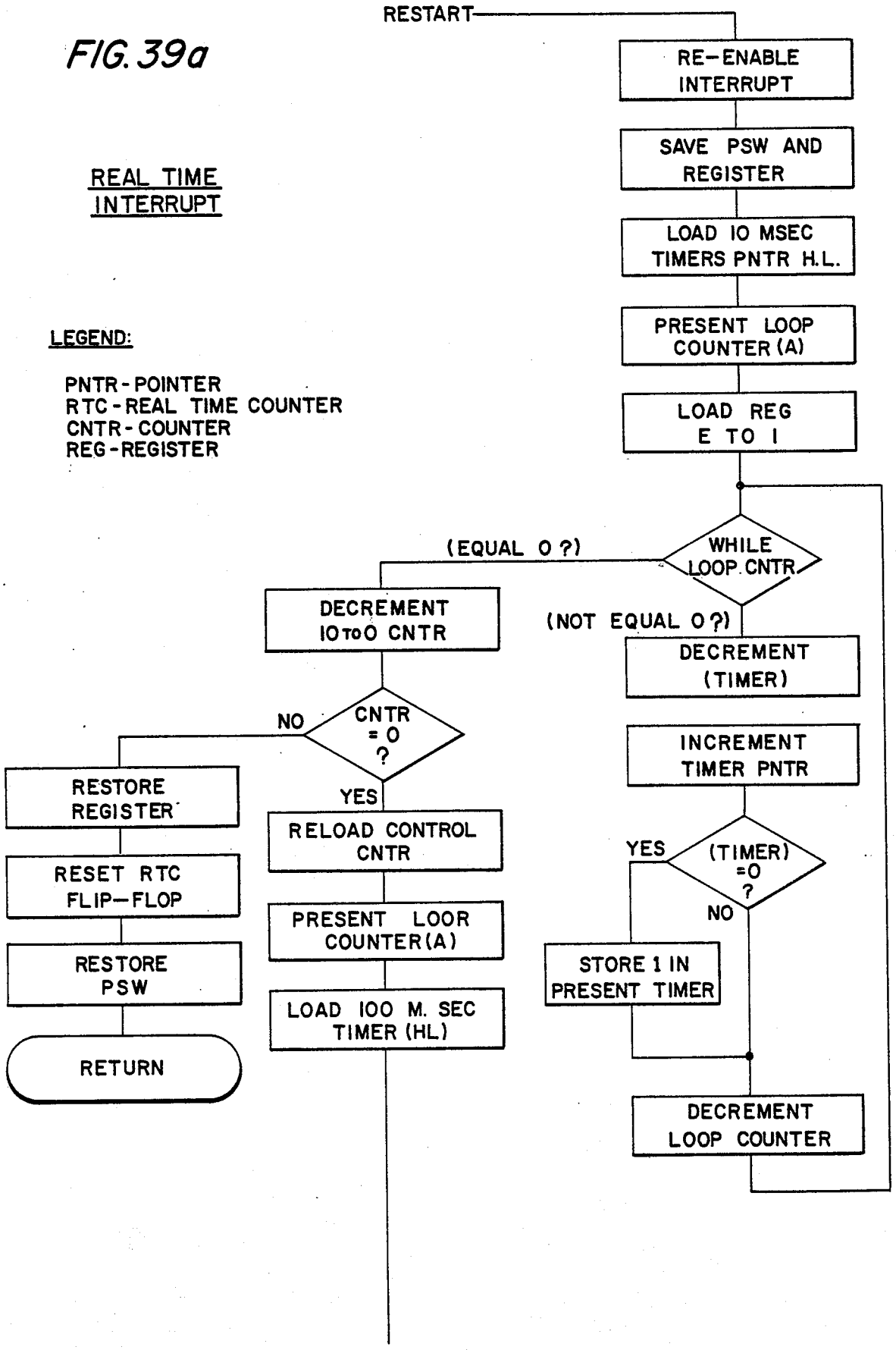
FIGS. 39*a* and 39*b* comprise a flow chart of the real time interrupt routines.
Figure 39B:
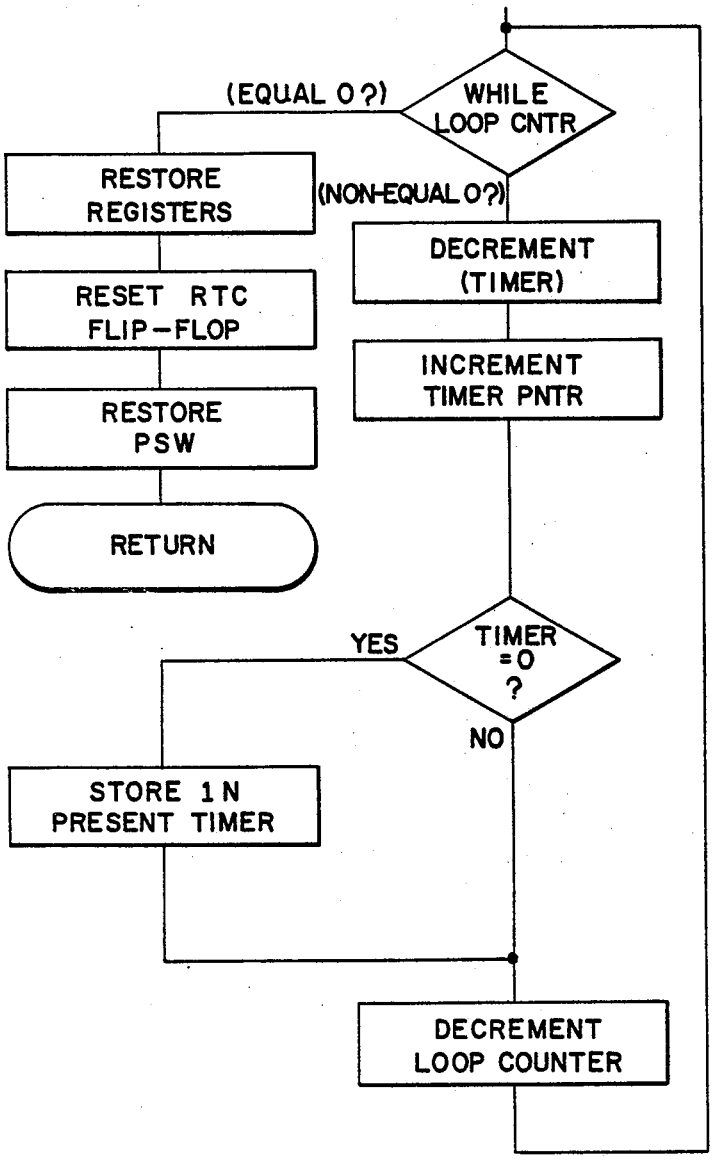

Referring particularly to FIG. 39(*a, b*) and TABLE X, The Real Time interrupt routine is entered in the same manner as the interrupt routines previously described, entry being in response to a specific RESTART instruction code assigned to the Real Time interrupt. On entry, the interrupt is re-enabled and the register contents stored. The timer pointer (PNTR) for the first class of timers (i.e. 10 msec TIMERS) is loaded, and a loop counter identifying the number of timers of this class (i.e. 10 msec TIMERS) preset. A control register (E REG) is loaded and a timer decrementing loop is entered for the first timer. The loop decrements the particular timer, increments the timer pointer (PNTR) to the location of the next timer in this class, checks the timer count, and decrements the loop counter. The decrementing loop routine is repeated for each timer in the class (i.e. 10 msec TIMERS) following which a control counter (CNTR) for the second group of timers (i.e. 100 msec TIMERS) is decremented by one and the count checked.

The control counter (CNTR) is initially set to a count equal to the number of times the first timer interval is divisible into the second timer interval. For example, if the first class of timers are 10 msec timers and the second timer class are 100 msec timers, the control counter (CNTR) is set at 10 initially and decremented on each Real Time interrupt by one down to zero.

If the count on the control counter (CNTR) is not zero, the registers are restored, Real Time interrupt flip flop 856 reset, and the routine exited. If the count on the control counter is zero, the counter is reloaded to the original maximum count (i.e. 10) and a loop is entered decrementing individually the second group of timers (i.e. 100 msec TIMERS). On completion, the routine is exited as described previously.

In the following TABLES:

"@" - is used to indicate flags, counters and subroutine names.

"#" - is used to indicate input signals.

"$" - is used to indicate output signals.

":" - is used to indicate macro instructions, system subroutines, system flags, and data, etc.

For further explanation of the mnemonics and particular instructions utilized by the following routines, the reader is directed to Intel Corporation's Programming Manual for the 8080 Microcomputer System.

TABLE I

```
                                  *NAR
                                  *
                                  *        I N I T I A L I Z E   S T A T E
                                  *
                                  *        INIT: SUBROUTINE
                                  *
                                  *        INITIALIZE STATE- EXECUTED AFTER EACH START OR RESTART.  SETS
                                  *        ALL POINTERS, FLAGS, AND DATA TO INITIAL VALUES REQUIRED TO
                                  *        START EXECUTION OF ANY CONTROL ALGORITHMS.  ALWAYS EXITS TO
                                  *        'NOT READY' STATE.

                                  *        EPILOG

05 00000   3E0A      A   INIT:    MVI      A,10                      INITIALIZE TO 10
05 00002   3252FD    N            STA      DIVD:10                   INITIALIZE TO 10
05 00005   32B5FC    N            STA      SLOWTOGL                  H&L= ADDR OF STBY EVENT TABLE
05 00008   211907    N            LXI      H,EV@STBY:                SAVE FOR MACH CLK ROUTINE
05 0000B   2264FD    N            SHLD     EV@PTR:                   INIT INSTRUMENTATION REMOTE
05 0000E   21FFFF    A            LXI      H,X'FFFF'                   ADDR PNTR TO END OF RAM
05 00011   2272FB    N            SHLD     INS@PTRB                  SET PNTR TO RAM CNTRL TABLE
05 00014   21FFFF    N            LXI      H,ADH@RAMT-1              SAVE PNTR
05 00017   2278FB    N            SHLD     TAB@STRT                  INIT TO UN-BYPASS
05 0001A   3E7F      A            MVI      A,X'7F'                                 ALL JAM SWS
05 0001C   328DFC    N            STA      JAM@BYPS
                                  *
                                  *        TIMER INITIALIZATION
                                  *        MUST BE DONE BEFORE ANY TIMERS CAN BE USED
                                  *
05 0001F   211FF9    A            LXI      H,AVAIL:**8+X'1F'         SET H&L TO END OF AVAIL: TABLE
05 00022   36FF      A            MVI      M,X'FF'                   STORE X'FF' IN LAST TABLE ADDR
05 00024   3E1F      A            MVI      A,31                      SET A-REG TO VALUE TO BE STORED
                                  REPEAT
05 00026   2D        A                DCR      L                     STEP TO NEXT TABLE LOCATION
05 00027   77        A                MOV      M,A                   STORE INITIALIZATION VALUE
05 00028   3D        A                DCR      A                     STEP TO NEXT VALUE
05 00029   C22600    N            UNTIL:   CC,Z,S                    IS INITIALIZATION COMPLETE
05 0002C   2120FE    A            LXI      H,ADR(DATA,TIME:OUT)      TO INITIALIZE TIME:OUT TABLE
05 0002F   225FFD    N            SHLD     INPTR:                     SET IN/OUT POINTERS TO
05 00032   2261FD    N            SHLD     OUTPTR:                    BEGINNING OF TIME:OUT TABLE
                                  *
                                  *        INITIALIZE SPOOL
                                  *        POINTERS
                                  *
05 00035   2140FE    A            LXI      H,ADR(DATA,SPL:TBL)       SET PNTRS
05 00038   226AFD    N            SHLD     SPL:IN                                  TO START
05 0003B   226CFD    N            SHLD     SPL:OUT                                          OF TABLE
                                  *
                                  *        CHECK IF PAPER WAS PRESENT WHEN POWER WENT DOWN
                                  *
05 0003E   3AC9E2    A            RNVNIB   NV@JAM@N                  A = JAM INFO FROM POWER DOWN
05 00041   0F        A            RRC                                SET CARRY TO FDR JAM INFO
05 00042   D25A00    N            IF:      CC,C,S                    WAS THERE PAPER IN FDR AREA
05 00045   47        A                MOV      B,A                   YES, SAVE JAM INFO
05 00046   213CFD    A                SFBIT,P  FDR@AJAM,FDR@MJAM     SET FEEDER JAMS
05 00049   3E0C      A
05 0004B   B6        A
05 0004C   77        A
```

```
153   05 0004D   2121F9   A
      05 00050   3E03     A
      05 00052   B6       A
      05 00053   77       A
154   05 00054   3E80     A
      05 00056   3267F4   A
155   05 00059   78       A
156
157   05 0005A   0F       A
158   05 0005B   D27100   N
159                                  *
160
161   05 0005E   2EFF     A
162                                  *
163   05 00060   2603     A
164                                  *
165   05 00062   223BFD   A
166   05 00065   3E80     A
      05 00067   3267F4   A
167   05 0006A   2120F9   A
      05 0006D   3E21     A
      05 0006F   B6       A
      05 00070   77       A
168
169
170   05 00071   E60C     A
      05 00073   CA8A00   N
171
172   05 00076   FE0C     A
      05 00078   C28300   N
173   05 0007B   3E80     A
      05 0007D   3261F4   A
174   05 00080   C38700   N
175   05 00083   0F       A
176
177   05 00084   3237F4   A
178
179   05 00087   CD0000   N
180
181   05 0008A   3E80     A
      05 0008C   328CF7   A
182   05 0008F   3287F7   A
183   05 00092   326BF4   A
184   05 00095   3EF2     A
185   05 00097   3200E6   A
186   05 0009A   FB       A
187   05 0009B   CD0000   N
      05 0009E   02       A
      05 0009F   E480     A
      05 00A1    EE80     A
188   05 00A3    CD0000   N
      05 00A6    12       A
      05 00A7    FA       A
      05 00A8    0000     N
189   05 00AA    CD0000   N
190   05 00AD    327AFC   N
191   05 00B0    3E08     A
192   05 00B2    3286FC   N
193   05 00B5    3E02     A
```

```
    SFBIT,P   BN@X@2,BN@X@3          SIGNAL TRANSPT CL!RANCE REQ!D

    SFLG      CLP@REQD               TELL FLT HNDLR CLEARANCE REQD

    MOV       A,R                    RESTORE THE A-REG
ENDIF
RRC                                  SET CARRY TO IMED@DN!
IF!       CC,C,S                     WAS THERE AN IMED@DN!

    MVI       L,MSK(FBIT,L@PR@FLT,JAM2@FLT,JAM3@FLT,JAM4@FLT,)
              JAM5@FLT,JAM6@FLT,RET1@FLT,RET2@FLT)
                                     SETS ALL JAM FBITS IN REG-L
    MVI       H,MSK(FBIT,S@S@JAM,MISSTRIP)
                                     SETS ADDITIONAL FBITS IN H
    SHLD      ADR(FBYT,PAP!1)        MOVE FBITS INTO FBYTES
    SFLG      CLR@REQD               TELL FLT HNDLR CLEARANCE REQD

    SFBIT,P   TS@FUS,TS@X@2          TURN ON UNDEDICATED MAP LAMPS

ENDIF
IF!       XBYT,A,AND,)               IS EITHER SRT JAM FLAG SET
          MSK(NVBIT,NV@LOW@J,NV@UP@J),NZ  IN NVNIB

    IF!       XBYT,A,EQ,)            YES, ARE BOTH SET
              MSK(NVBIT,NV@LOW@J,NV@UP@J)

        SFLG      TWO@ACT            TELL SRT THAT THERE WAS A JAM

    ELSE!
        RRC                          GET NV@LOW@J TO SIGN BIT &
        ID!READ   NV@LOW@J
        MODFLG    LOW@MOD            TELL SRT IF UP OR LOW JAM
    ENDIF
    CALL      JAM@SET                LET SRT SET JAM FLAGS & LAMPS
ENDIF
SFLG      SRT@RDY                    SIGNAL SRT NOT IN USE (READY)

MODFLG    PROG@RDY                   SET PROG ROUTINE READY
MODFLG    2SD@ENAB                   ALLOW SELECTION OF DUPLEX MODE
MVI       A,X!F2!                    RE-ENABLE
STA       RSINTFF!                           INTERRUPT
EI                                                   SYSTEM
SOBIT,S   NPFO$ON,24V$SPL            PFO OFF (INVT!D) & 24V ON

STIMR     FLT@DLY,25000,FLT@CHK      START LENS FAULT TIMER

CALL      DOC@CLP                    INITIALIZE DOC@NUM TO 1      (1)
STA       CF@DIGIT                   ENABLE !0! IN QTY FLASHED    (2)
MVI       A,MSK(FBIT,POP@RS)         TELL FLT ASSUME
STA       XP@PREV                            BRUSH HOUSE OPN
MVI       A,:NRDY                    INIT STCK
```

```
194   05 00087   3254FD   N        STA      :STATE:                          SYNCRONIZED BACKGROUND
195   05 0008A   3253FD   N        STA      STATE:                                        CONTROL LOOP
196   05 0008D   CD3702   N        CALL     NRDY:PRL                      INIT CONTROL TO NOT-READY STATE
198                                ***********************************************************************
199                                *                                                                     *
200                                *   S Y C R O N I Z E D   B A C K G R O U N D   C O N T R O L   L O O P S *
201                                *                                                                     *
202                                ***********************************************************************

204                                *        PRIORTIES:
205                                *                 FIRST     10MS TIME OUT REQUESTS
206                                *                 SECOND    10MS CALLS
207                                *                 THIRD     SPOOLED CALLS
208                                *                 FOURTH    20MS CALLS
209                                *                 FIFTH     100MS CALLS
210                                *                 SIXTH     100MS TIME OUT REQUESTS

212   05 000C0   2151FD   A        LXI      H,ADR(DATA,SB:RQST)          SET MEM PNTR TO SB BYTE
213                                REPEAT                                 LOOP-3 FROM HLT ON ALL INTER'S
214                                    REPEAT                             LOOP-2 BACK AFTER EACH 100MS
215                                        REPEAT                         LOOP-1 BACK AFTER EACH 20MS
216   05 000C3   7E       A                MOV       A,M                  A= SYNC BKGND REQUESTS FROM RTC
217                                        ID:READ   SB:RQST
218   05 000C4   07       A                RLC                            TEST FOR 10MS
219   05 000C5   D2F700   N                IF:       CC,C,S                        SB REQUEST
220                                *
221                                *                                      TIMER SERVICE REQUESTS
222                                *                                      'CALLS TIMED OUT TIMER SUBRS
223                                *                                       USING WRAP AROUND TABLE AND
224                                *                                       IN/OUT PNTRS - RTCI SETS
225                                *                                       INPTR: & ENTERS CALL ADDR
226                                *
227   05 000C8   3A5FFD   N                WHILE:    XBYT,INPTR:,NE,OUTPTR: ARE PNTRS AT SAME TABL
      05 000CB   2161FD   N
      05 000CE   8E       A
      05 000CF   CAE500   N
228   05 000D2   6E       A                    MOV       L,M       SET L-REG TO ADDR(L) IN TABLE
229   05 000D3   26FE     A                    MVI       H,HADR(DATA,TIME:OUT) MEM PNTR NOW SET TO
230   05 000D5   5E       A                    MOV       E,M            MOVE CALL ADDR(L) TO E
231   05 000D6   23       A                    INX       H             STEP TO NEXT TABLE BYTE
232   05 000D7   56       A                    MOV       D,M            MOVE CALL ADDR(H) TO D
233   05 000D8   23       A                    INX       H             STEP TO NEXT TABLE BYTE
234   05 000D9   7D       A                    MOV       A,L       PREPARE TO UPDATE PNTR
235                                            ID:READ   TIME:OUT  DYNAMIC TABLE CONTAINING ADDRS
236                                            MODBYT    A,AND,)   ADJUST FOR END OF TABLE
237   05 000DA   E62F     A                                TIME:MSK
238   05 000DC   3261FD   A                    STA       ADR(DATA,OUTPTR:) PNTR TO ADDR OF LAST SE
239   05 000DF   CD0000   N                    CALL      DE:IND    DO TIMEOUT CALL
240   05 000E2   C3C800   N                ENDWHILE                YES, ALL TIME OUTS SERVICED
241                                *                                END TIMER SECTION
242   05 000E5   2A55FD   N                LHLD      10:CALLS      GET PROPER 10MS CALL TABLE
243   05 000E8   CDC000   N                CALL      HL:IND        DO 10MS CALLS
244   05 000EB   2151FD   A                LXI       H,ADR(DATA,SB:RQST) SET MEM PNTR TO SB BYTE
245   05 000EE   F3       A                DI
246   05 000EF   7E       A                MODBYT    M,AND, 10:RQST REMOVE 10MS REQUEST
      05 000F0   E67F     A
      05 000F2   77       A
247                                      ID:ALTR   SB:RQST
```

```
248   05 000F3   FB       A
249   05 000F4   C31501   N
250   05 000F7   3A6AFD   N
      05 000FA   216CFD   N
      05 000FD   BE       A
      05 000FE   CA1101   N
251   05 00101   6E       A
252   05 00102   26FE     A
253   05 00104   5E       A
254   05 00105   23       A
255   05 00106   56       A
256   05 00107   23       A
257   05 00108   7D       A
258   05 00109   E64F     A
259   05 0010B   326CFD   A
260   05 0010E   CD0000   N
261
262   05 00111   2151FD   A
263   05 00114   7E       A
264
265
266   05 00115   07       A
267   05 00116   07       A
268   05 00117   D24201   N
269   05 0011A   2A59FD   N
270   05 0011D   5E       A
271   05 0011E   23       A
272   05 0011F   7E       A
      05 00120   FEFF     A
      05 00122   C23701   N
273   05 00125   2A57FD   N
274   05 00128   2259FD   N
275   05 0012B   2151FD   A
276   05 0012E   F3       A
277   05 0012F   7E       A
      05 00130   E6BF     A
      05 00132   77       A
278
279   05 00133   FB       A
280   05 00134   C34201   N
281   05 00137   56       A
282   05 00138   23       A
283   05 00139   2259FD   N
284   05 0013C   CD0000   N
285   05 0013F   2151FD   A
286
287
288   05 00142   7E       A
      05 00143   E640     A
      05 00145   C2C300   N
289
290   05 00148   7E       A
      05 00149   E620     A
      05 0014B   CA9E01   N
291
292   05 0014E   2A5DFD   N
293   05 00151   5E       A
294   05 00152   23       A
```

```
        EI                          (WATCH OUT FOR UNPRINTABLE NOT)
    ELSE:                           DO ANY SPOOLFD ROUTINES
        IF:         XBYT,SPL:IN,NE,SPL:OUT


            MOV         L,M
            MVI         H,HADR(DATA,SPL:TBL)
            MOV         E,M
            INX         H
            MOV         D,M
            INX         H
            MOV         A,L
            MODBYT      A,AND,SPL:MSK
            STA         ADR(DATA,SPL:OUT)
            CALL        DE:IND
        ENDIF
        LXI         H,ADR(DATA,SB:RQST)
        MOV         A,M
    ENDIF
    ID:READ   SB:RQST
    RLC
    RLC                             TEST FOR 20MS
    IF:         CC,C,S                          SB REQUEST
        LHLD        20PNTR          SET MEM PTR TO CALL IN 20MS TAB
        MOV         E,M             MOVE CALL ADDR(L) TO E
        INX         H               STEP MEM PTR TO ADDR(H)
        IF:         XBYT,M,EQ,X'FF' IS POINTER AT END OF TABLE


            LHLD        20:PNTR     YES, SET MOVING POINTER
            SHLD        20PNTR          BACK TO BEGINNING OF TABLE
            LXI         H,ADR(DATA,SB:RQST)       SET MEM PNTR TO
            DI
            MODBYT      M,AND, 20:RQST REMOVE 20MS REQUEST


            ID:ALTR     SB:RQST
            EI
        ELSE:
            MOV         D,M         NO, MOVE CALL ADDR(H) TO D
            INX         H               STEP TO NEXT CALL IN TABLE
            SHLD        20PNTR          SAVE FOR NEXT LOOP-1
            CALL        DE:IND
            LXI         H,ADR(DATA,SB:RQST) SET MEM PNTR TO SB BY
        ENDIF
    ENDIF
UNTIL:    XBYT,M,AND,20:RQST,Z  MORE 20MS CALLS TO DO  (LOOP-1)


ID:READ   SB:RQST
IF:       XBYT,M,AND,100:RQST,NZ TEST FOR 100MS SB REQUEST


    ID:READ   SB:RQST
    LHLD      100PNTR               SET MEM PNTR TO CALL IN 100 TAB
    MOV       E,M                   MOVE CALL ADDR(L) TO E
    INX       H                     STEP MEM PNTR TO ADDR(H)
```

```
295   05 00153   7E       A
      05 00154   FEFF     A
      05 00156   C29301   N
296   05 00159   2A5BFD   N
297   05 0015C   225DFD   N
298                                  *
299                                  *
300                                  *
301                                  *
302                                  *
303                                  *
304                                  *
305                                  *
306                                  *
307                                  *
308                                  *
309   05 0015F   2130FA   N
310   05 00162   1614     A

312                                  *

314   05 00164   3A45FD   A
      05 00167   E640     A
      05 00169   CA6E01   N
315
316   05 0016C   1611     A
317
318                                  *
319
320   05 0016E   7E       A
      05 0016F   A7       A
      05 00170   CA8201   N
321   05 00173   35       A
322   05 00174   C28201   N
323   05 00177   D5       A
324   05 00178   E5       A
325   05 00179   24       A
326   05 0017A   5E       A
327   05 0017B   24       A
328   05 0017C   56       A
329   05 0017D   CD0000   N
330   05 00180   E1       A
331   05 00181   D1       A
332                                  *
333
334
335   05 00182   23       A
336   05 00183   15       A
337   05 00184   C26E01   N
338                                  *
339   05 00187   2151FD   A
340   05 0018A   F3       A
341   05 0018B   7E       A
      05 0018C   E6DF     A
      05 0018E   77       A
342
343   05 0018F   FB       A
344   05 C0190   C39E01   N
345   05 00193   56       A
346   05 00194   23       A
```

```
IF:       XBYT,M,EQ,X'FF'   IS PNTR AT END OF TABLE

   LHLD      100'PNTR       YES, SET MOVING PNTR BACK
   SHLD      100PNTR             TO BEGINNING OF TABLE

                            100MS TIMER SERVICE
                             DECREMENTS TIMERS AND CALLS
                             SUBROUTINE REQUESTED WHEN
                             TIMER TIMES OUT
                             USES 3 TABLES ON 3 CONSECUTIVE
                             RAM PAGES -100'CNT W/TIMER
                                       -100'LS W/ADDR(L)
                                       -100'LS W/ADDR(H)
                             ADDR IS FOR REQSTED SUBR

   LXI       H,100'CNT      STARTING ADDR OF 100MS TIMERS
   MVI       D,100'TMAX     D=REG SET TO QTY OF 100MS TMRS

                            CONDITIONAL HOLD OF 100MS TMRS

   IF:       FBIT,STDBOPNO,T IS STAND-BY RELAY OPEN

       MVI       D,100'TMAX; YES, HOLD SPECIFIED NUMBER
                 -HOLDTMRS          OF TIMERS
   ENDIF

   REPEAT                   LOOP TO DECR & SERVICE TIMEOUTS
       IF:       VBYT,M,NZ IS TIMER ACTIVE

            DCR        M      DECR TIMER
            IF:             CC,Z,S HAS TIMER TIMED OUT
                PUSH       D       SAVE # TIMERS TO SERVICE
                PUSH       H       SAVE ADDR OF CURRENT TIMER
                INR        H       STEP TO NEXT RAM PAGE
                MOV        E,M     MOVE CALL ADDR(L) TO E
                INR        H       STEP TO NEXT RAM PAGE
                MOV        D,M     MOVE CALL ADDR(H) TO D
                CALL       DE'IND
                POP        H       RECALL ADDR OF CURRENT TMR
                POP        D       RECALL NUMBER OF TIMERS
                                    YET TO BE SERVICED
            ENDIF
       ENDIF
       INX        H           STEP TO NEXT TIMER ADDR
       DCR        D           DECR NUMBER OF 100MS TIMERS
   UNTIL:     CC,Z,S          HAVE ALL TIMERS BEEN SERVICED
                              END 100MS TIMER SECTION

   LXI       H,ADR(DATA,SB'RQST) SET MEM PNTR TO SB BYTE
   DI
   MODBYT    M,AND, 100'RQST REMOVE 100MS REQUEST


   ID'ALTR   SB'RQST
   EI
ELSE:
   MOV       D,M             NO, MOVE CALL ADDR(H) TO D
   INX       H                   STEP PNTR TO NEXT CALL
```

```
05 00195   225DFD   N                          SHLD     100PNTR          SAVE FOR NEXT LOOP-2
05 00198   CD0000   N                           CALL     DE:IND
05 0019B   2151FD   A                           LXI      H,ADR(DATA,SB:ROST) SET MEM PNTR TO SB BYTE
                                          ENDIF
                                       ENDIF
05 0019E   7E       A                UNTIL!    V9YT,M,Z                 MORE SB CALLS TO DO  (LOOP-2)
05 0019F   A7       A
05 001A0   C2C300   N
                                    ID:READ   SB:ROST
05 001A3   76       A                   HLT                             COOL IT UNTIL INTERRUPT RESTART
05 001A4   CAC300   N            UNTIL!    CC,Z,C                       WAS INTERRUPT RTC  (LOOP-3)
05 001A7   F3       A            DI                                     ONLY KIDDING BEFORE, BUT THIS
05 001A8   76       A            HLT                                     TIME REALLY STOP (ABORT)
                                 *
                                 *        SUBR TO SET CALL TABLE POINTERS
                                 *        CALLED BY EACH STATE PROLOG
                                 *
                                 *        POSITION SB:TABLE POINTER
                                 *
05 001A9   3A53FD   N   SB:PNTRS LDA      STATE!                        WHAT STATE IS WANTED
05 001AC   110600   A            LXI      D,X'06'                       LOAD D&E WITH SKIP NUMBER
05 001AF   21D501   N            LXI      H,SB:TABLE-X'06'              H&L=6'<' TABLE ADDR
                                 REPEAT
05 001B2   19       A                DAD      D                         SKIP THREE WORDS
05 001B3   3D       A                DCR      A                         DECR STATE LOOP COUNTER
05 001B4   F2B201   N            UNTIL!    CC,S,S                       IS POINTER AT CORRECT STATE
                                 *
                                 *        TRANSFER ADDRS TO VARIABLE SB POINTERS
                                 *
05 001B7   1155FD   N            LXI      D,10!CALLS                    SET D&E TO FIRST OF SB PNTRS
05 001BA   0602     A            MVI      B,2                           LOAD 10!CALLS
05 001BC   CDCE01   N            CALL     MV!WORDS                                  & 20!PNTR
05 001BF   2B       A            DCX      H                             ADJUST 'FROM' PNTR
05 001C0   2B       A            DCX      H                                                BACK 1 WORD
05 001C1   0602     A            MVI      B,2                           LOAD 20PNTR
05 001C3   CDCE01   N            CALL     MV!WORDS                                  & 100!PNTR
05 001C6   2B       A            DCX      H                             ADJUST 'FROM' PNTR
05 001C7   2B       A            DCX      H                                                BACK 1 WORD
05 001C8   CDCC01   N            CALL     MV!WORD                       LOAD 100PNTR
                                 ID:ALTR  10!CALLS,20!PNTR,20PNTR,;     DATA WORDS MODIFIED
                                          100!PNTR,100PNTR               BY THIS SUBR
05 001CB   C9       A            RET
                                 *NAR
                                 *
                                 *        MV!WORD/MV!WORDS SUBROUTINES
                                 *
                                 *        SUBR TO TRANSFER WORDS (2BYTES) FROM MEMORY POINTED TO BY <H&L>
                                 *         TO MEMORY POINTED TO BY <D&E>. CALL MV!WORD FOR 1 TRANSFER,
                                 *         AND CALL MV!WORDS (WITH B-REG # WORDS TO TRANSFER) FOR
                                 *         MULTIPLE TRANSFERS. USES ALL BUT C-REG.
                                 *
05 001CC   0601     A   MV!WORD  MVI      B,1                           B= # WORDS TO BE MOVED
                        MV!WORDS REPEAT
05 001CE   7E       A                MOV      A,M                       A= 1ST 'FROM' BYTE
05 001CF   12       A                STAX     D                         STORE IN 1ST 'TO' LOCATION
05 001D0   23       A                INX      H                         ADVANCE 'FROM'
05 001D1   13       A                INX      D                                   AND 'TO' PNTRS
05 001D2   7E       A                MOV      A,M                       A= 2ND 'FROM' BYTE
```

```
05 001D3    12        A              STAX     D                  STORE IN 2ND 'TO' LOCATION
05 001D4    23        A              INX      H                  ADVANCE 'FROM'
05 001D5    13        A              INX      D                                AND 'TO' PNTRS
05 001D6    05        A              DCR      B                  DECRM # OF WORDS CNTR
05 001D7    C2CE01    N          UNTIL!   CC,Z,S                 LOOP UNTIL ALL WORDS TRANSFERRD
05 001DA    C9        A          RET
                             *
                             *  TABLE OF SR CALL POINTERS
                             *  FOR EACH STATE
                             *
05 001DB    0906      N   SB:TABLE DW     COMP10
05 001DD    0A06      N          DW       COMP20
05 001DF    1206      N          DW       COMP100
05 001E1    B105      N          DW       TREP10
05 001E3    B505      N          DW       TREP20
05 001E5    C305      N          DW       TREP100
05 001E7    4202      N          DW       NRDY10
05 001E9    4602      N          DW       NRDY20
05 001EB    52C2      N          DW       NRDY100
05 001ED    AF02      N          DW       RDY10
05 001EF    B302      N          DW       RDY20
05 001F1    BF02      N          DW       RDY100
05 001F3    A803      N          DW       PRNT10
05 001F5    B203      N          DW       PRNT20
05 001F7    C803      N          DW       PRNT100
05 001F9    1905      N          DW       RUNN10
05 001FB    1D05      N          DW       RUNN20
05 001FD    2F05      N          DW       RUNN100

                             *
                             *  SUBR TO DO EPILOGS & PROLOGS LAST CALL IN EVERY 100MS TABLE
                             *
05 001FF    2153FD    A   STAT!CHG LXI     H,ADR(DATA,STATE!)     A= PRESENT STATE # IF UNCHANGED
05 00202    7E        A          MOV      A,M                     OR NEXT STATE IF CHANGED
05 00203    23        A          INX      H                      H&L= ADDR 'FORMER STATE' GLOBAL
05 00204    BE        A          IF!      XBYT,A,NE,M            HAS THERE BEEN A STATE CHANGE
05 00205    CA3602    N
                                     ID!READ   STATE!,!STATE!
05 00208    46        A                MOV      B,M               YES, B= FORMER STATE
05 00209    77        A                MOV      M,A               UPDATE 'FORMER' TO 'PRESENT'
                                     ID!ALTR   !STATE!
05 0020A    78        A                CASE!    VBYT,B            DO EPILOG FOR FORMER STATE
05 0020B    111F02    N
05 0020E    FE06      A
05 00210    CD0000    N                  C,0       COMP!EPL       COMPONENT CONTROL STATE
05 00213    1806      N                  C,1       TREP!EPL       TECH REP STATE
05 00215    DB05      N                  C,2       NRDY!EPL       NOT-READY STATE
05 00217    7A02      N                  C,3       RDY!EPL        READY STATE
05 00219    E302      N                  C,4       PRNT!EPL       PRINT STATE
05 0021B    E603      N                  C,5       RUNN!EPL       SYSTEM RUNNING, NOT PRINT STATE
05 0021D    4105      N                ENDCASE
                                     CASE!    VBYT,STATE!        DO PROLOG FOR PRESENT STATE
05 0021F    3A53FD    N
05 00222    113602    N
05 00225    FE06      A
05 00227    CD0000    N                  C,0       COMP!PRL       COMPONENT CONTROL STATE
05 0022A    FF05      N                  C,1       TREP!PRL       TECH REP STATE
05 0022C    A505      N
```

```
455   05 0022E   3702    N                 C,2      NRDY:PRL          NOT-READY STATE
456   05 00230   A602    N                 C,3      RDY:PRL           READY STATE
457   05 00232   1603    N                 C,4      PRNT:PRL          PRINT STATE
458   05 00234   0B05    N                 C,5      RUNN:PRL          SYSTEM RUNNING, NOT PRINT STATE
459                                     ENDCASE
460                                 ENDIF
461   05 00236   C9      A            RET                            RETURN TO 100 MSEC SYNC BKGND
463                            *NAR
464                            *
465                            *     N O T   R E A D Y   S T A T E
466                            *
467                            *     NOT READY STATE- EXECUTES AFTER INITIALIZE UNTIL ALL READY CONDITIONS
468                            *     ARE MET.  THIS STATE CAN ALSO BE ENTERED FROM 'RUN NOT PRINT','READY'
469                            *     AND 'TECH REP'.  CONTROL EXITS TO EITHER 'READY' OR 'TECH REP' STATES.

471                            *     PROLOG

473   05 00237   CDA901  N  NRDY:PRL CALL     SB:PNTRS                 SYNC BKG PNTRS TO NEW STATE
474   05 0023A   CD0000  N           STIMR    INST@TMR,1000,NEXT@FLT   UPDATES INST FLT CODE IN STBY
      05 0023D   49      A
      05 0023E   64      A
      05 0023F   0000    N
475   05 00241   C9      A            RET

477                            *     CALLS FOR NOT READY 10 MS SYN BACKGROUND

479   05 00242   CD0000  N  NRDY10   CALL     ADH@CTRL
480   05 00245   C9      A           RET

482                            *     CALLS FOR NOT READY 20 MS SYN BACKGROUND

484   05 00246   0000    N  NRDY20   DW       NRDY@SWS
485   05 00248   0000    N           DW       MN@ELVAS
486   05 0024A   0000    N           DW       DSPL@CTL
487   05 0024C   0000    N           DW       LMP@CTRL
488   05 0024E   0000    N           DW       INSTRU
489   05 00250   FFFF    A           DW       X'FFFF'                  END OF TABLE

491                            *     CALLS FOR NOT READY 100 MS SYN BACKGROUND

493   05 00252   0000    N  NRDY100  DW       NRILK@CK
494   05 00254   0000    N           DW       RED@BGND
495   05 00256   0000    N           DW       DVL@DUMP
496   05 00258   0000    N           DW       RECAPER
497   05 0025A   0000    N           DW       BIN@CHK                  1
498   05 0025C   0000    N           DW       MINIPHS1                 2
499   05 0025E   0000    N           DW       BIL@JMPO
500   05 00260   0000    N           DW       FUS@ROUT
501   05 00262   0000    N           DW       FLT@100                  1
502   05 00264   0000    N           DW       FLT@CTRL                 2
503   05 00266   0000    N           DW       FLT@CLRN                 3
504   05 00268   0000    N           DW       PROG2SJM
505   05 0026A   0000    N           DW       PSD@STBY
506   05 0026C   0000    N           DW       XHM@STBY
507   05 0026E   0000    N           DW       JAM@RST
508   05 00270   0000    N           DW       KEY@CNTR
509   05 00272   0000    N           DW       TST@LP4
```

```
510   05 00274   8402     N          DW        NRDY:CHG                    TEST IF OK TO
511   05 00276   FF01     N          DW        STAT:CHG                                  LEAVE NOT READY
512   05 00278   FFFF     A          DW        X'FFFF'                     END OF TABLE

514                                 *          EPILOG

516   05 0027A   CD0000   N   NRDY:EPL COBIT,S   WAIT$                     INSURE WAIT OFF AT NRDY EXIT
      05 0027D   E9FE     A
517   05 0027F   AF       A          CFLG      STRT:PRT                    DIS-ABLE TRANSFER TO 'PRINT'
      05 00280   325BF4   A
518   05 00283   C9       A          RET

520                                 *
521                                 *          SUBR FOR 'NOT-READY' 100MS SYNC BKGND
522                                 *           TESTS FOR CHANGE TO 'READY' OR 'TREP REP'
523                                 *
524   05 00284   CDCF05   N   NRDY:CHG CALL      TREP:CHG                    TEST FOR STATE CHANGE TO :TREP
525   05 00287   7E       A          IF:       XBYT,M,NE,:TREP             DID IT CHANGE TO :TREP STATE
      05 00288   FE01     A
      05 0028A   CA9302   N
526                                     ID:READ   STATE:
527   05 0028D   CD9402   N             CALL      RDYTEST:                  TEST ALL 'READY' FLAGS
528   05 00290   CD0803   N             CALL      NRDY:RDY                  MOVE TO EITHER :NRDY OR :RDY
529                                 ENDIF
530   05 00293   C9       A          RET

532                                 *
533                                 *          SUBR TO TEST ALL 'READY' FLAGS IN A LOOP
534                                 *
535   05 00294   2184F7   A   RDYTEST: LXI      H,RDYFLGS:                H&L= START ADDR OF READY FLAGS
536   05 00297   0609     A          MVI       B,RDYFNUM:                B= # OF READY FLAGS TO CHK
537                                 REPEAT
538   05 00299   7E       A             MOV       A,M                    A= <PRESENT READY FLAG>
539   05 0029A   07       A             RLC                              SET C IF FLAG SET (READY)
540   05 0029B   DAA002   N             IF:       CC,C,C                 IS PRESENT FLAG INDICATING RDY
541   05 0029E   0601     A                 MVI       B,1                NO, DON'T TEST ANY FURTHER
542                                     ENDIF
543   05 002A0   23       A             INX       H                      MOVE TO NEXT FLAG LOCATION
544   05 002A1   05       A             DCR       B                      DECRM LOOP CNTR (# READY FLAGS)
545   05 002A2   C29902   N          UNTIL:    CC,Z,S                    LOOP UNTIL ALL FLAGS CHKED
546                                 ID:READ   LENS@RDY,ELV@RDY,FUS@RDY,I FLAGS READ
547                                           PROG@RDY,ILCK@RDY,XMM@RDY,I
548                                           FLT@RDY,ADH@NMOV,SRT@RDY
549   05 002A5   C9       A          RET                                 RETURN
551                                 *NAR
552                                 *
553                                 *          R E A D Y    S T A T E
554                                 *
555                                 *          READY STATE- EXECUTES WHEN MACHINE IS READY TO GO INTO PRINT STATE.
556                                 *          CONTROL CAN GO BACK TO 'NOT READY' OR GO TO 'TECH REP' IF REQUIRED.

558                                 *          PROLOG

560   05 002A6   CD0000   N   RDY:PRL SOBIT,S   READY$
      05 002A9   E701     A
561   05 002AB   CDA901   N          CALL      SB:PNTRS                    SYNC BKG PNTRS TO NEW STATE
562   05 002AE   C9       A          RET
```

```
564                                 *        CALLS FØR READY 10MS SYN BACKGRØUND

566   05 002AF   CD0000   N   RDY10   CALL     ADHØCTRL
567   05 002B2   C9       A           RET

569                                 *        CALLS FØR READY 20MS SYN BACKGRØUND

571   05 002B3   0000     N   RDY20   DW       RDYØSWS
572   05 002B5   0000     N           DW       MNØELVØS
573   05 002B7   0000     N           DW       DSPLØCTL
574   05 002B9   0000     N           DW       LMPØCTRL                    ,
575   05 002BB   0000     N           DW       INSTRU
576   05 002BD   FFFF     A           DW       X'FFFF'                     END ØF TABLE

578                                 *        CALLS FØR READY 100MS SYN BACKGRØUND

580   05 002BF   0000     N   RDY100  DW       BINØCHK                     1
581   05 002C1   0000     N           DW       MINIPHS1                    2
582   05 002C3   0000     N           DW       BILØJMPØ
583   05 002C5   0000     N           DW       DVLØDUMP
584   05 002C7   0000     N           DW       RECAPER
585   05 002C9   0000     N           DW       FUSØRDUT
586   05 002CB   0000     N           DW       FLTØ100                     1
587   05 002CD   0000     N           DW       FLTØCTRL                    2
588   05 002CF   0000     N           DW       NRILKØCK
589   05 002D1   0000     N           DW       REDØBGND
590   05 002D3   0000     N           DW       2SDØSTPY
591   05 002D5   0000     N           DW       XMMØSTPY
592   05 002D7   0000     N           DW       JAMØRST
593   05 002D9   0000     N           DW       KEYØCNTR
594   05 002DB   0000     N           DW       TSTØLP4
595   05 002DD   E9C2     N           DW       RDY:CHG                     TEST IF ØK TØ
596   05 002DF   FFC1     N           DW       STAT:CHG                                  LEAVE READY
597   05 002E1   FFFF     A           DW       X'FFFF'                     END ØF TABLE

599                                 *        FPILØG

601   05 002E3   CD0000   N   RDY:EPL  CØBIT,S   READY$
      05 002E6   E7FE     A
602   05 002E8   C9       A           RET

604                                 *        CHANGE ØF STATE RØUTINES

606                                 *
607                                 *        SUBR FØR 'READY' 100MS SYNC BKGND
608                                 *         TESTS FØR CHANGE TØ 'NØT-READY' ØR 'TECH REP'
609                                 *
610   05 002E9   CDDF05   N   RDY:CHG  CALL     TREP:CHG                    TEST FØR STATE CHANGE TØ :TREP
611   05 002EC   7E       A           IF:      XBYT,M,NE,:TREP             DID IT CHANGE TØ :TREP STATE
      05 002ED   FE01     A
      05 002EF   CA0A03   N
612                                              ID:READ   STATE:
613   05 002F2   CD9402   N                      CALL      RDYTEST:                TEST ALL 'READY' FLAGS
614   05 002F5   CD0B03   N                      CALL      NRDY:RDY                MØVE TØ EITHER :NRDY ØR :RDY
615   05 002F8   3A5BF4   A                      IF:       FLG,STRT:PRT,T          IS START PRINT REQUESTED
      05 002FB   07       A
      05 002FC   D20A03   N
616   05 002FF   2153FD   A                         LXI       H,ADR(DATA,STATE:)   SET MEM PNTR
```

```
617   05 00302   7E        A                    IF:       XBYT,M,EQ,:RDY        OK TO GO TO PRINT
      05 00303   FE03      A
      05 00305   C20A03    N
618                                                ID:READ   STATE:
619   05 00308   3604      A                       MVI       M,:PRNT            CHG TO PRT STATE
620                                                ID:ALTR   STATE:
621                                          ENDIF
622                                       ENDIF
623                                    ENDIF
624   05 0030A   C9        A           RET

626                            *
627                            *     SUBR TO USE INFO FROM 'RDYTEST' AND EXECUTE THE PROPER CHANGE OF STATE
628                            *
629   05 0030B   2153FD    A   NRDY:RDY LXI       H,ADR(DATA,STATE:)            SET MEM PNTR
630   05 0030E   3603      A           MVI       M,:RDY                        ASSUME GOING TO 'READY' STATE
631                                    ID:ALTR   STATE:
632   05 00310   DA1503    N           IF:       CC,C,C                        ARE ALL 'READY' FLAGS SET
633   05 00313   3602      A               MVI       M,:NRDY                   NO, MOVE TO 'NOT-READY' STATE
634                                       ID:ALTR   STATE:
635                                    ENDIF
636   05 00315   C9        A           RET
638                            *NAR
639                            *
640                            *     P R I N T    S T A T E
641                            *
642                            *     PRINT STATE- EXECUTES WHILE MACHINE IS PRODUCING COPIES.
643                            *     ENTERED FROM 'READY' AND EXITS TO 'RUN NOT PRINT'.

645                            *     PROLOG

647   05 00316   2160FE    N   PRNT:PRL CLR:MEM   16,SHIFTREG                   CLEAR SHIFT REGISTER
      05 00319   0610      A
      05 00318   CD0000    N
648   05 0031E   3E60      A           MVI       A,LADR(DATA,SHIFTREG)         FORCE SHIFT REG TO START AT
649   05 00320   3263FD    A           STA       ADR(DATA,SR@PTR:)              BEGINNING OF SHIFTREG TABLE
650                                    CLR:MEM   SD1@DLY-TIME@DN:+1,)          CLEAR THE FOLLOWING FLAGS
651   05 00323   21A7F4    A                     ADR(FLG,TIME@DN:)
      05 00326   0609      A
      05 00328   CD0000    N
652                                    ID:CLR    TIME@DN:,IMED@DN:,)
653                                              CYCL@DN:,NORM@DN:,QWIK:OUT,)
654                                              IMGMADF:,SD1@TIMO,SD1@DLY
655   05 0032B   3E80      A           SFLG      910@DONE                      ALLOW FIRST PITCH RESET
      05 0032D   326FF4    A
656   05 00330   AF        A           XRA       A
657   05 00331   3266FD    N           STA       CYCUPCT:                      'INIT CYCLE-UP CNTR TO 0
658   05 00334   3269FD    N           STA       SR@VALU:                      INIT 'NEW SR VALUE' TO 0
659   05 00337   325DFA    N           STA       PLL@INFO                      INIT PLL SHUTDOWN CONTROL TO 0
660   05 0033A   3268FD    N           STA       SMPL@CT:                      INIT SAMPLE COPY CNTR TO 0
661   05 0033D   3E03      A           MVI       A,3
662   05 0033F   3267FD    N           STA       NOIMGCT:                      INIT 'NO IMAGE CNTR' TO 3
663   05 00342   CD0000    N           CALL      SRSK                          SHIFT REG SCHEDULER (INIT SR#0)
664   05 00345   CD0000    N           CALL      TIM@MOD                       CALC SHIFTED IMAGE VALUES   (1)
665   05 00348   CD0000    N           STIMR     935:TMR,810,RETURN:           SET 'OVER-RUN EVENT' TIMER  (2)
      05 0034B   22        A
      05 0034C   51        A
      05 0034D   0000      N
666   05 0034F   CD0000    N           CALL      TBLD@PRT                      BUILD NEW PITCH TABLE       (3)
```

```
667  05 00352  CD0000  N          S0BIT,S   PRNT$RLY,PR$C00L          PRINT RELAY & C00LING FAN ON
     05 00355  02      A
     05 00356  EA08    A
     05 00358  F608    A
668  05 0035A  AF      A          CTIMR     PR@C00L                   CLEAR C00LING FAN TIMER
     05 0035B  3232FA  N
669  05 0035E  CD0000  N          C0BIT,S   NPF0$ON                   TURN OFF PF0 (INVERTED DRIVER)
     05 00361  E47F    A
670  05 00363  3A20F4  A          IF1       FLG,ADH@SELC,T
     05 00366  07      A
     05 00367  D27003  N
671  05 0036A  CD0000  N              CALL      ADH@M0TN
672  05 0036D  C37503  N          ELSE:
673  05 00370  3E80    A              SFLG      ADH@WTEN
     05 00372  320CF4  A
674                               ENDIF
675  05 00375  CD0000  N          CALL      TRN@00D
676  05 00378  CD0000  N          CALL      PAP@SIZE                  CHK PAPER WIDTH FOR FUSER   (1)
677  05 0037B  CD0000  N          CALL      EDGE@FA                   CHK WHICH EDGE FADE OUT     (2)
678  05 0037E  CD0000  N          CALL      PAP@PRL3
679  05 00381  CD0000  N          CALL      PR0G@UP                   PROG INITIALIZATION SUBR
680  05 00384  CD0000  N          CALL      PR0G@UP1
681  05 00387  CD0000  N          CALL      FDR@PRT                   CHECK FEEDER SELECTION
682  05 0038A  CD0000  N          CALL      BLG@BKPT                  READ BILLING BREAK-POINTS
683  05 0038D  CD0000  N          CALL      D00ELV                    CAUSE ELV TO EXECUTE
684  05 00390  3A54F4  A          IF1       FLG,SRT@SEL,T             IS SORTER BEING USED
     05 00393  07      A
     05 00394  D29F03  N
685  05 00397  CD0000  N              CALL      SRT@INIT              INITIALIZE SORTER JAM DETECT
686                                   MVI       A,MSK(NVBIT,NV@FJAM,  SETS ALL 4 JAM CONDITIONS
687  05 0039A  3E0F    A                         NV@IMED,NV@L0W@J,NV@UP@J)
688  05 0039C  C3A403  N          ELSE:
689  05 0039F  3AC9E2  A              RNVNIB    NV@JAM@N              READ SAVED PREVIOUS SRT JAMS
690                                   M0DBYT    A,OR,MSK(NVBIT,       & SET IMED ON & FDR JAM
691  05 003A2  F603    A                         NV@FJAM,NV@IMED)
692                               ENDIF
693  05 003A4  32C9E2  A          WNVNIB    NV@JAM@N                  STORE IN CASE OF PWR DN
694                               ID:ALTR   NV@FJAM,NV@IMED,NV@L0W@J,  SEE ABOVE IF:/ELSE:
695                                         NV@UP@J
696  05 003A7  CDA901  N          CALL      SB:PNTRS                  SYNC BKG PNTRS TO NEW STATE
697  05 003AA  C9      A          RET

699                          *   CALLS FOR PRINT 10 MS SYN BACKGROUND

701  05 003AB  CD0000  N  PRNT10  CALL      ADH@CTPL
702  05 003AE  CDC004  N          CALL      PRT!IMD
703  05 003B1  C9      A          RET

705                          *   CALLS FOR PRINT 20 MS SYN BACKGROUND

707  05 003B2  0000    N  PRNT20  DW        PRT@SWS
708  05 003B4  0000    N          DW        TON@DIS
709  05 003B6  0000    N          DW        PAP@TGL3
710  05 003B8  0000    N          DW        LMP@CTPL
711  05 003BA  0000    N          DW        FDR@BKFD
712  05 003BC  0000    N          DW        SORTER@
713  05 003BE  0000    N          DW        FLV@PRNT
714  05 003C0  0000    N          DW        S0S@JMDT
715  05 003C2  0000    N          DW        DSPL@CTL
```

```
716   05 003C4   0000    N            DW        INSTRU
717   05 003C6   FFFF    A            DW        X'FFFF'                    END OF TABLE

719                            *      CALLS FOR PRINT 100 MS SYN BACKGROUND

721   05 003C8   0000    N   PRNT100  DW        RILK@CK
722   05 003CA   0000    N            DW        2SD@RUN
723   05 003CC   0000    N            DW        LITE@OFF
724   05 003CE   0000    N            DW        XMM@PRNT
725   05 003D0   0000    N            DW        FUS@RDUT
726   05 003D2   0000    N            DW        READY@CK
727   05 003D4   0000    N            DW        JAM@RST
728   05 003D6   0000    N            DW        MINIPHS8
729   05 003D8   4F06    N            DW        SMPL@CPY
730   05 003DA   0000    N            DW        RXCYCLDN                   STUB IN US IMG
731   05 003DC   0000    N            DW        KEY@CNTR
732   05 003DE   0000    N            DW        TST@LP4
733   05 003E0   2C04    N            DW        PRT:CHG                    TEST IF OK TO
                                                                                   LEAVE PRINT
734   05 003F2   FF01    N            DW        STAT:CHG
735   05 003E4   FFFF    A            DW        X'FFFF'                    END OF TABLE
737                            *      EPILOG

739   05 003E6   CD0000  N   PRNT:EPL CALL      AX@EPTY                    (1)
740   05 003E9   CD0000  N            CALL      FDM@EPL3                   (2)
741   05 003EC   CD0000  N            CALL      FDA@EPL3                   (3)
742   05 003EF   CD0000  N            CALL      TRN@EPL3
743   05 003F2   CD0000  N            CALL      DVL@NRDY
744                                   COBIT,S   FUS$CAPL,FUS$LOAD,ILLM$SPL,)
745   05 003F5   CD0000  N                      EF0$11,EF0$12$5,SMPL$CPY,READY$
      05 003F8   07      A
      05 003F9   E6F7    A
      05 003FB   EDFD    A
      05 003FD   F2F7    A
      05 003FF   ECF7    A
      05 00401   EBF7    A
      05 00403   E2FE    A
      05 00405   E7FE    A
746   05 00407   CD0000  N            SOBIT,S   NPF0$ON                   TURN OFF PF0 (INVERTED DRIVER)
      05 0040A   E480    A
747   05 0040C   AF      A            CFLG      ELV@AUTO                   DISABLE AUTO-TRAY SWITCHING
      05 0040D   3222F4  A
748   05 00410   CD0000  N            CALL      PAP@EPL3
749   05 00413   CD1704  N            CALL      ABORT
750   05 00416   C9      A            RET

752                            *
753                            *      SUBROUTINE
754                            *

756   05 00417   F3      A   ABORT    DI                                   TURN OFF INTERRUPT SYSTEM
757   05 00418   AF      A            CFLG      TBLD@FIN                   SIGNAL NEW PITCH TABLE REQ'D
      05 00419   325DF4  A
758   05 0041C   211907  N            LXI       H,EV@STBY:                 ADDR OF STBY EVENT TABLE
759   05 0041F   2264FD  N            SHLD      EV@PTR:                    SAVE FOR MACH CLK ROUTINE
760   05 00422   CD0000  N            COBIT,S   BTR$LOAD,PRNT$RLY          UN-LOAD BTR & DROP PRINT RELAY
      05 00425   02      A
      05 00426   E17F    A
      05 00428   EAF7    A
```

```
761   05 0042A   FB       A          EI
762   05 0042B   C9       A          RET
764   05 0042C   3A66FD   N  PRT!CHG IF!      XBYT,CYCUPCT!,EQ,2          CHECK FOR PROLOG 2 OR CYCLE OUT
      05 0042F   FEC2     A
      05 00431   C23C04   N
765   05 00434   3E80     A              SFLG     PRT@PRO2               YES, SET 'PRINT PROLOG 2' FLAG
      05 00436   3271F4   A
766   05 00439   C37004   N          ORIF!    XBYT,A,EQ,3                NO, IS CYCLE UP CNTR=3
      05 0043C   FEC3     A
      05 0043E   C27004   N
767   05 00441   3A71F4   A          ANDIF!   FLG,PRT@PRO2,T             YES, AND IS PROLOG 2 FLAG SET
      05 00444   07       A
      05 00445   D27004   N
768   05 00448   AF       A              CFLG     PRT@PRO2               YES, DO PROLOG 2 AND CLR FLAG
      05 00449   3271F4   A
769                          *
770                          *        PRINT STATE BACKGROUND- PROLOG 2
771                          *
772   05 0044C   CD0000   N              CALL     PAP@PRL2               RETN XPORT OFF IF NOT SIDE 1
773   05 0044F   CD0000   N              CALL     PROG@UP2
774   05 00452   3AADF4   A              IF!      FLG,IMGMADE!,T         HAS 1ST IMAGE BEEN MADE
      05 00455   07       A
      05 00456   D25C04   N
775   05 00459   CD0000   N                 CALL     PROG@UP              YES, CALL PROG INITIALIZATION
776                                    ENDIF
777   05 0045C   3A57FA   N              IF!      VBYT,MINIBYTE,NZ       IS MINI-PHYSICAL ACTIVE
      05 0045F   A7       A
      05 00460   CA7004   N
778   05 00463   AF       A                 CFLG     DSPL@1ST             YES, ENABLE DISPLAY UPDATE
      05 00464   329AF4   A
779   05 00467   3C       A                 INR      A                    DISPLAY QUANTITY
780   05 00468   3250FA   N                 STA      DSPL@ST1              COMPLETE
781   05 0046B   3EC6     A                 MVI      A,6                  SET DOCUMENT TOTAL TO
782   05 0046D   326FFA   N                 STA      DOC@TOTL              6 FOR ADH DOCUMENT CHECK
783                                    ENDIF
784                                 ENDIF

786                          *        END PROLOG2

788                          *
789                          *        BUILD FLAG BYTE
790                          *
791   05 00470   0608     A          MVI      B,8                      NUMBER OF FLAGS REQ'D
792   05 00472   AF       A          XRA      A                        CLEAR A-REG
793   05 00473   57       A          MOV      D,A                      CLEAR D-REG
794   05 00474   21A9F4   A          LXI      H,ADR(FLG,IMED@DN!)      STARTING ADDR OF PRT!CHG FLAGS
795                                  REPEAT
796   05 00477   7E       A              MOV      A,M                  LOAD A W/CONTENTS OF FLAG ADDR
797   05 00478   07       A              RLC                           ROTATE FLAG(D7) INTO CARRY
798   05 00479   7A       A              MOV      A,D                  LOAD A W/FLAGS BILT INTO BYTE
799   05 0047A   17       A              RAL                           PUT FLAG IN DO & SHIFT LEFT
800   05 0047B   57       A              MOV      D,A                  SAVE RESULT IN D-REG
801   05 0047C   23       A              INX      H                    STEP TO NEXT FLAG
802   05 0047D   05       A              DCR      B                    DECR NUMBER OF FLAGS REQ'D
803   05 0047E   C27704   N          UNTIL!   CC,Z,S                   LOOP UNTIL ALL FLAGS IN BYTE
804                                  ID!READ  IMED@DN!,CYCL@DN!,NORM@DN!,)  FLAGS READ
805                                           QWIK!OUT,IMGMADE!,SD1@TIMO,)
806                                           SD1@DLY,ADH@SELC
```

```
808                                 *       TEST FOR STATE CHANGE TO IRUNN
809                                 *
810   05 00481   3A67FD   N                 LDA       NOIMGCT:                    MOV CURRENT NO IMAGE COUNTER
811   05 00484   5F       A                 MOV       E,A                         TO THE E-REG
812   05 00485   060E     A                 MVI       B,14                        LOOP CNTR FOR STATE CHG TESTS
813   05 00487   21E104   N                 LXI       H,CYC:OUT                   TABLE ADDR OF PRT:CHG TESTS
814                                         REPEAT
815   05 0048A   7A       A                     MOV       A,D                     MOV FLAG BYTE TO THE A-REG
816   05 0048B   A6       A                     MODBYT    A,AND,M                 MASK FOR DESIRED FLAGS
817   05 0048C   23       A                     INX       H                       STEP TO STATUS TEST
818   05 0048D   AE       A                     MODBYT    A,XOR,M                 TEST FLAG STATUS
819   05 0048E   C29F04   N                     IF:       CC,Z,S                  DID TEST PASS
820   05 00491   23       A                         INX       H                   YES, STEP TO NOIMGCT: TEST
821   05 00492   7B       A                         IF:       XBYT,E,GE,M         IS NOIMGCT: AT CORRECT VALUE
      05 00493   BE       A
      05 00494   DA9E04   N
822   05 00497   3E05     A                             MVI       A,:RUNN         YES, CHANGE STATE
823   05 00499   3253FD   N                             STA       STATE:           TO RUN NOT PRINT
824   05 0049C   0601     A                             MVI       B,1             FORCE END OF TESTS (EARLY OUT)
825                                                 ENDIF
826   05 0049E   2B       A                         DCX       H                   ADJ PNTR BACK TO NO IMG TEST
827                                             ENDIF
828   05 0049F   23       A                     INX       H                       STEP OVER NO IMG TEST
829   05 004A0   23       A                     INX       H                       STEP TO MASK FOR NEXT TEST
830   05 004A1   05       A                     DCR       B                       DECR LOOP COUNTER
831   05 004A2   C28A04   N                 UNTIL:    CC,Z,S                      ALL TESTS COMPLETE OR STATE CHG
832                                 *
833   05 004A5   7A       A                 MOV       A,D                         MOV FLAG BYTE TO A-REG
834   05 004A6   E662     A                 MODBYT    A,AND,D61D51D1              MASK AND TEST FOR FLAGS TRUE
835                                         ID:READ   NORMODN:,CYCLODN:,SD1ODLY   FROM ABOVE BYTE BUILD
836   05 004A8   CABF04   N                 IF:       CC,Z,C                      ARE ANY FLAGS TRUE
837   05 004AB   2166FD   A                     LXI       H,ADR(DATA,CYCUPCT:)    PREPARE TO TEST OR MODIFY
838   05 004AE   7E       A                     IF:       XBYT,M,GF,3             HAS PROG PUSHED IT TO 0
      05 004AF   FE03     A
      05 004B1   DAB604   N
839                                             ID:READ   CYCUPCT:
840   05 004B4   3602     A                     MVI       M,2                     NO, FORCE CYCLE-UP MODE AGAIN
841                                             ID:ALTR   CYCUPCT:
842                                         ENDIF
843   05 004B6   CD0000   N                     COBIT,S   ILLM$SPL                ILLM SPL OFF DURING DEAD CYCLE
      05 004B9   F2F7     A
844   05 004BB   AF       A                     CFLG      SMPLOFLG                CANCEL SAMPLE COPY SEQUENCE
      05 004BC   324CF4   A
845                                         ENDIF
846   05 004BF   C9       A                 RET


848                                 PRT:IMD IF:       FLGS,IMEDODN:,AND,:         IS IMEDIATE DOWN REQUESTED
849   05 004C0   3AA9F4   A                             TBLOSFIN,T                   AND HAS PROB BEEN DETECTED
      05 004C3   215DF4   A
      05 004C6   A6       A
      05 004C7   F2D004   N
850   05 004CA   CD1704   N                     CALL      ABORT
851   05 004CD   C3E004   N                 ORIF:     FLG,TIMEDDN:,T              IF TIMED DWN REQ'D DROP OUT
      05 004D0   3AA7F4   A
      05 004D3   07       A
```

```
     05 004D4   D2F004   N
852  05 004D7   21E1FF   A              C0BIT    BTP*LOAD                BIAS TRANS ROLL (ASAP)
     05 004DA   3E7F     A
     05 004DC   F3       A
     05 004DD   A6       A
     05 004DE   77       A
     05 004DF   FB       A
853                               ENDIF
854  05 004E0   C9       A        RET
856                         *
857                         *                                          D7 6 5 4 3 2 1 0 (X=DON'T CARE)
858                         *
859                         *          TABLE OF FLAG STATUS TESTS      I C N O I S S A   N C
860                         *           AND NO IMAGE COUNTER VALUES    M Y O W M D D D   O O
861                         *           USED TO DETERMINE IF STATE     E C R I G 1 1 H     U      T N
862                         *           SHOULD CHANGE FROM PRINT TO    D L M K M O O S   I N     E U
863                         *           RUN NOT PRINT                  O O O : A T T E   M T     S M
864                         *                                          D O D O D I L S   A E     T B
865                         *                                          N N : U E M Y L   O R       E
866                         *                                          : : : T : O   C   E         R
867                         *
868  05 004E1   48       A   CYC:OUT  DB       D6|D3                   X 1 X X 0 X X X   00      1
869  05 004E2   40       A            DB       D6
870  05 004E3   00       A            DB       0
871  05 004E4   5C       A            DB       D6|D4|D3|D2             X 1 X 0 1 1 X X   16      2
872  05 004E5   4C       A            DB       D6|D3|D2
873  05 004E6   10       A            DB       16
874  05 004E7   5C       A            DB       D6|D4|D3|D2             X 1 X 0 1 0 X X   11      3
875  05 004E8   48       A            DB       D6|D3
876  05 004E9   0B       A            DB       11
877  05 004EA   68       A            DB       D6|D5|D3                X 0 1 X 0 X X X   00      4
878  05 004EB   20       A            DB       D5
879  05 004EC   00       A            DB       0
880  05 004ED   75       A            DB       D6|D5|D4|D2|D0          X 0 0 0 X 1 X 0   36      5
881  05 004EE   04       A            DB       D2
882  05 004EF   24       A            DB       36
883  05 004F0   75       A            DB       D6|D5|D4|D2|D0          X 0 0 0 X 1 X 1   20      6
884  05 004F1   05       A            DB       D2|D0
885  05 004F2   14       A            DB       20
886  05 004F3   7D       A            DB       D6|D5|D4|D3|D2|D0       X 0 1 0 1 1 X 0   36      7
887  05 004F4   2C       A            DB       D5|D3|D2
888  05 004F5   24       A            DB       36
889  05 004F6   7D       A            DB       D6|D5|D4|D3|D2|D0       X 0 1 0 1 1 X 1   20      8
890  05 004F7   2D       A            DB       D5|D3|D2|D0
891  05 004F8   14       A            DB       20
892  05 004F9   75       A            DB       D6|D5|D4|D2|D0          X 0 0 0 X 0 X 0   21      9
893  05 004FA   00       A            DB       0
894  05 004FB   15       A            DB       21
895  05 004FC   7D       A            DB       D6|D5|D4|D3|D2|D0       X 0 1 0 1 0 X 0   21     10
896  05 004FD   28       A            DB       D5|D3
897  05 004FE   15       A            DB       21
898  05 004FF   75       A            DB       D6|D5|D4|D2|D0          X 0 0 0 X 0 X 1   13     11
899  05 00500   01       A            DB       D0
900  05 00501   0D       A            DB       13
901  05 00502   7D       A            DB       D6|D5|D4|D3|D2|D0       X 0 1 0 1 0 X 1   13     12
902  05 00503   29       A            DB       D5|D3|D0
903  05 00504   0D       A            DB       13
904  05 00505   10       A            DB       D4                      X X X 1 X X X X   11     13
```

```
905   05 00506   10       A            DB        D4
906   05 00507   0B       A            DB        11
907   05 00508   80       A            DB        D7                          1 X X X X X X X   00    14
908   05 00509   80       A            DB        D7
909   05 0050A   00       A            DB        0
912                                *NAR
913                                *
914                                *    R U N    N O T    P R I N T    S T A T E
915                                *
916                                *    RUN NOT PRINT- EXECUTES WHILE MACHINE IS COMPLETING A COPY RUN.
917                                *    ENTERED FROM 'PRINT' AND EXITS TO 'NOT READY'.

919                                *    PROLOG

921   05 0050B   CD0000   N   RUNN:PRL CALL      DO@ELV                      CAUSE ELV TO EXECUTE
922   05 0050E   CD0000   N            STIMR     RUNN:TMR,2500,RUNN@CHG      STAY IN RUNN 2.5 SEC
      05 00511   2F       A
      05 00512   FA       A
      05 00513   7505     N
923   05 00515   CDA901   N            CALL      SB:PNTRS                    SYNC BKG PNTRS TO NEW STATE
924   05 00518   C9       A            RET

926                                *    CALLS FOR RUN NOT PRINT 10 MS SYN BACKGROUND

928   05 00519   CD0000   N   RUNN10   CALL      ADH@CTRL
929   05 0051C   C9       A            RET

931                                *    CALLS FOR RUN NOT PRINT 20 MS SYN BACKGROUND

933   05 0051D   0000     N   RUNN20   DW        RUNN@SWS
934   05 0051F   0000     N            DW        SORTER$
935   05 00521   0000     N            DW        SOS@JMOT
936   05 00523   0000     N            DW        FLV@PRNT
937   05 00525   0000     N            DW        LMP@CTRL
938   05 00527   0000     N            DW        PAP@TGL4
939   05 00529   0000     N            DW        DSPL@CTL
940   05 0052B   0000     N            DW        INSTRU
941   05 0052D   FFFF     A            DW        X'FFFF'                     END OF TABLE

943                                *    CALLS FOR RUN NOT PRINT 100 MS SYN BACKGROUND

945   05 0052F   0000     N   RUNN100  DW        JAM@RST
946   05 00531   0000     N            DW        RILK@CK
947   05 00533   0000     N            DW        FUS@RDUT
948   05 00535   0000     N            DW        2SD@RUN
949   05 00537   0000     N            DW        XMM@PRNT
950   05 00539   0000     N            DW        LITE@OFF
951   05 0053B   0000     N            DW        TST@LP4
952   05 0053D   FF01     N            DW        STAT:CHG                    TEST IF OK TO LEAVE RUN NOT PRT
953   05 0053F   FFFF     A            DW        X'FFFF'                     END OF TABLE

955   05 00541   CD0000   N   RUNN:EPL CALL      DEL@CK                      CALC COPIES DELIVERED
956   05 00544   CD0000   N            CALL      PAP@EPL4                    'RUNNPRT' PAPER PATH MOP UP SUB
957   05 00547   CD0000   N            CALL      MOT@OFF                     TURN OFF SORTER MOTORS
958   05 0054A   CD0000   N            CALL      DO@ELV                      CAUSE FLV TO EXECUTE
959   05 0054D   AF       A            CFLG      AXFD@FLT                    RESET FOR USE DURING NEXT RUN
      05 0054E   323FF4   A
960   05 00551   2123FC   A            CFBIT,P   TF@XMMO                     STOP BLINKING OF XMM 'OTHER'
      05 00554   3EFE     A
```

```
     05 00556   A6       A
     05 00557   77       A
961  05 00558   CD0000   N          COBIT,S   SOS$SMPL
     05 0055B   ECFD     A
962  05 0055D   CD7B05   N          CALL      NV@JAM
963  05 00560   CD0000   N          CALL      RCP@STRE                    STORE RECAP DATA IN RAM
964  05 00563   CD0000   N          CALL      ADH@MOTF
965  05 00566   3E08     A          MVI       A,8
966  05 00568   3285FA   N          STA       COOLCNT                     SET COUNTER FOR 7 TIMEOUTS
967  05 0056B   CD0000   N          CALL      PR@FAN
968  05 0056E   CD0000   N          CALL      FLT@EPL5                    (1)
969  05 00571   CD0000   N          CALL      HIST@FLE                    (2) LOG HISTORY DATA FOR RUN
970  05 00574   C9       A          RET                                   (3)

972  05 00575   2153FD   N  RUNN@CHG LXI      H,STATE!                    SET H&L TO ADDR OF STATE!
973  05 00578   3602     A          MVI       M,:NRDY                     CHANGE STATE! TO NOT READY
974                                 ID:ALTR   STATE!
975  05 0057A   C9       A          RET
977  05 0057B   3A66F4   A  NV@JAM  RFLG      UP@JAM                      LOAD A WITH SRT UPPER JAM FLAG
     05 0057E   07       A
978                                *                                      & SAVE IT IN THE CARRY BIT
979  05 0057F   3A36F4   A          LDAFLG    LOW@JAM                     LOAD A WITH SRT LOWER JAM FLAG
980  05 00582   17       A          RAL                                   & MOVE CARRY &
981  05 00583   17       A          RAL                                   LOW@JAM INTO THEIR POSITIONS
982  05 00584   07       A          RLC
983  05 00585   07       A          RLC
984                                 MODBYT    A,AND,MSK(NVBIT,)           MASK FOR DESIRED BITS
985  05 00586   E60C     A                    NV@LOW@J,NV@UP@J)
986  05 00588   47       A          MOV       B,A                         & SAVE IT IN THE B-REG
987  05 00589   3AA9F4   A          IF!       FLG,IMED@DN!,T              WAS THERE AN IMED ON CONDITION
     05 0058C   07       A
     05 0058D   D29605   N
988  05 00590   78       A              MOV       A,B                     YES,RESTORE A-REG
989                                    MODBYT    A,OR,MSK(NVBIT,NV@FJAM,)  & SET NV JAM BITS
990  05 00591   F603     A                        NV@IMED)
991  05 00593   C3A105   N          ELSE!
992  05 00596   3A3CFD   A              IF!       FBITS,FDR@AJAM,OR,FDR@MJAM,T IS EITHER JAM CONDITION TRUE
     05 00599   E60C     A
     05 0059B   CA9F05   N
993  05 0059E   37       A                  STC                           YES,SET CARRY
994                                    ENDIF
995  05 0059F   17       A              RAL                               ROTATE INTO DO
996  05 005A0   B0       A              MODBYT    A,OR,B                  'OR' IN SRT JAM BITS
997                                 ENDIF
998  05 005A1   32C9E2   A          WNVNIB    NV@JAM@N
999                                 ID:ALTR   NV@FJAM,NV@IMED,NV@LOW@J,NV@UP@J
1000 05 005A4   C9       A          RET                                   RETURN TO STATE CHECKER
1002                               *NAR
1003                               *
1004                               *        T E C H    R E P    S T A T E
1005                               *
1006                               *        THE TECH REP STATE IS ENTERED WHEN THE SERVICE KEY IS ON IN
1007                               *        'NOT READY' & 'READY' STATES. THIS ALLOWS THE TECH REP TO PERFORM SUCH
1008                               *        TASKS AS ACCESS NON-VOLATILE MEMORY & COMPONENT CONTROL.

1010                               *
1011                               *        PROLOG
1012                               *
```

```
05 005A5   CD0000   N   TREP:PRL CØBIT,S   WAIT$                      INSURE WAIT ØFF AT TREP ENTRANC
05 005A8   E9FE     A
05 005AA   CD0000   N            CALL      DGNØPRL                    DIAGNØSTIC PRØLØG
05 005AD   CDA901   N            CALL      SB:PNTRS                   SYNC BKG PNTRS TØ NEW STATE
05 005BØ   C9       A            RET

                                 *         CALLS FØR TECH REP 10MS SYN BACKGRØUND

05 005B1   CD0000   N   TREP10   CALL      ADHØCTRL
05 005B4   C9       A            RET

                                 *         CALLS FØR TECH REP 20MS SYN BACKGRØUND

05 005B5   0000     N   TREP20   DW        TREPØSWS
05 005B7   0000     N            DW        MNØELVØS
05 005B9   0000     N            DW        LMPØCTRL
05 005BB   0000     N            DW        DSPLØCTL
05 005BD   0000     N            DW        DGNØBKG
05 005BF   0000     N            DW        INSTRU
05 005C1   FFFF     A            DW        X'FFFF'                    END ØF TABLE

                                 *         CALLS FØR TECH REP 100MS SYN BACKGRØUND

05 005C3   0000     N   TREP100  DW        NRILKØCK
05 005C5   0000     N            DW        ØSDØSTBY
05 005C7   0000     N            DW        XMHØSTBY
05 005C9   0000     N            DW        REDØBGND
05 005CB   0000     N            DW        BINØCHK
05 005CD   0000     N            DW        JAMØRST
05 005CF   0000     N            DW        DVLØDUMP
05 005D1   0000     N            DW        FUSØRDUT
05 005D3   0000     N            DW        TSTØLP4
05 005D5   DF05     N            DW        TREP:CHG                   TEST IF ØK TØ
05 005D7   FF01     N            DW        STAT:CHG                              LEAVE TREP REP
05 005D9   FFFF     A            DW        X'FFFF'                    END ØF TABLE

                                 *
                                 *         EPILØG  (TECH REP STATE)
                                 *
05 005DB   CD0000   N   TREP:EPL CALL      DGNØEPL                    DIAGNØSTIC EPILØG
05 005DE   C9       A            RET

                                 *         CHANGE ØF STATE CHECK

05 005DF   2153FD   A   TREP:CHG LXI       H,ADR(DATA,STATE:)         PREPARE FØR PØSSIBLE STATE CHG
05 005E2   7E       A            IF:       XBYT,M,NE,:CØMP            DØ NØT CHG STATE IF IN CØMP
05 005E3   FEØØ     A
05 005E5   CAFEØ5   N                 IF:       FLG,SERØACT,T          IF SERVICE KEY IS ØN AND IF
05 005E8   3A49F4   A
05 005EB   07       A
05 005EC   D2FCØ5   N                 ANDIF:    FBIT,DGNØPRTØ,F         IN DIAG PRINT PRØGRAM
05 005EF   3A2ØFC   A
05 005F2   E6Ø2     A
05 005F4   C2FCØ5   N                     MVI       M,:TREP            CHG TØ TREP STATE
05 005F7   36Ø1     A                 ELSE:                            IF KEY IS TURNED ØFF
05 005F9   C3FEØ5   N                     MVI       M,:NRDY            CHG TØ NØT READY STATE
05 005FC   36Ø2     A                 ENDIF
```

```
1065                                        ID:ALTR   STATE:
1066                                    ENDIF
1067   05 005FE    C9        A            RET
```

TABLE II

```
 96                                 *    FIXED PITCH EVENT TABLE
 97                                 *
 98                                 *    EVENTS MUST BE IN SEQUENTIAL ORDER STARTING
 99                                 *    WITH THE EVENT CLOSES TO PITCH RESET FIRST
100                                 *
101                                 *    THERE CAN BE NO MORE THAN 256 COUNTS BETWEEN EVENTS
102                                 *
103                                 *    FORMAT OF EVENTS FOR EVENT TABLE
104                                 *
105                                 *    EVENT     X,Y,Z
106                                 *    WHERE:
107                                 *    X = ABSOLUTE COUNTS FROM RESET
108                                 *    Y = SHIFT REGISTER NEEDED IN EVENT
109                                 *    Z = EVENT NAME
110                                 *
111                                 *
112                                 *    PITCH EVENTS
113                                 *
114                                      TABLE
115   05 0001E    0200      A            EVENT     2,3,TRN2CURR
      05 00020    03        A
      05 00021    0000      N
116   05 00023    0300      A            EVENT     3,2,ADC@ACT
      05 00025    02        A
      05 00026    0000      N
117   05 00028    0400      A            EVENT     4,3,FDR5AFLT
      05 0002A    03        A
      05 0002B    0000      N
118   05 0002D    0700      A            EVENT     7,0,SPLYS@ON
      05 0002F    00        A
      05 00030    0000      N
119   05 00032    0800      A            EVENT     8,2,FDR1AXFD
      05 00034    02        A
      05 00035    0000      N
120   05 00037    0A00      A            EVENT     10,3,FUS@LOAD
      05 00039    03        A
      05 0003A    0000      N
121   05 0003C    3000      A            EVENT     48,8,DECG@INV          DECISION GATE FOR INVTD COPIES
      05 0003E    08        A
      05 0003F    0000      N
122   05 00041    3600      A            EVENT     54,5,FUS@NTLD          FUSER LOADED TEST
      05 00043    05        A
      05 00044    0000      N
123   05 00046    5500      A            EVENT     85,3,FDR6MFLT
      05 00048    03        A
```

| | | | | | | |
|---|---|---|---|---|---|---|
| | 05 00049 | 0000 | N | | | |
| 124 | 05 0004B | 5900 | A | EVENT | 89,2,FDR2MNFD | |
| | 05 0004D | 02 | A | | | |
| | 05 0004E | 0000 | N | | | |
| 125 | 05 00050 | 5D00 | A | EVENT | 93,8,JAM6@N0N | PAPER PATH JAM SW PITCH EVENT |
| | 05 00052 | 08 | A | | | |
| | 05 00053 | 0000 | N | | | |
| 126 | 05 00055 | 7600 | A | EVENT | 118,9,JAM5@INV | PAPER PATH JAM SW PITCH EVENT |
| | 05 00057 | 09 | A | | | |
| | 05 00058 | 0000 | N | | | |
| 127 | 05 0005A | 7800 | A | EVENT | 120,0,FSH@0FF | |
| | 05 0005C | 00 | A | | | |
| | 05 0005D | 0000 | N | | | |
| 128 | 05 0005F | 8700 | A | EVENT | 135,0,PR0G@HST | PR0G HISTORY FILE UPDATE |
| | 05 00061 | 00 | A | | | |
| | 05 00062 | 0000 | N | | | |
| 129 | 05 00064 | 8F00 | A | EVENT | 143,6,JAM4@CHK | PAPER PATH JAM SW PITCH EVENT |
| | 05 00066 | 06 | A | | | |
| | 05 00067 | 0000 | N | | | |
| 130 | 05 00069 | AA00 | A | EVENT | 170,10,RET2@CHK | PAPER PATH JAM SW PITCH EVENT |
| | 05 0006B | 0A | A | | | |
| | 05 0006C | 0000 | N | | | |
| 131 | 05 0006E | CF00 | A | EVENT | 207,3,S0S@CLN | |
| | 05 00070 | 03 | A | | | |
| | 05 00071 | 0000 | N | | | |
| 132 | 05 00073 | D100 | A | EVENT | 209,2,TRN5CURR | |
| | 05 00075 | 02 | A | | | |
| | 05 00076 | 0000 | N | | | |
| 133 | 05 00078 | E300 | A | EVENT | 227,5,JAM3@CHK | PAPER PATH JAM SW PITCH EVENT |
| | 05 0007A | 05 | A | | | |
| | 05 0007B | 0000 | N | | | |
| 134 | 05 0007D | 0901 | A | EVENT | 265,2,FDR3AEDG | ENABLE AUX FDR WT SENSOR |
| | 05 0007F | 02 | A | | | |
| | 05 00080 | 0000 | N | | | |
| 135 | 05 00082 | 0B01 | A | EVENT | 267,4,JAM2@CHK | PAPER PATH JAM SW PITCH EVENT |
| | 05 00084 | 04 | A | | | |
| | 05 00085 | 0000 | N | | | |
| 136 | 05 00087 | 0E01 | A | EVENT | 270,8,RET1@CHK | PAPER PATH JAM SW PITCH EVENT |
| | 05 00089 | 08 | A | | | |
| | 05 0008A | 0000 | N | | | |
| 137 | 05 0008C | 6901 | A | EVENT | 361,3,TRN3DTCK | |
| | 05 0008E | 03 | A | | | |
| | 05 0008F | 0000 | N | | | |
| 138 | 05 00091 | 6C01 | A | EVENT | 364,2,FDR4MEDG | ENABLE MAIN WT SENSOR |
| | 05 00093 | 02 | A | | | |
| | 05 00094 | 0000 | N | | | |
| 139 | 05 00096 | B901 | A | EVENT | 441,9,JAM6@INV | PAPER PATH JAM SW PITCH EVENT |
| | 05 00098 | 09 | A | | | |
| | 05 00099 | 0000 | N | | | |
| 140 | 05 0009B | C201 | A | EVENT | 450,4,FUS@UNLD | |
| | 05 0009D | 04 | A | | | |
| | 05 0009E | 0000 | N | | | |
| 141 | 05 000A0 | C301 | A | EVENT | 451,2,TRN1R0LL | |
| | 05 000A2 | 02 | A | | | |
| | 05 000A3 | 0000 | N | | | |
| 142 | 05 000A5 | F401 | A | EVENT | 500,0,DPM@SMPL | |
| | 05 000A7 | 00 | A | | | |
| | 05 000A8 | 0000 | N | | | |

```
143  05 000AA   0E02   A     EVENT    526,3,TRN4DTCK
     05 000AC   03     A
     05 000AD   0000   N
144  05 000AF   1B02   A     EVENT    539,0,DVLV@OFF          TURN OFF VAR DFNS DEVELOPERS
     05 000B1   00     A
     05 000B2   0000   N
145  05 000B4   5B02   A     EVENT    600,0,BIL@PLOP          TEST FOR PLATEN OPEN     (BLG)
     05 000B6   00     A
     05 000B7   0000   N
146  05 000B9   7602   A     EVENT    630,5,INVTRCTL          INVTR GATE & RETURN CONTROL
     05 000BB   05     A
     05 000BC   0000   N
147  05 000BE   8A02   A     EVENT    650,6,DECG@NON          DECISION GATE FOR NON-INVTD
     05 000C0   06     A
     05 000C1   0000   N
148  05 000C3   9A02   A     EVENT    666,0,JAM@DLY
     05 000C5   00     A
     05 000C6   0000   N
149  05 000C8   BC02   A     EVENT    700,7,JAM5@NON          PAPER PATH JAM SW PITCH EVENT
     05 000CA   07     A
     05 000CB   0000   N
150  05 000CD   2003   A     EVENT    800,0,PROGMODE
     05 000CF   00     A
     05 000D0   0000   N
151  05 000D2   2203   A     EVENT    802,0,FSH@ENB
     05 000D4   00     A
     05 000D5   0000   N
152  05 000D7   5003   A     EVENT    848,0,DVB@VAR           TURN ON VARIABLE-BIAS DEVELOPER
     05 000D9   00     A
     05 000DA   0000   N
153  05 000DC   5203   A     EVENT    850,4,SRSK@EV           INIT SRSK & SRT MOTOR
     05 000DE   04     A
     05 000DF   0000   N
154  05 000E1   5403   A     EVENT    852,0,PECOFFEV          TURN OFF POST EXP. COROTRON
     05 000E3   00     A
     05 000E4   0000   N
155  05 000E6   8C03   A     EVENT    908,0,PECONEV           TURN ON POST EXP COROTRON
     05 000E8   00     A
     05 000E9   0000   N
156  05 000EB   8EC3   A     EVENT    910,0,910@EV
     05 000ED   00     A
     05 000EE   0000   N
157  05 000F0   9003   A     EVENT    912,0,DGN&HCNT
     05 000F2   00     A
     05 000F3   0000   N
158  05 000F5   A703   A     EVENT    935,0,OVER@RUN
     05 000F7   00     A
     05 000F8   0000   N
159                          ENDTABLE
```

TABLE III

```
71                                  *
72                                  *        VARIABLE PITCH EVENT TABLE
73                                  *
74          00000001                FLSH@BSE EQU      1
75          00000019                F0@0NBSE EQU      25
76          00000064                F0@0FFBS EQU      100
77    05 00000     0100     A       R0M@FSH  DW       FLSH@BSE
78    05 00002     00       A                DB       0
79    05 00003     0000     N                DW       FSH@0N
80    05 00005     6400     A       R0M@0FF  DW       F0@0FFBS
81    05 00007     00       A                DB       0
82    05 00008     0000     N                DW       F0@0FF
83    05 0000A     1900     A       R0M@0N   DW       F0@0NBSE
84    05 0000C     00       A                DB       0
85    05 0000D     0000     N                DW       F0@0N
86    05 0000F     0100     A       R0M@FSHS DW       FLSH@BSE
87    05 00011     00       A                DB       0
88    05 00012     0000     N                DW       FSH@0N@S
89    05 00014     6400     A       R0M@0FFS DW       F0@0FFBS
90    05 00016     00       A                DB       0
91    05 00017     0000     N                DW       F0@0FF@S
92    05 00019     1900     A       R0M@0NS  DW       F0@0NBSE
93 •  05 0001B     00       A                DB       0
94    05 0001C     0000     N                DW       F0@0N@S
95                                  *
```

TABLE IV

```
161         00000396                BASE@CNT SET      918                    #CLK CNTS/PITCH
162         0000038E                SAFE@CNT SET      910                    MIN # CLK CNTS/PITCH
163                                 *
164                                 *        PITCH TABLE BUILDER
165                                 *
166                                 *        BUILD VARIABLE PITCH EVENT TABLE INTO RAM
167                                 *        FROM ROM DATA + REDUCTION ADJUST & F0 TRIM
168                                 *
169   05 000FA     2A0000   N       TBLD@PRT LHLD     R0M@FSH                H&L= BASE CNT OF FLASH
170   05 000FD     EB       A                XCHG                            D&E= BASE CNT OF FLASH
171   05 000FE     2A9AFC   N                LHLD     1FLSH@0N               H&L= RED ADJ
172   05 00101     19       A                DAD      D                      H&L= BASE + ADJ
173   05 00102     2244FC   N                SHLD     RAM@FSH                RAM@FSH = BASE + ADJ
174                                 *
175   05 00105     2A0500   N                LHLD     R0M@0FF                H&L= BASE CNT OF F0 OFF
176   05 00108     EB       A                XCHG                            D&E= BASE CNT OF F0 OFF
177   05 00109     2A9CFC   N                LHLD     1F0@0FF                H&L= RED ADJ + TRIM ADJ
178   05 0010C     19       A                DAD      D                      H&L= BASE + ADJ
179   05 0010D     2249FC   N                SHLD     RAM@0FF                RAM@0FF = BASE + ADJ
180                                 *
```

```
05 00110   2A0A00   N        LHLD    R0M@0N          H&L= BASE CNT OF F0 ON
05 00113   EB       A        XCHG                    D&E= BASE CNT OF F0 ON
05 00114   2A9EFC   N        LHLD    1F0@0N          H&L= RED ADJ + TRIM ADJ
05 00117   19       A        DAD     D               H&L= BASE + ADJ
05 00118   CDEA02   N        CALL    0N@M0D          CALL MOD ROUTINE TO MOD IF<0
05 00118   224EFC   N        SHLD    RAM@0N          RAM@0N = RESULTS OF ABOVE
                         *
05 0011E   3A31F4   A        IF:     FLG,IMG@SFT,T   IS THERE IMAGE SHIFT
05 00121   07       A
05 00122   D25601   N
05 00125   3E06     A            MVI     A,6         YES,# OF VAR EVENTS TO USE = 6
05 00127   47       A            MOV     B,A         SET UP B-REG FOR LOOP CONTROL
05 00128   3262FA   N            STA     TBLD@NUM    STORE # OF VAR EVENTS
05 0012B   3D       A            DCR     A           SET UP # OF TIMES TO GO
05 0012C   3263FA   N            STA     TBLD@TMP    THRU SORT
                         *
05 0012F   2A0F00   N            LHLD    R0M@FSHS    UPDATE R0M@FSHS TO
05 00132   EB       A            XCHG                INCLUDE RED MODE ADJ + SHIFT
05 00133   2AA0FC   N            LHLD    2FLSH@0N    ADJ AND SAVE FOR THE
05 00136   19       A            DAD     D           IMAGE SHIFT
05 00137   2253FC   N            SHLD    RAM@FSHS    FLASH EVENT
                         *
05 0013A   2A1400   N            LHLD    R0M@0FFS    UPDATE R0M@0FFS TO INCLUDE
05 0013D   EB       A            XCHG                RED MODE ADJ + TRIM ADJ +
05 0013E   2AA2FC   N            LHLD    2F0@0FF     SHIFT ADJ AND SAVE
05 00141   19       A            DAD     D           FOR THE IMAGE SHIFT
05 00142   2258FC   N            SHLD    RAM@0FFS    FADE OUT EVENT
                         *
05 00145   2A1900   N            LHLD    R0M@0NS     UPDATE R0M@0NS TO INCLUDE
05 00148   EB       A            XCHG                RED MODE ADJ + TRIM ADJ +
05 00149   2AA4FC   N            LHLD    2F0@0N      SHIFT ADJ
05 0014C   19       A            DAD     D
05 0014D   CDEA02   N            CALL    0N@MOD      CALL MOD ROUTINE TO MOD IF <0
05 00150   2250FC   N            SHLD    RAM@0NS     SAVE THE RESULTS
                         *
05 00153   C36001   N        ELSE:
05 00156   3E03     A            MVI     A,3         IF IMAGE SHIFT NOT SET
05 00158   47       A            MOV     B,A         #OF VAR EVENTS TO USE = 3
05 00159   3262FA   N            STA     TBLD@NUM    SET UP B-REG FOR LOOP CONTROL
05 0015C   3D       A            DCR     A           STORE # OF VAR EVENTS & SETUP
05 0015D   3263FA   N            STA     TBLD@TMP    #OF TIMES TO GO THRU SORT
                             ENDIF
                         *
```

TABLE V

```
                         *
                         *   SORTS VARIABLE RAM EVENT TABLE BY
                         *   ABS CLK COUNT & LOWEST ENDS IN EV@RAM
                         *
                         *   SORTS ONLY 1ST 3 IF NO IMAGE SHIFT, OTHERWISE SORTS ALL 6
                         *
05 0017E   2144FC   N        LXI     H,EV@RAM            H&L= ADDR OF TOP OF VAR RAM TBL
05 00181   3A63FA   N        WHILE:  XBYT,TBLD@TMP,NE,0  TIMES TO GO THRU OUTER LOOP
05 00184   FE00     A
05 00186   CAFD01   N
```

```
260   05 00189   3253FA   N     STA       IN@LP@CT                INTER LOOP CNT=OUTER LOOP CNT
261   05 0018C   3E80     A     SFLG      TBLD@1ST                SET 1ST FLAG FOR THIS POSITION
      05 0018E   325EF4   A
262   05 00191   2252FB   N     SHLD      FIX@ADDR                ADDR OF POSITION TO FULL
263   05 00194   B7       A     ORA       A                       CLEAR Z CONDITION BIT
264   05 00195   CAEF01   N     WHILE:    CC,Z,C
265   05 00198   5E       A         MOV       E,M                 E= LS PART OF ABS CLK COUNT
266   05 00199   23       A         INX       H
267   05 0019A   56       A         MOV       D,M                 D= MS PART OF ABS CLK COUNT
268   05 0019B   D5       A         PUSH      D                   STORE ABS CLK CNT OF FILL POS
269   05 0019C   3A5EF4   A         IF:       FLG,TBLD@1ST,T      IS IT 1ST TIME FOR THIS POS
      05 0019F   07       A
      05 001A0   D2AE01   N
270   05 001A3   AF       A             CFLG      TBLD@1ST        YES, CLEAR ITS FLAG
      05 001A4   325EF4   A
271   05 001A7   23       A             INX       H               AND INCREMENT
272   05 001A8   23       A             INX       H               POINTER TO LS PART OF
273   05 001A9   23       A             INX       H               ABS CLK COUNT OF NEXT
274   05 001AA   23       A             INX       H               EVENT
275   05 001AB   C3B601   N         ELSE:
276   05 001AE   2A5CFB   N             LHLD      VAR@ADDR        H&L= ADDR
277   05 001B1   23       A             INX       H               OF LS PART OF
278   05 001B2   23       A             INX       H               ABS CLK COUNT TO
279   05 001B3   23       A             INX       H               COMPARE TO FILL
280   05 001B4   23       A             INX       H               POSITION
281   05 001B5   23       A             INX       H
282                                 ENDIF
283   05 001B6   225CFB   N         SHLD      VAR@ADDR            STORE POINTER TO COMPARE EVENT
284   05 001B9   5E       A         MOV       E,M                 E= LS PART OF COMPARE ABS CLK
285   05 001BA   23       A         INX       H
286   05 001BB   56       A         MOV       D,M                 D= MS PART OF COMPARE ABS CLK
287   05 001BC   E1       A         POP       H                   H&L= ABS CLK COUNT OF FILL POS
288   05 001BD   EB       A         IF:       XWRD,D,LT,H         IS CLK OF COMPARE < FILL
      05 001BE   CD0000   N
      05 001C1   D2E501   N
289   05 001C4   2A5CFB   N             LHLD      VAR@ADDR        YES, SWITCH THE 2 EVENTS
290   05 001C7   EB       A             XCHG                      D&E= ADDR LOWER CLK VALUE
291   05 001C8   2A52FB   N             LHLD      FIX@ADDR        H&L= ADDR LARGER CLK VALUE
292   05 001CB   3EFB     A             MVI       A,-5            INITIALIZE LOOP COUNTER TO 5
293   05 001CD   3265FA   N             STA       TSW@NUM         WHICH = # OF ITEMS TO MOVE
294   05 001D0   B7       A             ORA       A               CLEAR Z CONDITION BIT
295   05 001D1   CAE501   N             WHILE:    CC,Z,C
296   05 001D4   1A       A                 LDAX      D           A= CONTAINS OF COMPARE EVENT
297   05 001D5   46       A                 MOV       B,M         B= CONTAINS OF FILL EVENT
298   05 001D6   77       A                 MOV       M,A         UPDATE FILL POS
299   05 001D7   78       A                 MOV       A,B         UPDATE COMPARE POS
300   05 001D8   12       A                 STAX      D           WITH NEW VALUE
301   05 001D9   13       A                 INX       D           MOVE POINTERS TO
302   05 001DA   23       A                 INX       H           NEXT ITEM
303   05 001DB   3A65FA   N                 LDA       TSW@NUM     INC MOVE
304   05 001DE   3C       A                 INR       A           LOOP CONTROL
305   05 001DF   3265FA   N                 STA       TSW@NUM     COUNTER
306   05 001E2   C3D101   N             ENDWHILE
307                                 ENDIF
308   05 001E5   2153FA   N         DECBYT    IN@LP@CT            DECRM INNER LOOP CNTR
      05 001E8   35       A
309   05 001E9   2A52FB   N         LHLD      FIX@ADDR            H&L= ADDR OF FILL POSITION
310   05 001EC   C39501   N     ENDWHILE
```

```
05 001EF   110500   A        LXI     D,5          MOVE H&L TO LOOK AT NEXT EVENT
05 001F2   19       A        DAD     D            POSITION TO FILL
05 001F3   3A63FA   N        LDA     TBLD@TMP     DECREMENT # OF EVENTS
05 001F6   3D       A        DCR     A            TO SORT
05 001F7   3263FA   N        STA     TBLD@TMP
05 001FA   C38101   N     ENDWHILE
```

TABLE VI

```
                         *
                         *     MOVE THE SR# & EVENT ADDR FROM ROM TABLE
                         *     TO RAM TABLE.  MOVES ONLY THE FIRST 3 IF
                         *     NO IMAGE SHIFT, OTHERWISE MOVES ALL 6
                         *
05 00160   1144FC   N        LXI     D,RAM@FSH    D&E = ADDR OF RAM TABLE
05 00163   210000   N        LXI     H,ROM@FSH    H&L = ADDR OF ROM TABLE
05 00166   B0       A        ORA     B            CLEAR Z CONDITION BIT
05 00167   CA7E01   N        WHILE:  CC,Z,C
05 0016A   23       A           INX     H         INCREMENT H&L AND D&E
05 0016B   23       A           INX     H         POINTERS OVER THE
05 0016C   13       A           INX     D         ABS CLK COUNT
05 0016D   13       A           INX     D
05 0016E   7E       A           MOV     A,M       LOAD A WITH SR#
05 0016F   12       A           STAX    D         STORE SR# IN RAM TABLE
05 00170   23       A           INX     H         MOVE POINTERS TO LS
05 00171   13       A           INX     D         ADDR OF EVENT
05 00172   7E       A           MOV     A,M       LOAD A WITH LS ADDR OF EVENT
05 00173   12       A           STAX    D         & STORE IT IN RAM TABLE
05 00174   23       A           INX     H         MOVE POINTERS TO MS
05 00175   13       A           INX     D         ADDR OF EVENT
05 00176   7E       A           MOV     A,M       MOVE MS ADDR OF EVENT
05 00177   12       A           STAX    D         TO RAM
05 00178   23       A           INX     H         MOVES POINTERS TO
05 00179   13       A           INX     D         LS PART OF ABS CLK COUNT
05 0017A   05       A           DCR     B         DECREMENT LOOP COUNTER
05 0017B   C36701   N        ENDWHILE
                         *
```

TABLE VII

```
                         *
                         *     MERGE VARIABLE PITCH EVENT TABLE & FIXED EVENT
                         *     TABLE CALCULATING THE REL DIFFERENCE WITH THE
                         *     RESULTS GOING INTO THE RUN EVENT TABLE
                         *
05 001FD   2A44FC   N        LHLD    EV@RAM       INITIALIZE VAR@CLK TO ABS CLK
05 00200   225EFB   N        SHLD    VAR@CLK      COUNT OF 1ST VAR PITCH EVENT
05 00203   2144FC   N        LXI     H,EV@RAM     INITIALIZE VAR@ADDR TO ADDR OF
05 00206   225CFB   N        SHLD    VAR@ADDR     1ST VAR PITCH EVENT
```

```
327  05 00209  211E00  N   LXI       H,EV@ROM                INITIALIZE FIX@ADDR TO ADDR OF
328  05 0020C  2252FB  N   SHLD      FIX@ADDR                1ST FIXED PITCH EVENT
329  05 0020F  3E80    A   SFLG      TBLD@1ST                NOTES 1ST EVENT TO RUN TABLE
     05 00211  325EF4  A
330  05 00214  3E2C    A   MVI       A,TABLENUM              INITIALIZE TSW@NUM TO # OF
331  05 00216  3265FA  N   STA       TSW@NUM                 EVENTS IN FIXED PITCH TABLE
332  05 00219  2A1E00  N   LHLD      EV@ROM                  INITIALIZE D&E WITH ABS CLOCK
333  05 0021C  EB      A   XCHG                              COUNT OF 1ST FIXED EVENT
334  05 0021D  AF      A   CFLG      VAR@DONE                FLAG DENOTES VAR EVENTS
     05 0021E  3259F4  A
335  05 00221  3A59F4  A   WHILE:    FLG,VAR@DONE,F          WHILE THERE ARE MORE VAR EVENTS
     05 00224  07      A
     05 00225  DA6F02  N
336  05 00228  2A5EFB  N       IF:       XWRD,VAR@CLK,LE,D   IS VAR CLK CNT <= FIXED CLK CNT
     05 0022B  CD0000  N
     05 0022E  DA3402  N
     05 00231  C25902  N
337  05 00234  2A5CFB  N           LHLD      VAR@ADDR        YES, H&L= VAR EVENT ADDR
338  05 00237  CD9302  N           CALL      TBLD@UPD        PLACE VAR EVENT AT END RUN TBL
339  05 0023A  3A62FA  N           LDA       TBLD@NUM        DECREMENT # OF
340  05 0023D  3D      A           DCR       A               VARIABLE EVENTS LEFT
341  05 0023E  3262FA  N           STA       TBLD@NUM        TO MERGE
342  05 00241  C24C02  N           IF:       CC,Z,S          DID TBLD@NUM GO TO 0
343  05 00244  3E80    A               SFLG      VAR@DONE    YES,DENOTE NO MORE VAR EVENTS
     05 00246  3259F4  A
344  05 00249  C35602  N           ELSE:
345  05 0024C  225CFB  N               SHLD      VAR@ADDR    STORE ADDR OF NEXT VAR EVENT
346  05 0024F  5E      A               MOV       E,M         UPDATE VAR@CLK TO
347  05 00250  23      A               INX       H           VALUE OF ABS CLK COUNT
348  05 00251  56      A               MOV       D,M         OF PRESENT VARIABLE
349  05 00252  EB      A               XCHG                  EVENT
350  05 00253  225EFB  N               SHLD      VAR@CLK
351                                   ENDIF
352  05 00256  C36602  N       ELSE:                         IF FIXED TABLE CLK COUNT IS
353  05 00259  2A52FB  N           LHLD      FIX@ADDR        LESS THEN VAR TABLE UPDATE THE
354  05 0025C  CD9302  N           CALL      TBLD@UPD        RUN TABLE WITH THAT EVENT
355  05 0025F  2252FB  N           SHLD      FIX@ADDR        UPDATE TO NEXT FIXED EVENT
356  05 00262  2165FA  N           LXI       H,TSW@NUM       DECREMENT # OF FIXED EVENTS
357  05 00265  35      A           DCR       M               LEFT
358                               ENDIF
359  05 00266  2A52FB  N       LHLD      FIX@ADDR
360  05 00269  5E      A       MOV       E,M                 UPDATE D&L TO =
361  05 0026A  23      A       INX       H                   ABS CLK CNT VALUE
362  05 0026B  56      A       MOV       D,M                 OF PRESENT FIXED TABLE
363  05 0026C  C32102  N   ENDWHILE
364  05 0026F  3EFF    A   MVI       A,X'FF'                 CLEAR Z CONDITION
365  05 00271  B7      A   ORA       A                       BIT FOR LOOP
366  05 00272  2A52FB  N   LHLD      FIX@ADDR                NO MORE VAR EVENTS, USE FIXED
367  05 00275  CA8402  N   WHILE:    CC,Z,C                  DONE WITH FIXED TABLE
368  05 00278  CD9302  N       CALL      TBLD@UPD            NO,UPDATE RUN TABLE
369  05 0027B  EB      A       XCHG                          SAVE H&L IN D&E
370  05 0027C  2165FA  N       LXI       H,TSW@NUM           DECREMENT # OF FIXED
371  05 0027F  35      A       DCR       M                   EVENTS LEFT
372  05 00280  EB      A       XCHG                          RESTORE H&L
373  05 00281  C37502  N   ENDWHILE
374  05 00284  2A58FB  N   LHLD      P@TBL@A                 H&L=ADDR OF LAST MS ADDR IN RUN
375  05 00287  2B      A   DCX       H                       MOVE H&L POINTER BACK TO POINT
376  05 00288  2B      A   DCX       H                       AT THE BEGINNING OF THE LAST
```

```
05 00289   2B        A          DCX     H                          EVENT (OVER@RUN) & STORE IT
05 0028A   2264FD    N          SHLD    EV@PTR:                    FOR MACH CLK INTERRUPT HANDLER
05 0028D   3E80      A          SFLG    TBLD@FIN                   DENOTES PITCH TABLE IS COMPLETE
05 0028F   325DF4    A
05 00292   C9        A          RET
                                *
                                *       SUBROUTINE TO CALCULATE REL DIFFERENCE BETWEEN
                                *       2 EVENTS & MOVE REST OF TABLE TO RUN TABLE
                                *
05 00293   3A5EF4    A   TBLD@UPD IF:       FLG,TBLD@1ST,T          THIS IS THE FIRST EVENT
05 00296   07        A
05 00297   D2AF02    N
05 0029A   AF        A              CFLG      TBLD@1ST              YES, CLR FLAG TO KEEP OUT
05 0029B   325EF4    A
05 0029E   7E        A              MOV       A,M                   A= LS OF 1ST EVENT ABS CLK CNT
05 0029F   3251FA    N              STA       EV@1@TIM              USED AT PITCH RESET
05 002A2   5F        A              MOV       E,A                   E=LS OF 1ST EVENT ABS CLK CNT
05 002A3   23        A              INX       H                     H&L=ADDR OF MS ABS CLK CNT
05 002A4   56        A              MOV       D,M                   D=MS OF 1ST EVENT ABS CLK CNT
05 002A5   EB        A              XCHG                            D&E= ADDR OF MS ABS CLK CNT
05 002A6   2256FB    N              SHLD      LCLK@CNT              STORE ABS CLK OF 1ST EVENT
05 002A9   21E8FE    N              LXI       H,EV@BASE:            H&L = ADDR OF RUN TABLE
05 002AC   C3D802    N          ELSE:
05 002AF   5E        A              MOV       E,M                   E=LS CLK CNT OF NEW EVENT
05 002B0   23        A              INX       H                     H&L= ADDR OF MS ABS CLK CNT
05 002B1   56        A              MOV       D,M                   D=MS CLK CNT OF NEW EVENT
05 002B2   E5        A              PUSH      H                     SAVE ADDR OF MS ABS CLK CNT
05 002B3   2A56FB    N              IF:       XWRD,LCLK@CNT,GE,D    IS LAST CLK CNT GE NEW CLK CNT
05 002B6   CD0000    N
05 002B9   DAC502    N
05 002BC   23        A                  INX       H                 H&L= LAST CLK CNT + 1
05 002BD   2256FB    N                  SHLD      LCLK@CNT          STORE IT FOR NEXT TIME
05 002C0   3E01      A                  MVI       A,1               PUT THIS EVENT AT THE NEXT CLK
05 002C2   C3CC02    N              ELSE:
05 002C5   45        A                  MOV       B,L               B=LS CLK CNT OF LAST EVENT
05 002C6   EB        A                  XCHG                        H&L=ABS CLK CNT OF NEW EVENT
05 002C7   2256FB    N                  SHLD      LCLK@CNT          STORE IT FOR THE NEXT TIME
05 002CA   7D        A                  MOV       A,L               A=LS CLK CNT OF NEW EVENT
05 002CB   90        A                  SUB       B                 FIND DIFF (ONLY NEED LS IF CLK
                                    ENDIF                           CNTS BETWEEN EVENTS <256)
05 002CC   D1        A              POP       D                     D&E=ADDR OF MS OF CLK OF NEW EV
05 002CD   2A58FB    N              LHLD      P@TBL@A               H&L= ADDR OF END OF LAST RUN EV
05 002D0   2B        A              DCX       H                     MOVE H&L POINTER
05 002D1   2B        A              DCX       H                     TO REL DIFF OF LAST
05 002D2   2B        A              DCX       H                     EVENT IN RUN TABLE
05 002D3   77        A              MOV       M,A                   MOVE REL DIFF TO RUN TABLE
05 002D4   23        A              INX       H                     INCREMENT RUN TABLE
05 002D5   23        A              INX       H                     POINTER OVER LAST
05 002D6   23        A              INX       H                     EVENT
05 002D7   23        A              INX       H
                                ENDIF
05 002D8   23        A          INX       H                         H&L= ADDR OF SR# IN RUN TABLE
05 002D9   13        A          INX       D                         D&E= ADDR OF SR#
05 002DA   1A        A          LDAX      D                         MOVE SR# FROM TABLE TO
05 002DB   77        A          MOV       M,A                       RUN TABLE
05 002DC   23        A          INX       H                         MOVE POINTERS TO LS 8 BITS
05 002DD   13        A          INX       D                         OF EVENT ADDR
05 002DE   1A        A          LDAX      D                         MOVE LS 8 BITS OF ADDR
```

```
430   05 002DF    77        A            MOV       M,A                          MOVES POINTER TO MS 8 BITS
431   05 002E0    23        A            INX       H                            OF EVENT ADDR
432   05 002E1    13        A            INX       D                            MOVES MS 8 BITS OF ADDR
433   05 002E2    1A        A            LDAX      D
434   05 002E3    77        A            MOV       M,A
435   05 002E4    2258FB    N            SHLD      POTBL@A                      STORE ADDR OF RUN TABLE
436   05 002E7    13        A            INX       D                            POINTER TO LS 8 BITS OF CLK CNT
437   05 002E8    EB        A            XCHG                                   H&L= ADDR OF LS 8 BITS OF CLK
438   05 002E9    C9        A            RET
440                                  *
441                                  *    SUBROUTINE TO DETERMINE IF MODIFIED FO ON EVENT
442                                  *    CLK COUNT IF CLK COUNT RESULTS ARE NEGATIVE OR 0
443                                  *
444   05 002EA    7C        A   ON@MOD   MOV       A,H                          A= MS PART OF ABS CLK COUNT
445   05 002EB    07        A            RLC                                    CARRY= SIGN OF ABS CLK COUNT
446   05 002EC    D20203    N            IF:       CC,C,S                       IS THE ABS CLK CNT NEG
447   05 002EF    119603    A                LXI       D,BASE@CNT               YES,ADD # CLK COUNTS PER PITCH
448   05 002F2    19        A                DAD       D                        TO NEG #
449   05 002F3    118E03    A                IF:       XWRD,H,GE,SAFE@CNT       IS RESULTS GE SAFE # CLK/PITCH
      05 002F6    C00000    N
      05 002F9    DAFF02    N
450   05 002FC    210100    A                    LXI       H,1                  YES,MOVE TO TURN ON LATER
451                                            ENDIF
452   05 002FF    C30E03    N            ORIF:     XWRD,H,EQ,0                  IF RESULTS = 0, MOVE LATER IN
      05 00302    110000    A
      05 00305    C00000    N
      05 00308    C20E03    N
453   05 00308    210100    A                LXI       H,1                      PITCH BECUASE FVENT MUST BE > 0
454                                        ENDIF
455   05 0030E    C9        A            RET
456                                      END

CONTROL SECTION SUMMARY: 01 00000   PT 0     02 00000   PT 0     03 00000   PT 0     04 0FFD8   PT 2
                         05 0030F   PT 1
* NO UNDEFINED SYMBOLS
*    ERROR SEVERITY LEVEL: 0
* NO ERROR LINES
```

TABLE VIII

```
219                                  *
220                                  * PITCH RESET INTERRUPT HANDLER
221                                  *

223   06 000F9    FB        A   RSET:    EI                                     RE-ENABLE INTERRUPTS
224   06 000FA    F5        A            PUSH      PSW                          SAVE A-REG & CONDITION BITS
225   06 000FB    3A5DF4    A            IF:       FLG,TBLD@FIN,T               IS PITCH TABLE BUILD FINISHED
      06 000FE    07        A
      06 000FF    D26201    N
226   06 00102    E5        A                PUSH      H                        SAVE H&L
227                                        IF:       FLGS,SR@DONE,T           YES, IS THERE A NEW SR VALUE
228   06 00103    3A4DF4    A                          AND,910@DONE,T           YES, DID 910 EVENT GET DONE
      06 00106    216FF4    A
      06 00109    A6        A
      06 0010A    F25501    N
```

```
229   06 0010D   AF       A
      06 0010E   326FF4   A
230   06 00111   324DF4   A
231   06 00114   2163FD   A
232   06 00117   7E       A
233   06 00118   C60F     A
234   06 0011A   E66F     A
235   06 0011C   77       A
236   06 0011D   26FE     A
237   06 0011F   6F       A
238   06 00120   3A69FD   A
239   06 00123   77       A
240   06 00124   3A51FA   A
241   06 00127   326EFD   A
242   06 0012A   21E8FE   A
243   06 0012D   2264FD   A
244
245
246   06 00130   3AABF4   A
      06 00133   21AAF4   A
      06 00136   B6       A
      06 00137   21AFF4   A
      06 0013A   B6       A
      06 0013B   FA5201   N
247   06 0013E   2166FD   A
248   06 00141   7E       A
      06 00142   FE05     A
      06 00144   CA5201   N
249   06 00147   FE04     A
      06 00149   C25101   N
250   06 0014C   3E80     A
      06 0014E   32ADF4   A
251
252   06 00151   34       A
253
254
255   06 00152   C36101   N
256   06 00155   3E80     A
      06 00157   32A9F4   A
257   06 0015A   2132FD   A
      06 0015D   3E40     A
      06 0015F   B6       A
      06 00160   77       A
258
259   06 00161   E1       A
260
261   06 00162   3EFE     A
262   06 00164   3200E6   A
263   06 00167   F1       A
264   06 00168   C9       A
```

```
CFLG      910@D@NE                YES, RESET & MACH CLK TIMING OK

M@DFLG    SR@D@NE                 CLR FLAG UNTIL NEXT SR EVENT
LXI       H,ADR(DATA,SR@PTR!)     LOAD RELATIVE
M@V       A,M                                   PNTR T@ SR #0
M@DBYT    A,ADD,15                M@VE PNTR BACK
M@DBYT    A,AND,SR@ADJ!                          BY 1 (CIRCULAR)
M@V       M,A                     SAVE NEW REL SR PNTR IN SR@PTR!
MVI       H,HADR(DATA,SHIFTREG)   H&L= ABS ADDR
M@V       L,A                     ,                 @F SR #0
LDA       ADR(DATA,SR@VALU!)      A= NEW SR VALUF FR@M SRSK
M@V       M,A                     UPDATE C@NTENTS @F SR#0
LDA       ADR(DATA,EV@1@TIM)      INIT MCLK!CNT
STA       ADR(DATA,MCLK!CNT)                    T@ 1ST EVENT TIME
LXI       H,ADR(DATA,EV@BASE!)    INIT EV@PTR!
SHLD      ADR(DATA,EV@PTR!)                     TA 1ST EVENT ADDR
IF:       FLGS,N@RM@DN!,,         IS N@RMAL SHUT@WN REQUESTED
          AND,CYCL@DN!,,          N@, IS CYCLE-D@WN REQUESTED
          AND,SD1@DLY,F           N@, IS PR@C DEAD CYCLING


    LXI       H,ADR(DATA,CYCUPCT!) N@, L@AD CYCLE-UP CNTR
    IF:       XBYT,M,NE,5          IS PR@C IN CYCLE-UP M@DE


      IF:       XBYT,A,EQ,4        YES, IS IT RDY T@ MAKE 1ST IMG

                SFLG      IMGMADE! YES, SIGNAL 1ST IMAGE MADE

            ENDIF
            INR       M            INCRM CYCLE-UP CNTR (UNTIL= 5)
        ENDIF
    ENDIF
ELSE!                              NEW SR VALUE N@T AVAILABLE
    SFLG      IMED@DN!             REQUEST AN IMED SHUTD@WN

    SFBIT,P   E@PR@FLT             SIGNAL EARLY PITCH RESET FAULT


ENDIF
P@P       H                        RESTORE H&L
ENDIF
MVI       A,RSETFF!                RESET PITCH RESET
STA       ADR(EQU,RSINTFF!)                  ,          INT FLIP-FL@P
P@P       PSW                      RESTORE A-REG & C@NDITION BITS
RET                                RETURN T@ INTERRUPTED R@UTINE
```

TABLE IX

```
57                                  *
58                                  * MACHINE CLOCK INTERRUPT HANDLER
59                                  *

61        06 0002B                  ORIGIN    X'38'                    INTERRUPT TRAP CELL LOCATION

64   06 00038   F5       A   MCLK:  PUSH      PSW                      SAVE A-REG & CONDITION CODES
65   06 00039   3A6EFD   A          LDA       ADR(DATA,MCLK:CNT)       IS THERE
66   06 0003C   3D       A          DCR       A                                  A PITCH
67   06 0003D   C26600   N          IF:       CC,Z,S                                   EVENT TO DO
68   06 00040   E5       A              PUSH      H                    YES, SAVE
69   06 00041   D5       A              PUSH      D                              ALL REMAINING
70   06 00042   C5       A              PUSH      B                                          REGS
71   06 00043   2A64FD   A              LHLD      ADR(DATA,EVOPTR:)    H&L= 1ST LOC OF NEXT PE TO DO
72   06 00046   7E       A              MOV       A,M                  SAVE RELATIVE DIFFERENTIAL TO
73   06 00047   326EFD   A              STA       ADR(DATA,MCLK:CNT)    NEXT EVENT (# CLOCK COUNTS)
74   06 0004A   23       A              INX       H                    MOVE PNTR TO REL SR IN TABLE
75   06 0004B   3A63FD   A              LDA       ADR(DATA,SROPTR:)    LOAD REL POSITION OF SR #0
76   06 0004E   86       A              MODBYT    A,ADD,M              C= LS PORTION OF ADDR OF THE
77   06 0004F   E66F     A              MODBYT    A,AND,SROADJ:         REQUESTED SHIFT REGISTER
78   06 00051   4F       A              MOV       C,A                   POSITION (FOR USE WITHIN PE)
79   06 00052   06FE     A              MVI       B,HADR(SHIFTREG)     B&C= ADDR REQUESTED SR POSITION
80   06 00054   0A       A              LDAX      B                    A= <REQUESTED SR POSITION>
81   06 00055   23       A              INX       H                    E= LS PORTION OF ADDR OF THE
82   06 00056   5E       A              MOV       E,M                   REQUESTED PITCH EVENT
83   06 00057   23       A              INX       H                    D= MS PORTION OF ADDR OF THE
84   06 00058   56       A              MOV       D,M                   REQUESTED PITCH EVENT
85   06 00059   23       A              INX       H                    SAVE PNTR TO
86   06 0005A   2264FD   A              SHLD      ADR(DATA,EVOPTR:)              NEXT PITCH EVENT
87   06 0005D   CD0000   N              CALL      DE:IND               VECTOR TO REQUESTED PITCH EVENT
88   06 00060   C1       A              POP       B                    RESTORE
89   06 00061   D1       A              POP       D                            SAVED
90   06 00062   E1       A              POP       H                                  REGISTERS
91   06 00063   C37000   N          ELSE:
92   06 00066   326EFD   A              STA       ADR(DATA,MCLK:CNT)   NO PE; SAVE DECRM'D 'MCLK:CNT'
93   06 00069   0F       A              RRC                            IS IT TIME FOR
94   06 0006A   D27000   N              IF:       CC,C,S                                A REFRESH
95   06 0006D   3202E6   A                  REFRESH                    YES, REFRESH RFMOTES (1 MSEC)
96                                      ENDIF
97                                  ENDIF
98   06 00070   FB       A          EI                                 RE-ENABLE INTERRUPT SYSTEM
99   06 00071   3EFD     A          MVI       A,MCLKFF:                RESET MCLK
100  06 00073   3200E6   A          STA       ADR(EQU,RSINTFF:)                INTERRUPT FLIP-FLOP
101  06 00076   F1       A          POP       PSW                      RESTORE A-REG & CONDITION CODES
102  06 00077   C9       A          RET                                RETURN TO INTERRUPTED ROUTINE
```

TABLE X

```
139
140                                  *
141                                  * REAL TIME CLOCK INTERRUPT HANDLER
                                     *
143   06 00081   FB        A   RTC:   EI                                  RE-ENABLE INTERRUPTS
144   06 00082   F5        A         PUSH     PSW                        SAVE A-REG & CONDITION BITS
145   06 00083   3EF7      A         MVI      A,RTCFF:                   RESET RTC
146   06 00085   3200E6    A         STA      ADR(EQU,RSINTFF:)
                                                                         INTERRUPT FLIP-FLOP
147   06 00088   D5        A         PUSH     D                          SAVE D&E REGS
148   06 00089   E5        A         PUSH     H                          SAVE H&L REGS
149   06 0008A   C5        A         PUSH     B                          SAVE 'B' REGISTER
150                                  *
151   06 0008B   2150FD    N         DECBYT   GLB:TIMR                   DECREMENT THE CLOCK CELL
      06 0008E   35        A
152   06 0008F   7E        A         MOV      A,M                        A = <GLB:TIMR>  ( 0 TO 255 )
153   06 00090   23        A         INX      H                          MEM. PTR. TO SB:RQST BYTE
154   06 00091   E601      A         IF:      XBYT,A,AND,X'01',NZ        IS IT 20 MSEC TIME YET
      06 00093   CA9000    N
155   06 00096   7E        A             MODBYT   M,OR,10:RQST|20:RQST   YES - BOTH 10 AND 20 BKGD
      06 00097   F6C0      A
      06 00099   77        A
156   06 0009A   C3A100    N         ELSE:
157   06 0009D   7E        A             MODBYT   M,OR,10:RQST           NO - 10 BKGD ONLY
      06 0009E   F680      A
      06 000A0   77        A
158                                  ENDIF
159   06 000A1   23        A         INX      H                          MEM. PTR. TO DIVD:10 CNTR
160   06 000A2   35        A         DCR      M                          DECREMENT 10 TO 0 COUNTER
161   06 000A3   C2AD00    N         IF:      CC,Z,S                     HAS 100 MSEC PASSED
162   06 000A6   360A      A             MVI      M,10                   YES - RESET THE 10 TO 0 COUNTER
163   06 000A8   2B        A             DCX      H                      MEM. PTR. BACK TO SB:RQST
164   06 000A9   7E        A             MODBYT   M,OR,100:RQST          ADD 100 BKGD TO REQUEST BYTE
      06 000AA   F620      A
      06 000AC   77        A
165                                  ENDIF
166                                  REPEAT
167   06 000AD   2150FD    N             LXI      H,GLB:TIMR             NOW CHECK FOR TIME OUTS
168   06 000B0   46        A             MOV      B,M                    LOAD 'B' WITH QUANTITY TO LOOK
169   06 000B1   16FB      A             MVI      D,COUNT:               FOR (CLOCK CELL VALUE)
170   06 000B3   CD0000    N             CALL     FIND:LOC               SET 'D' FOR TABLE TO SEARCH
171   06 000B6   CAF000    N             IF:      CC,Z,C                 GO LOOK IN ACTIVE LIST
172   06 000B9   E5        A                 PUSH     H                  HAS A MATCH BEEN FOUND
173   06 000BA   26FC      A                 MVI      H,ID:              YES - SAVE LOCATION ON STACK
174   06 000BC   5E        A                 MOV      E,M                SEGWAY MEM PTR TO ID: TABLE
175   06 000BD   1600      A                 MVI      D,0                NOW ASSEMBLE
176   06 000BF   21C8F4    A                 LXI      H,TMR:FLGS         ADDRESS OF TIMER
177   06 000C2   19        A                 DAD      D                  FLAG INTO THE
178   06 000C3   0600      A                 MVI      B,0                MEMORY POINTER
179   06 000C5   F3        A                 DI                          GET SET TO CLEAR THE FLAG
180   06 000C6   7E        A                 MOV      A,M                NO INTERRUPTIONS NOW, PLEASE
181   06 000C7   07        A                 RLC                         GET FLAG
182   06 000C8   D2EC00    N                 IF:      CC,C,S             INTO THE CARRY BIT
183   06 000CB   70        A                     MOV      M,B            IS FLAG SET
184   06 000CC   FB        A                     EI                      YES - RESET AND NOW
185   06 000CD   E1        A                     POP      H              EVERYBODY CAN INTERRUPT AGAIN
186   06 000CE   26FD      A                     MVI      H,LS:ADDR      LOCATION FROM STACK TO MEM PTR
                                                                         SEGWAY MEM PTR TO LS: TABLE
```

```
187   06 000D0   5E       A                 MOV      E,M              GET LS TIME-OUT ADDRESS
188   06 000D1   24       A                 INR      H                SEGWAY MEM PTR TO MSI TABLE
189   06 000D2   56       A                 MOV      D,M              GET MS TIME-OUT ADDRESS
190   06 000D3   45       A                 MOV      B,L              LOCATION TO 'B' TEMPORARILY
191   06 000D4   2A5FFD   N                 LHLD     INPTR:           STUFF TIME-OUT ADDRESS INTO
192   06 000D7   73       A                 MOV      M,E              INTO TABLE OF TIME-OUT
193   06 000D8   23       A                 INX      H                ADDRESSES THAT IS CHECKED
194   06 000D9   72       A                 MOV      M,D              FOR ENTRIES EVERY 10 MSECONDS
195   06 000DA   23       A                 INX      H                BY THE STATE CHECKER
196   06 000DB   7D       A                 MODBYT   L,AND,TIME:MSK   FORCE A CIRCULAR TABLE
      06 000DC   E62F     A
      06 000DE   6F       A
197   06 000DF   225FFD   N                 SHLD     INPTR:           SAVE NEW ADDRESS LOCATION
198   06 000E2   58       A                 MOV      E,B              LOCATION BACK TO 'E'
199   06 000E3   CD0000   N                 CALL     DEACTIV:         TAKE OUT OF ACTIVE TIMER LIST
200   06 000E6   CD0000   N                 CALL     PUT:             AND MAKE LOCATION AVAILABLE
201   06 000E9   C3EE00   N              ELSE:                        * * * FLAG IS NOT SET SO
202   06 000EC   FB       A                 EI                          LET INTERRUPTIONS OCCUR
203   06 000ED   E1       A                 POP      H                  MAKE THE STACK RIGHT AND
204                                     ENDIF                         FORCE NON-ZERO CONDITION TO
205   06 000EE   F601     A              MODBYT   A,OR,1                STAY IN UNTIL LOOP
206                                 ENDIF                             * * * NO MATCH - RTC COMPLETE
207   06 000F0   C2AD00   N          UNTIL:   CC,Z,S                   WILL FALL THROUGH THIS CRACK
208                                *
209   06 000F3   E1       A          POP      H                        RESTORE THE
210   06 000F4   44       A          MOV      B,H                      'B' REGISTER
211   06 000F5   E1       A          POP      H                        RESTORE H&L REGS
212   06 000F6   D1       A          POP      D                        RESTORE D&E REGS
213   06 000F7   F1       A          POP      PSW                      RESTORE A-REG & CONDITION CODES
214   06 000F8   C9       A          RET                               RETURN TO 'FLOAT' BACKGROUND
215                                *
```

TABLE XI

```
124                                *
125                                *        SHIFT REGISTER SCHEDULER EVENT
126                                *
127                                *        AT SR #4 + 850 CLOCK COUNTS
128                                *
129   05 0016B   E621     A   SRSK@EV  MODBYT   A,AND,SRSRT:|SRIMG:        CHECK FOR A SHFET THAT IS GOING
130   05 0016D   FE21     A           IF:      XBYT,A,EQ,SRSRT:|SRIMG:      TO THE SORTER
      05 0016F   C27801   N
131   05 00172   110000   N              LXI      D,MOT@ON                 YES, TURN ON SORTER MOTOR
132   05 00175   CD0000   N              CALL     SP@@L:                   SP@@L JOB TO BACKGROUND LIST
133                                   ENDIF
134   05 00178   110000   N           LXI      D,SRSK                     NOW RUN SH-REG SCHED., BUT
135   05 0017B   CD0000   N           CALL     SP@@L:                     SP@@L JOB TO BACKGROUND LIST
136   05 0017E   C9       A           RET
137                                 END
```

```
CØNTRØL SECTIØN SUMMARY: 01 00000   PT 0     02 00000   PT 0     03 00000   PT 0     04 0FFD8   PT 2
                         05 0017F   PT 1
* NØ UNDEFINED SYMBØLS
*    ERRØR SEVERITY LEVEL: 0
* NØ ERRØR LINES
```

TABLE XII

```
579                          *                 **************
580                          *                 *            *
581                          *                 *   SPØØL:   *
582                          *                 *            *
583                          *                 **************

585                          *   SUBR TØ SPØØL LØNG PITCH EVENTS INTØ A TABLE THAT IS SCANNED IN BACKGRØUND.
586                          * EXECUTIØN TIME= 48 USEC    ENTER WITH D&E= ADDRESS ØF SUBR TØ SPØØL

588   05 00174   2A6AFD   A   SPØØL:   LHLD    ADR(DATA,SPL:IN)        SPØØLING TABLE INPUT PNTR
589   05 00177   73       A           MØV     M,E                     STØRE LS PØRTIØN ØF SUBR ADDR
590   05 00178   23       A           INX     H                       INCRM SPØØLING PNTR
591   05 00179   72       A           MØV     M,D                     STØRE MS PØRTIØN ØF SUBR ADDR
592   05 0017A   23       A           INX     H                       INCRM SPØØLING PNTR
593   05 0017B   7D       A           MØV     A,L                     A= LS PØRTIØN ØF SPØØLING PNTR
594   05 0017C   E64F     A           MØDBYT  A,AND,SPL:MSK           FØRCE CIRCULAR
595   05 0017E   326AFD   A           STA     ADR(DATA,SPL:IN)                SPØØLING TABLE
596   05 00181   C9       A           RET                             RETURN TØ PITCH EVENT
```

Figure 40A:
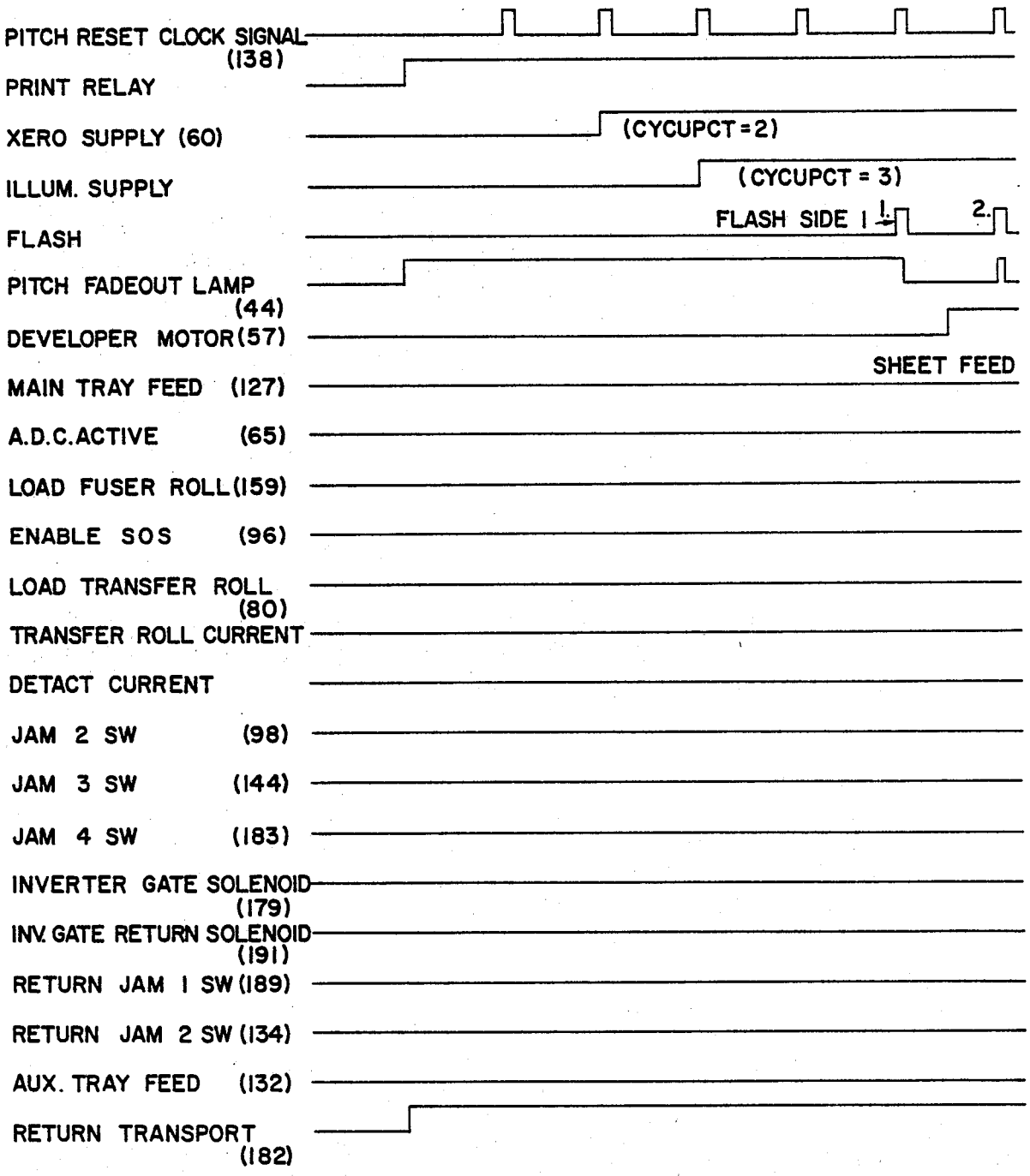
FIGS. 40*a*, 40*b*, 40*c* are a timing chart of the principal operating components of the host machine in an exemplary copy run.
Figure 40B:
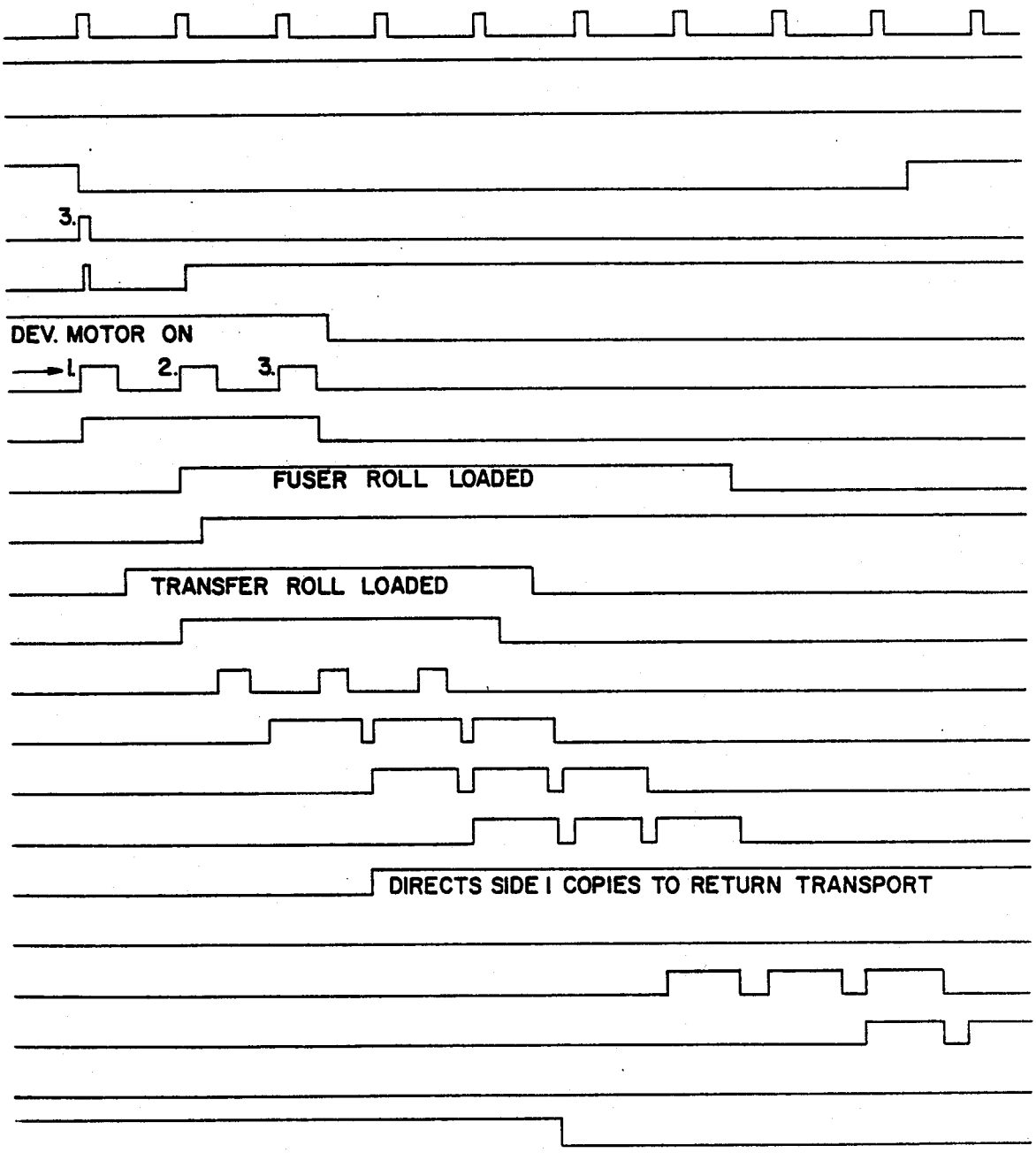
Figure 40C:
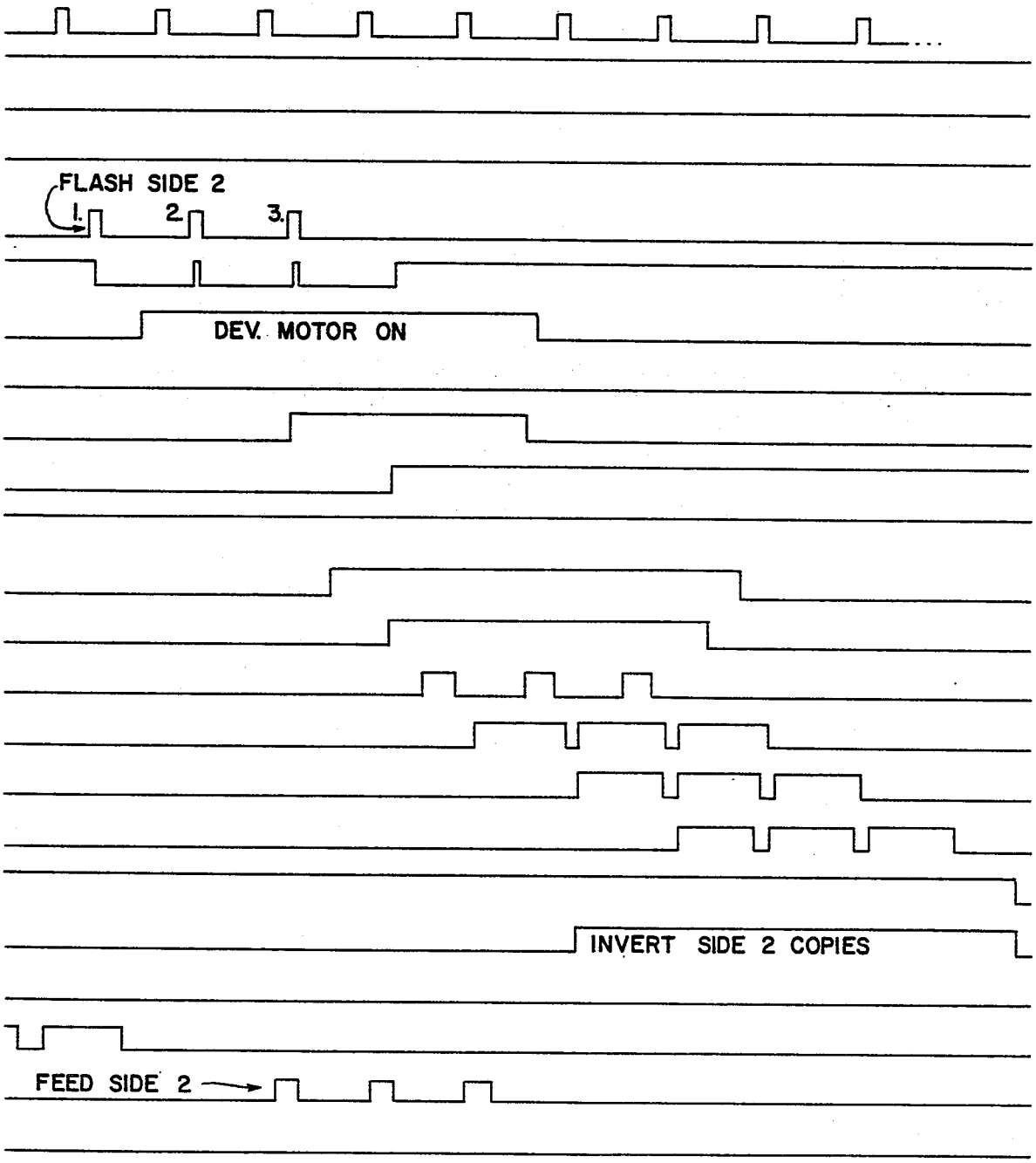

Referring particularly to the timing chart shown in FIg. 40, an exemplary copy run wherein three copies of each of two simplex or one-sided originals in duplex mode is made. Referring to FIG. 32, the appropriate button of copy selector 808 is set for the number of copies desired, i.e. 3 and document handler button 822, sorter select button 825 and two sided (duplex) button 811 depressed. The originals, in this case, two simplex or one-sided originals are loaded into tray 233 of document handler 16 (FIG. 14) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

Figure 41:
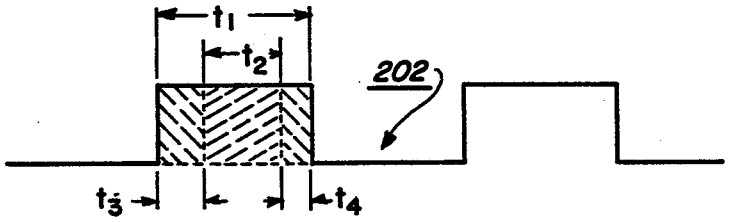
FIG. 41 is an enlarged view of a machine clock pulse illustrating timing interval breakdowns.

During the run, the first original is advanced onto platen 35 by document handler 16 where, as seen in FIG. 41, three exposures (1ST FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 (referred to as an inverter gate in the tables) to return transport 182 and carried to auxiliary tray 102. The image bearing sheets entering tray 102 are aligned by edge pattern 187 in preparation for refeeding thereof.

Following delivery of the last copy sheet to auxiliary tray 102, the document handler 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship from auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into an output receptacle such as sorter 14 where, in this example, the sheets are placed in successive ones of the first three trays 212 of either the upper of lower arrays 210, 211 respectively depending on the disposition of deflector 220.

As described, the various foreground routines are carried out through a multiple prioritized interrupt system wherein the background routine in progress is interrupted to carry out, at the appropriate time, a fresh foreground routine. Referring particularly to FIG. 41, an enlarged portion of the machine clock pulse signal 202 is there shown. As shown, the interrupt portion of the clock pulse has an overall time span or interval $t_1$. A portion of the interrupt $t_2$ is reserved for carrying out the foreground routine called, with intervals $t_3$, $t_4$ prior to and after the interval $t_2$ for entry and exit to the routine.

Where the routine is overlong, i.e. requires an interval greater than the interval $t_2$ available, the routine is instead placed or spooled in with the background routines where the time available for carrying out the routine is greater. Referring to Table I (STCK), real time oriented background routines are called in accordance with a predetermined call priority. In the exemplary arrangement shown (Table I, "Synchronized Background Control Loops"), spooled calls are third in priority after 10 msec. time out requests and 10 msec. calls and before 20 msec. calls. This results in a call being made for a spooled routine, i.e. an overlong foreground routine, periodically, (i.e. every 10 msec.) on a real time basis.

Figure 42:
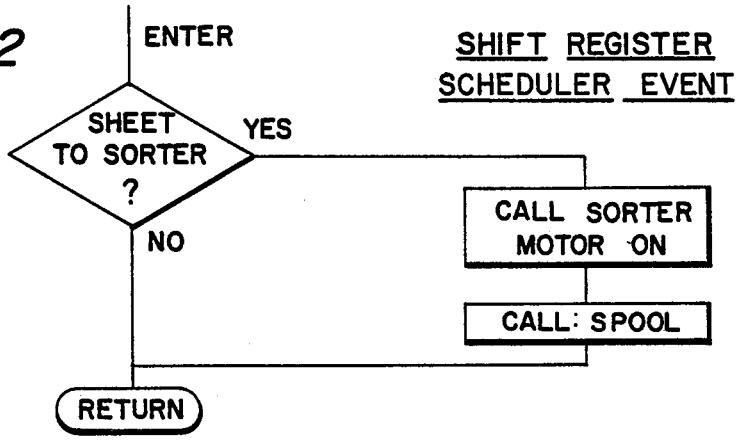
FIG. 42 is a flow chart of the shift register scheduler routine.
Figure 43:
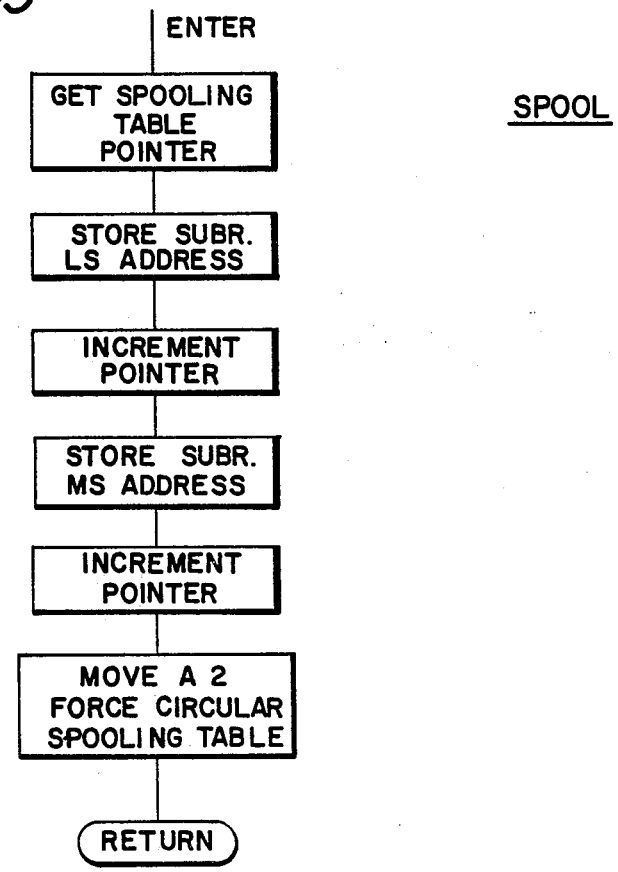
FIG. 43 is a flow chart of the spooling routine of the present invention.

While certain overlong foreground routines lend themselves to permanent spooling or placement with the background routines, others may only require spooling under certain machine operating programs. Referring to the Fixed Pitch Event Table II, at clock pulse 850, pitch 4, the Shift Register Scheduler Event (SRSK EV) of Table XI and FIG. 42 is called. This routine looks to see if a copy sheet is going to sorter 14, and if so, sorter motors 222 are turned on and the spooling routine (SPOOL) of Table XII and FIG. 43 is called.

The spooling routine (SPOOL) obtains the address of the spooling table input pointer, stores the address of the routine spooled, and returns to the pitch event. The spooled routine is executed in background when the spooled calls are made.

Where the Shift Register Scheduler Event (Table XI) finds that the sheet is not going to sorter 14 return is made to the pitch event and the affected foreground routine is not spooled.

As will be understood, sorter 14 may be selected or not selected by the operator through the use of sorter select buttons 825, 826 on console 800 (FIG. 23). And, in cases where duplex or two sided copies are selected, the first pass copy sheets are returned to auxiliary tray 102 rather than sorter 14.

It will be understood that the entire foreground routine or only the excess portion thereof may be spooled into background. In the case of the latter, the portion of the routine in foreground would be performed when the routine is called at the designated clock pulse count (i.e. EVENT 850, 4, SRSK EV of Fixed Pitch Event Table II) with the remaining portion performed when called in background. It will be further understood that background routine priorities may be arranged so as to call the spooled routine on return to background following the initiating machine clock pulse. In this instance, the interrupted routine would be performed at one time with a short hiatus accassioned by exit from foreground to background.

While the invention has been described with reference to the structure disclosed, it is not confined to the details set forth, but is intended to cover such modifications or changes as may come within the scope of the following claims.

What is claimed is:

1. In the method of operating an electrostatic type copy reproducing machine having a plurality of processing stations to produce copies in accordance with copy run instructions, said machine including relatively permanent background operating routines for operating said machine and foregrond routines, at least a portion of said foreground routines reflecting said copy run instructions, the steps which comprise:

a. actuating said background routines in preset timed order to render said processing stations operable;
b. interrupting said background routines periodically and in synchronism with said machine for a preset interval to carry out a foreground routine to activate predetermined processing stations;
c. shifting at least the portion of a foreground routine that cannot be completed in said preset interval into said background routine; and
d. completing any of said overlong foreground routine on return to said background routine.

2. The method according to claim 1 including the step of integrating said shifted foreground routine into said background routines preset timed order.

3. The method of accommodating an overlong control routine in the control system of an electrostatic type copier, said control system being composed of background routines and foreground routines together with interrupt means for periodically interrupting the background routine in progress to provide control data from said foreground routines, the steps consisting of:

a. placing a portion of said overlong routine with said foreground routines; and
b. placing the remainder of said overlong routine with said background routines.

* * * * *